US006909417B2

(12) United States Patent
Washio et al.

(10) Patent No.: US 6,909,417 B2
(45) Date of Patent: Jun. 21, 2005

(54) SHIFT REGISTER AND IMAGE DISPLAY APPARATUS USING THE SAME

(75) Inventors: Hajime Washio, Tenri (JP); Yasushi Kubota, Sakurai (JP); Kazuhiro Maeda, Tenri (JP); Yasuyoshi Kaise, Tenri (JP); Michael James Brownlow, Oxford (GB); Graham Andrew Cairns, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 50 days.

(21) Appl. No.: 09/578,440

(22) Filed: May 25, 2000

(65) Prior Publication Data

US 2003/0174115 A1 Sep. 18, 2003

(30) Foreign Application Priority Data

May 28, 1999 (JP) ..... 11-150682

(51) Int. Cl.[7] ..... G09G 3/36

(52) U.S. Cl. ..... 345/98; 345/55; 345/56; 345/99; 345/100; 345/103; 327/140; 327/141; 327/143; 327/333; 326/39; 326/40; 326/80; 377/64

(58) Field of Search ..... 345/100, 103, 345/98, 99, 55, 56; 327/140, 141, 143, 333; 326/39, 40, 80; 377/64

(56) References Cited

U.S. PATENT DOCUMENTS 5,210,712 A * 5/1993 Saito ..... 708/819
5,252,957 A * 10/1993 Itakura ..... 345/98
5,387,934 A * 2/1995 Nakamura ..... 348/312
5,576,737 A 11/1996 Isozaki
5,642,128 A * 6/1997 Inoue ..... 345/96
5,778,237 A * 7/1998 Yamamoto et al. ..... 713/322
5,781,171 A 7/1998 Kihara et al.
6,081,131 A * 6/2000 Ishii ..... 326/68
6,160,533 A * 12/2000 Tamai et al. ..... 345/89
6,219,020 B1 * 4/2001 Furuhashi et al. ..... 345/100
6,232,945 B1 * 5/2001 Moriyama et al. ..... 345/98
6,236,260 B1 * 5/2001 Vest et al. ..... 327/536
6,271,818 B1 * 8/2001 Yamazaki et al. ..... 345/92
6,414,670 B1 * 7/2002 Kim ..... 345/98
6,683,605 B1 * 1/2004 Bi et al. ..... 345/211

FOREIGN PATENT DOCUMENTS

JP 60-150323 8/1985
JP 63-271298 11/1988
JP 02-054621 2/1990

(Continued)

OTHER PUBLICATIONS

*High–Performance Column Driver for Gray–Scale TFEL Displays*, S.A. Steiner, H.Y. Tsoi, SID 88 DIGEST (1988) pp. 31–34.

European Search Report dated May 14, 2001 for Application EP 00 11 1192.

*Primary Examiner*—Xiao Wu
*Assistant Examiner*—Abbas Abdulselam
(74) *Attorney, Agent, or Firm*—David G. Conlin; Steven M. Jensen; Edwards & Angell, LLP

(57) ABSTRACT

A level shifter 13 is provided for each of SR flip flops F1 constituting a shift register 11. The level shifter 13 increases a voltage of a clock signal CK. This arrangement reduces a distance for transmitting a clock signal whose voltage has been increased, as compared with a construction in which a voltage of a clock signal is increased by a single level shifter and the signal is transmitted to each of the flip flops; consequently, a load capacity of the level shifter can be smaller. Furthermore, each of the level shifters is operated during a pulse output of the previous level shifter 13, and the operation is suspended at the end of the pulse output. Thus, the level shifters 13 can operate only when it is necessary to apply a clock signal CK to the corresponding SR flip flop F1. As a result, even when an amplitude of a clock signal is small, it is possible to reduce power consumption of the shift resister under normal operation.

31 Claims, 35 Drawing Sheets

FOREIGN PATENT DOCUMENTS

| | | |
|---|---|---|
| JP | 03-147598 | 6/1991 |
| JP | 05-189990 | 7/1993 |
| JP | 7-168154 | 7/1995 |
| JP | 07-168154 | 7/1995 |
| JP | 07-248741 | 9/1995 |
| JP | 08-160387 | 6/1996 |
| JP | 09-219636 | 8/1997 |
| JP | 10-039823 | 2/1998 |
| JP | 10-062746 | 3/1998 |
| JP | 10-074060 | 3/1998 |
| JP | 10-199284 | 7/1998 |
| JP | 11-338431 | 12/1999 |
| JP | 2000-235374 | 8/2000 |
| JP | 2000-322020 | 11/2000 |
| JP | 2000-339985 | 12/2000 |

* cited by examiner

SHIFT REGISTER AND IMAGE DISPLAY APPARATUS USING THE SAME

FIELD OF THE INVENTION

The present invention relates to a shift register which can be favorably used for, for example, a driving circuit of an image display apparatus and can shift an input pulse even when a clock signal is smaller in an amplitude than a driving voltage, and further concerns an image display apparatus using the same.

BACKGROUND OF THE INVENTION

For instance, in a data signal line driving circuit and a scanning signal line driving circuit of an image display apparatus, a shift register has been widely used to adjust timing when sampling each data signal from an image signal, and to generate a scanning signal applied to each scanning signal line.

Meanwhile, the power consumption of an electronic circuit increases proportionally to a frequency, a load capacity, and the square of a voltage. Thus, a driving voltage has been set lower to reduce power consumption in a circuit connected to an image display apparatus, for example, in a circuit for generating an image signal transmitted to the image display apparatus, or in the image display apparatus itself.

Regarding a circuit using a polycrystalline silicon thin film transistor to secure a large display area, for example, in a pixel, a data signal line driving circuit, and a scanning signal line driving circuit, a driving voltage is not sufficiently reduced because a difference in a threshold voltage sometimes reaches about several [V] between substrates or on a single substrate. However, in a circuit using a monocrystalline silicon transistor such as the circuit for generating an image signal, a driving voltage is set at a value such as 5 [V], 3.3 [V], or a smaller value in many cases. Hence, when applying a clock signal lower than a driving voltage of the shift resistor, the shift register is provided with a level shifter for raising a voltage of the clock signal.

To be specific, as shown in FIG. 39, when a clock signal CK having an amplitude of about 5 [V] is applied to a conventional shift resistor 101, a level shifter 103 increases a voltage of the clock signal CK to a driving voltage (15[V]) of the shift resistor 101. The clock signal CK whose voltage has been increased is then applied to flip flops $F_1$ to $F_n$, and a shift resistor section 102 shifts a start signal SP in synchronization with the clock signal CK.

However, in the conventional shift register 101, the clock signal CK is level-shifted before being transmitted to the flip flops $F_1$ to $F_n$. Therefore, the longer a distance between the ends of the flip flops $F_1$ to $F_n$, the longer a distance for transmission, resulting in larger power consumption.

To be specific, the capacity of a signal line for transmission increases with a transmitting distance. Thus, the level shifter 103 requires a larger driving capability, thereby increasing power consumption. Further, as in the construction in which the polycrystalline silicon thin film transistor is used to form the driving circuit including the level shifter 103, when the driving capability of the level shifter 103 is not sufficient, it is necessary to provide a buffer 104 between the level shifter 103 and the flip flops $F_1$ to $F_n$ as indicated by a dotted line of the FIG. 39 to transmit a waveform without deformation. Consequently, larger power consumption is necessary.

In recent years, an image display apparatus with a larger display screen and a higher resolution has been demanded, so that more steps have been required for the shift resistor section 102. Therefore, there has been an increasing need for a shift register and an image display apparatus that can achieve small power consumption even in the case of a large distance between the ends of the flip flops $F_1$ to $F_n$.

SUMMARY OF THE INVENTION

In order to solve the aforementioned problem, a shift register of the present invention includes flip flops of a plurality of steps that operate in synchronization with a clock signal, and level shifters for increasing a voltage of a clock signal smaller in an amplitude than a driving voltage of the flip flop and for applying the clock signal to each of the flip flops, the shift register for transmitting an input pulse in synchronization with the clock signal being characterized by including the following means.

Namely, the flip flops are divided into a plurality of blocks, each including at least one flip flop. The level shifters are respectively provided in the blocks. Among a plurality of the level shifters, at least one of the level shifters, which correspond to the blocks requiring no clock signal input for transmitting the input pulse, is suspended at that point.

Here, the flip flops constituting the shift register determine whether a clock signal is necessary or not for transmitting an input pulse in each of the blocks. For instance, when set reset flip flops are used as the flip flops, between a pulse input to a block and a setting of the flip flop of the final step, the block needs a clock signal. Meanwhile, when D flip flops are used as the flip flops, between a pulse input to a block and the end of a pulse output of the flip flop of the final step, the block needs a clock signal. Additionally, in any one of the cases, a construction is acceptable in which each of the blocks includes a single flip flop and the level shifter is provided for each of the flip flops or for a plurality of the flip flops.

According to the above arrangement, a voltage of a clock signal is increased in any one of a plurality of the level shifters and is applied to the flip flops in the block corresponding to the level shifters, and input pulses are transmitted in order in synchronization with the clock signal whose voltage has been increased. Furthermore, among the level shifters, at least one of them requiring no clock signal output is suspended.

Here, a block requiring no clock signal is, for example, a block transmitting no input pulse. Moreover, even in the case of a block transmitting an input pulse, when the flip flop is the set reset flip flop, which is set in response to a clock signal and is reset in response to an output of the following flip flop, a clock signal is not necessary after the flip flop of the final step is set.

According to the above arrangement, the shift register is provided with a plurality of the level shifters. Therefore, as compared with a construction in which a single level shifter applies a level-shifted clock signal to all flip flops, it is possible to reduce a distance between the level shifter and the flip flop. Consequently, a distance for transmitting a level-shifted clock signal can be reduced so as to cut a load capacity of the level shifter and to reduce the need for a large driving capability of the level shifter. Even when the driving capability is small and a distance is long between the ends of the flip flop, this arrangement makes it possible to eliminate the need for a buffer between the level shifter and the flip flops, thereby reducing power consumption of the shift register. Additionally, at least one of a plurality of the level shifters suspends its operation; thus, as compared with a construction in which all the level shifters are simultaneously operated, the power consumption of the shift register can be smaller. According to the above results, it is possible to achieve the shift register which can be operated by a clock signal input at a low voltage with small power consumption.

For a fuller understanding of the nature and advantages of the invention, reference should be made to the ensuing detailed description taken in conjunction with the accompanying drawings.

DESCRIPTION OF THE EMBODIMENTS

[Embodiment 1]

Referring to FIGS. 1 to 7, the following explanation describes one embodiment of the present invention. Here, the present invention can be widely adopted for a shift resistor, in which an inputted clock signal is smaller in an amplitude than a driving voltage. The following describes the present invention adopted for an image display apparatus as a suitable example.

Figure 2:
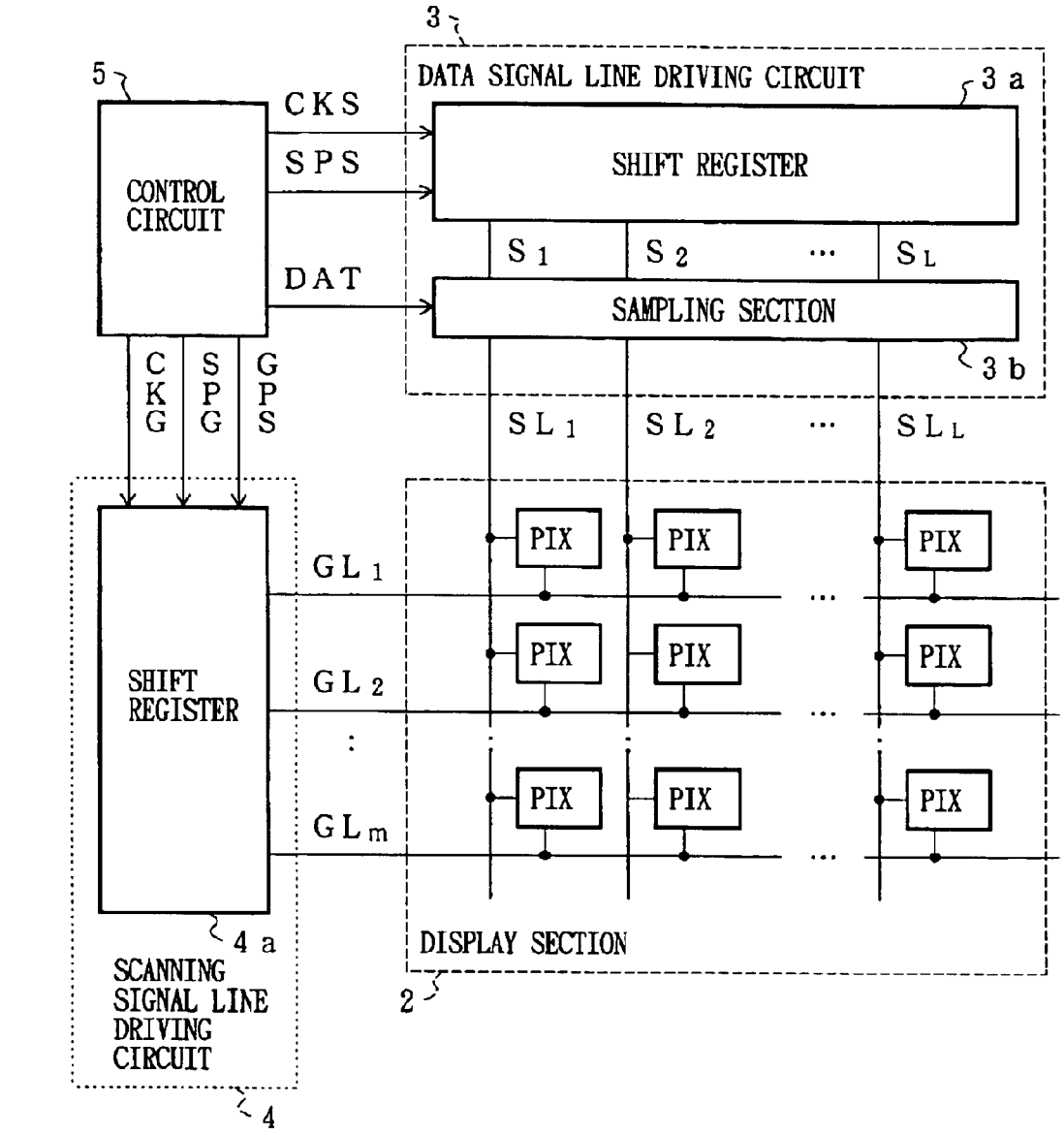
FIG. 2 is a block diagram showing a main construction of an image display apparatus using the shift register.

To be specific, as shown in FIG. 2, an image apparatus device 1 of the present embodiment is provided with a display section 2 having pixels PIX in a matrix form, a data signal line driving circuit 3 and a scanning signal line driving circuit 4 that drive the pixels PIX. When a control circuit 5 generates an image signal DAT for indicating a display state of the pixels PIX, the image display apparatus 1 displays an image in response to the image signal DAT.

The display section 2 and the driving circuits 3 and 4 are disposed on a single substrate to reduce the manufacturing steps and the wiring capacity. Moreover, in order to integrate more pixels PIX and to increase a display area, the circuits 2 to 4 consist of polycrystalline silicon thin film transistors formed on a glass substrate. Furthermore, when a normal glass substrate (glass substrate having a deformation point of 600° C. or less) is used, in order to prevent warp and deformation appearing in a process performed at a deformation point or more, the polycrystalline silicon thin film transistor is manufactured at a process temperature of 600° C. or less.

Here, the display section 2 is provided with 1 pieces (hereinafter, a capital letter 'L' is used for convenience of reference) of data signal lines $SL_1$ to $SL_L$ and m pieces of scanning signal lines $GL_1$ to $GL_m$ respectively intersecting the data signal lines $SL_1$ to $SL_L$. Here, 'i' represents any one of positive integers of L or less and 'j' represents any one of positive integers of m or less. A pixel $PIX_{(i,j)}$ is provided for each combination of the data signal line $SL_1$ and the scanning signal line $GL_j$. Namely, each of the pixels $PIX_{(i\,j)}$ is disposed in a part surrounded by two adjacent data signal lines $SL_i$*$SL_{i+1}$ and two adjacent scanning lines $GL_j$*$GL_{j+l}$.

Figure 3:
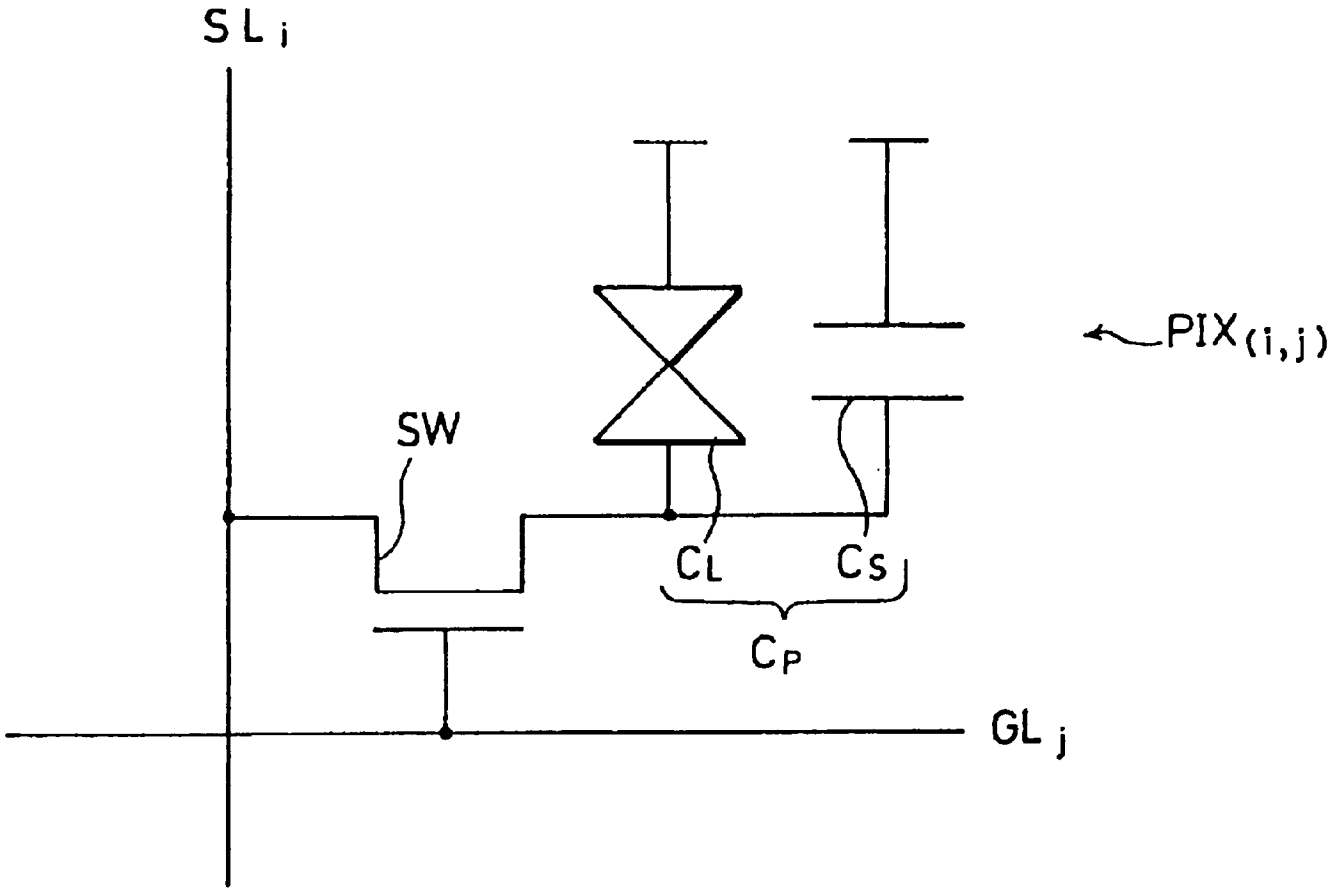
FIG. 3 is a circuit diagram showing an example of a pixel in the image display apparatus.

Here, as shown in FIG. 3, the pixel $PIX_{(i,j)}$ is provided with a field-effect transistor (switching element) SW, in which a gate is connected to the scanning line $GL_j$ and a drain is connected to the data signal line $SL_i$, and a pixel capacity $C_p$ in which one of electrodes is connected to a source of the field-effect transistor SW. Further, the other end of the pixel capacity $C_P$ is connected to a common electrode line which is used in common for all the pixels PIX. The pixel capacity $C_P$ consists of a liquid crystal capacity $C_L$ and a secondary capacity $C_S$, which is added if necessary.

When the scanning line $GL_j$ is selected in the pixel $PIX_{(i,j)}$, the field-effect transistor SW is brought into conduction, and voltage applied to the data signal line $SL_i$ is applied to the pixel capacity $C_P$. On the other hand, while the field-effect transistor SW is shut off after the selection period of the scanning signal line $GL_j$, the pixel capacity $C_P$ maintains a voltage applied at the time of shutting off. Here, transmittance and reflectance of liquid crystal vary in accordance with a voltage applied to the liquid capacity $C_L$. Therefore, the scanning signal line $GL_j$ is selected and voltage is applied to the data signal line $SL_i$ in accordance with image data, so that it is possible to vary a display state of the pixel $PIX_{(i,j)}$ in accordance with the image data.

In the image display apparatus 1 of FIG. 2, the scanning signal line driving circuit 4 selects the scanning signal line GL, and image data, which is transmitted to the pixels PIX so as to correspond to a combination of the selected scanning signal line GL and the data signal line SL, is outputted to each of the data signal lines SL by the data signal line driving circuit 3. With this arrangement, the image data is respectively written to the pixels PIX connected to the scanning signal line GL. Further, the scanning signal line driving circuit 4 successively selects the scanning signal lines GL, and the data signal line driving circuit 3 outputs the image data to the data signal lines SL. Consequently, the image data is respectively written to all the pixels PIX on the display section 2.

Here, between the control circuit 5 and the data signal line driving circuit 3, image data to the pixels PIX is transmitted as an image signal DAT on a time division. The data signal line driving circuit 3 extracts image data from the image signal DAT at the timing based on a clock signal CKS and a start signal SPS that serve as timing signals with predetermined periods.

To be specific, the data signal line driving circuit 3 is provided with a) a shift resistor 3*a* which successively shifts the start signals SPS in synchronization with the clock signals CKS so as to generate output signals $S_1$ to $S_L$, each being shifted in timing by a predetermined interval; and b) a sampling section 3*b* which samples the image signal DAT at a timing indicated by each of the output signals $S_1$ to $S_L$ and extracts image data to be outputted to each of the data signal lines $SL_1$ to $SL_L$, from the image signal DAT. In the same manner, the scanning signal line driving circuit 4 is provided with a shift resistor 4*a* which successively shifts the start signals SPG in synchronization with the clock signals CKG so as to output scanning signals, each being shifted in timing by a predetermined interval, to the scanning signal lines $GL_1$ to $GL_m$.

Additionally, in the image display apparatus 1 of the present embodiment, the display section 2, the driving circuits 3 and 4 are formed by polycrystalline silicon thin film transistors. Each of these circuits 2 to 4 has a driving voltage Vcc of, for example, about 15 [V]. Meanwhile, the control circuit 5 is formed by a monocrystalline silicon transistor on a different substrate separately from the circuits 2 to 4. A driving voltage of the control circuit 5 is set at a value smaller than the driving voltage Vcc, for example, 5 [V] or less. Additionally, the circuits 2 to 4 and the control circuit 5 are formed on the different substrates; however, the number of signals transmitted between the circuits 2 to 4 and the circuit 5 is considerably smaller than that of signals transmitted among the circuits 2 to 4. For example, the image signal DAT, the start signals SPS (SPG), and the clock signal CKS (CKG) are included at most. Further, the control circuit 5 is formed by a monocrystalline silicon transistor, so that a sufficient driving capacity can be secured with ease. For this reason, even in the case of formation on different substrates, it is possible to suppress an increase in the manufacturing steps, a wiring capacity, and power consumption, to a degree causing no serious problem.

Figure 1:
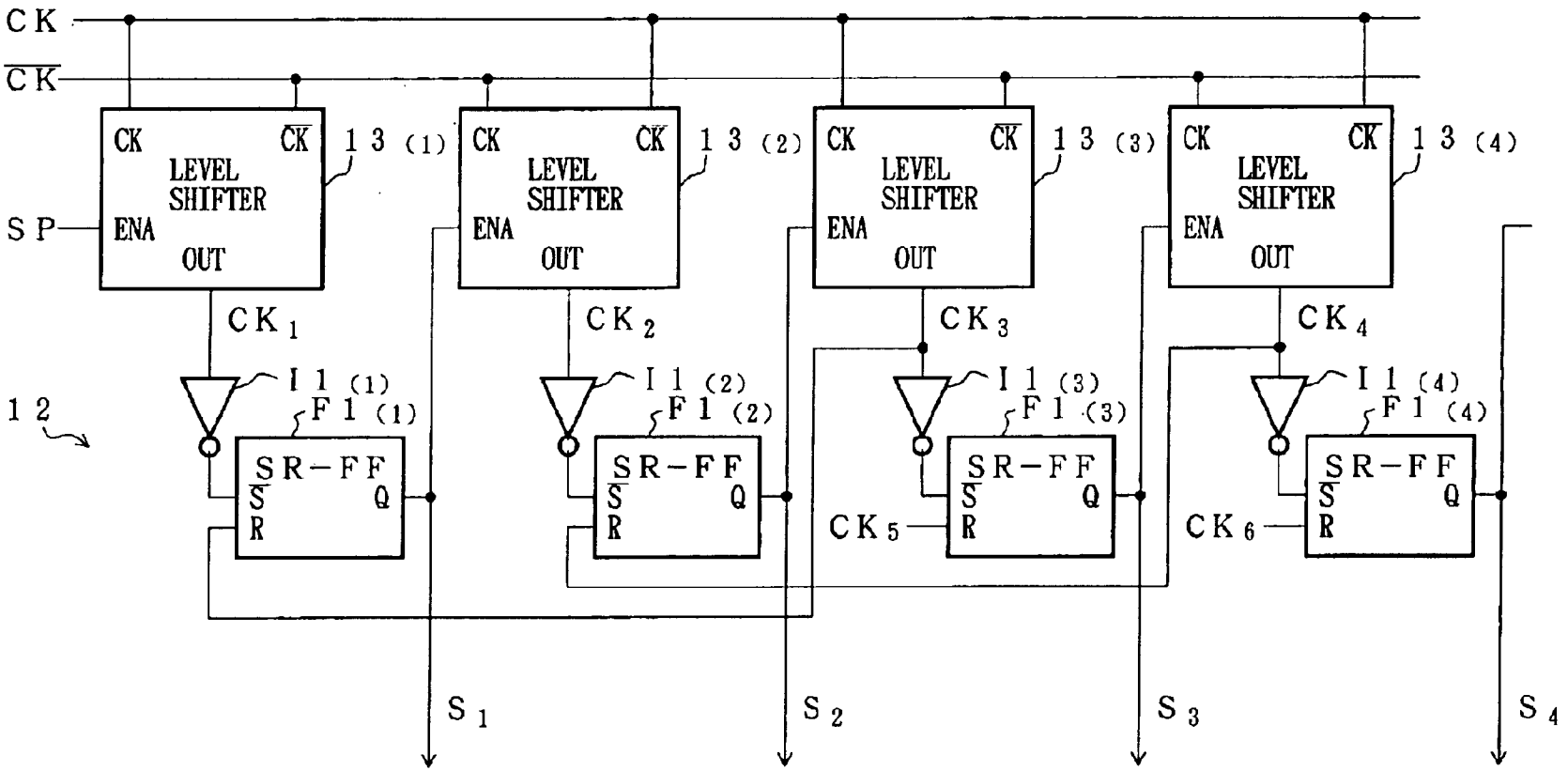
FIG. 1 is a block diagram showing a main construction of a shift register including set reset flip flops in accordance with one embodiment of the present invention.

Additionally, in the present embodiment, a shift resistor 11 of FIG. 1 is used as at least one of the shift resistors 3*a* and 4*a*. Hereinafter, the start signal SPS (SPG) is referred to as SP, the number of steps L (m) of the shift resistor 11 is referred to as n, and the output signals are referred to as $S_1$ to $S_n$ in order to respond to both of the shift resistors 3*a* and 4*a*.

To be specific, the shift resistor 11 includes a set/reset flip flop (SR flip flop) $F1_{(1)}$ and later, a flip flop section 12 operating at the driving voltage $V_{CC}$, and level shifter $13_{(1)}$ and later which increase a voltage of a clock signal CK and applies the clock signal CK to the SR flip flop $F1_{(1)}$ and later. The clock signal CK smaller in an amplitude than the driving voltage $V_{CC}$ is applied from the control circuit 5.

In the present embodiment, the level shifter $13_{(1)}$ and later are disposed so as to respectively correspond to the SR flip flop $F1_{(1)}$ and later. As will be described later, the level shifter $13_{(1)}$ and later are formed as current-driven level shifters, which are capable of increasing a voltage without causing any problems even when an amplitude of a clock signal CK is smaller than the driving voltage $V_{CC}$. Further, while a control signal $ENA_i$ provides an instruction for operation, the i representing an integer between 1 and n, each level shifter $13_{(i)}$ can apply a clock signal $CK_i$, whose voltage has been increased, to the corresponding SR flip flop $F1_{(i)}$ based on the clock signal CK and an inverse signal CK bar thereof. Furthermore, when a control signal ENA provides an instruction for suspension, the operation is suspended so as to prevent the clock signal $CK_i$ from being applied to the corresponding SR flip flop $F1_{(i)}$. While the operation is suspended, an input switching element (described later) is shut off so as to reduce power consumption of the level shifter $13_{(i)}$, that is caused by feedthrough current.

Meanwhile, the flip flop section 12 has a construction in which a start signal SP with a period width of one clock can be transmitted to the following step at each edge of a clock signal CK (rising edge and falling edge). To be specific, the output of the level shifter $\mathbf{13}_{(i)}$ is applied as a set signal S bar having a negative logic via an inverter $\mathbf{I1}_{(i)}$ to the SR flip flop $\mathbf{F1}_{(i)}$. Moreover, an output Q of the SR flip flop $\mathbf{F1}_{(i)}$ is outputted as an output $S_i$ of the shift register 11 and is outputted as a control signal $ENA_{i+1}$ to the following level shifter $\mathbf{13}_{(i+1)}$. Additionally, to the level shifter $\mathbf{13}_{(1)}$ of the first step, a start signal SP from the control circuit S of FIG. 1 is applied as a control signal $ENA_1$ after a voltage of the start signal SP is increased. Furthermore, to the SR flip flop $\mathbf{F1}_{(i)}$, among set signals transmitted to the following SR flip flop F1, a signal, which is delayed by a pulse width of a transmitted pulse, is applied as a reset signal R. In the present embodiment, a pulse with one clock period width is transmitted. Hence, a signal delayed by one clock period, namely, a clock signal $CK_{(i+2)}$, which is applied to an SR flip flop $\mathbf{F1}_{(i+2)}$ of two steps later, is applied as a reset signal having a positive logic.

Further, a clock signal CK is applied to a non-inverse input terminal and an inverse signal CK bar of the clock signal is applied to an inverse input terminal so that the SR flip flops $\mathbf{F1}_{(1)}$, $\mathbf{F1}_{(3)}$, and later of odd-numbered steps are set at a rising edge of the clock signal CK in the level shifter $\mathbf{13}_{(1)}$ and later of odd-numbered steps. In contrast, a clock signal CK is applied to an inverse input terminal and an inverse signal CK bar thereof is applied to a non-inverse input terminal in the level shifters $\mathbf{13}_{(2)}$, $\mathbf{13}_{(4)}$ and later of even-numbered steps so that the SR flip flops $\mathbf{F1}_{(2)}$, and later of even-numbered steps are set at a falling edge of the clock signal CK.

Figure 4:
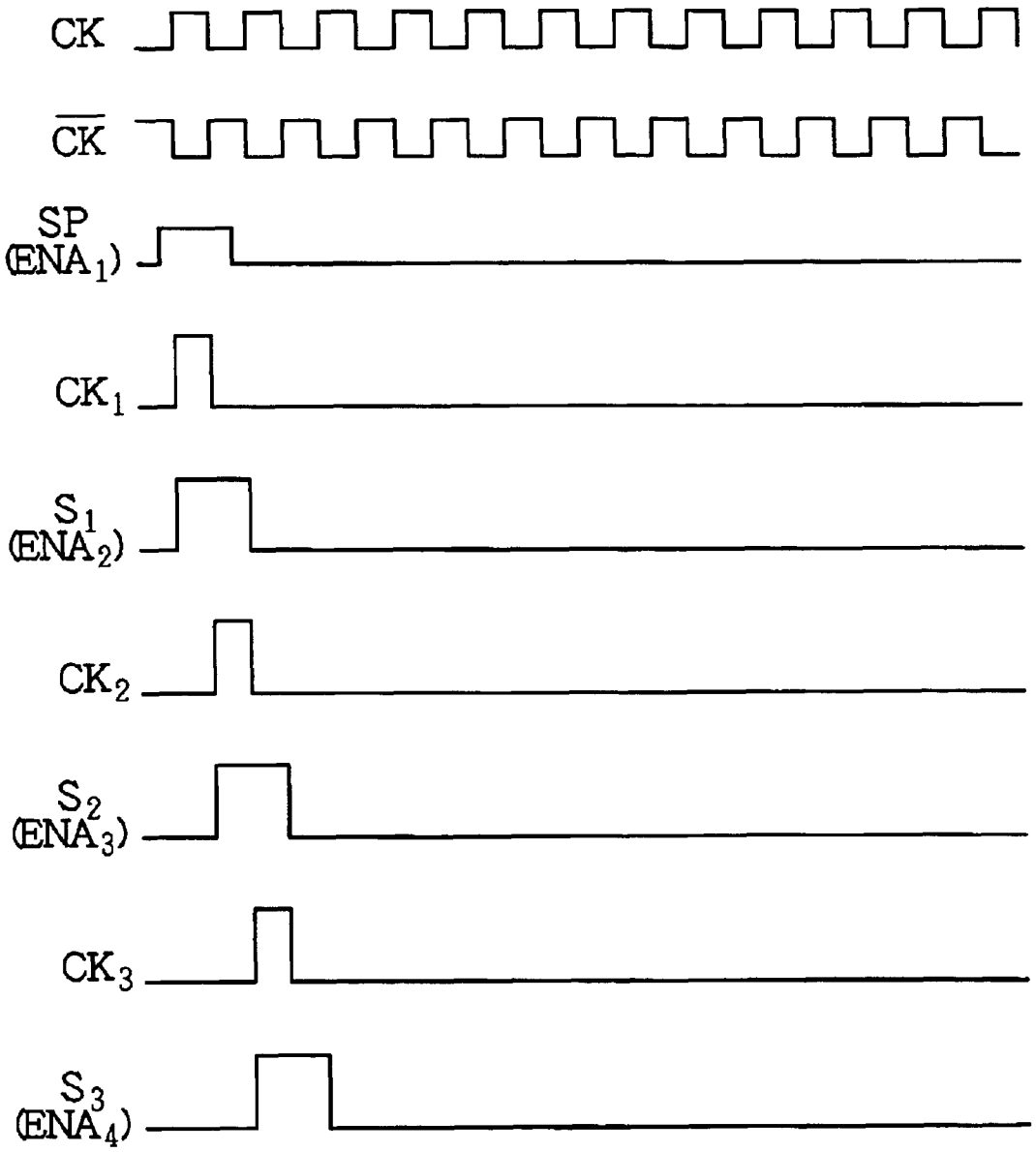
FIG. 4 is a timing chart showing an operation of the shift register.

According to this arrangement, as shown in FIG. 4, during a pulse input of a start signal SP, the level shifter $\mathbf{13}_{(1)}$ of the first step is operated, and a clock signal $CK_1$, whose voltage has been increased, is applied to the SR flip flop $\mathbf{F1}_{(1)}$. Thus, the SR flip flop $\mathbf{F1}_{(1)}$ is set when the clock signal CK firstly rises after the pulse input has started, and then, an output $S_1$ is shifted to a high level.

The output $S_1$ is applied to the level shifter $\mathbf{13}_{(2)}$ of the second step as a control signal $ENA_2$. Hence, the level shifter $\mathbf{13}_{(2)}$ outputs a clock signal $CK_2$ during a pulse output of the SR flip flop $\mathbf{F1}_{(1)}$ (while control signal $ENA_2=S_1$ is at a high level). Additionally, in the level shifter $\mathbf{13}_{(2)}$, a clock signal CK is applied to an inverse input terminal, so that the level shifter $\mathbf{13}_{(2)}$ outputs a signal whose polarity is opposite to that of the clock signal CK and voltage has been increased, as a clock signal $CK_2$. Thus, the SR flip flop $\mathbf{F1}_{(2)}$ is set when the clock signal CK firstly falls after the output $S_1$ of the previous step has been shifted to a high level, an then, an output $S_2$ is shifted to a high level.

The output signal $S_i$ is applied to the level shifter $\mathbf{13}_{(i+1)}$ of the following step as a control signal $ENA_{i+1}$. Hence, the SR flip flop $\mathbf{F1}_{(2)}$ and later in the second step and later output the output $S_2$ and later, each being delayed by a half period of the clock signal CK from the one of the previous step.

Meanwhile, to the level shifter $\mathbf{13}_{(i)}$ of each step, an output $CK_{i+2}$ of the level shifter $\mathbf{13}_{(i+2)}$ at two steps later is applied as a reset signal R. Therefore, the output $S_i$ is at a high level for one clock period and is shifted to a low level. Hence, the flip flop section 12 can transmit a start signal SP of one clock period width to the following step at each edge (rising and falling) of a clock signal CK.

Here, the level shifter $\mathbf{13}_{(i)}$ is respectively disposed for the SR flip flop $\mathbf{F1}_{(i)}$, so that even when the SR flip flop $\mathbf{F1}_{(i)}$ is disposed at many steps, it is possible to shorten a distance between the level shifter and the flip flop that correspond to each other, as compared with a case in which a voltage of a clock signal CK is increased by a single level shifter, and the clock signal CK is applied to all flip flops. Therefore, it is possible to shorten a transmitting distance of the clock signal $CK_i$ after increasing the voltage and to reduce the load capacity of the level shifter $\mathbf{13}_{(i)}$. Moreover, even when it is difficult to sufficiently secure the driving capacity of the level shifter $\mathbf{13}_{(i)}$, for example, even when the level shifter $\mathbf{13}_{(i)}$ is formed by a polycrystalline silicon thin film transistor, a buffer is not necessary because the load capacity is small. Consequently, it is possible to reduce the power consumption of the shift resistor 11.

Furthermore, when the flip flop $\mathbf{F1}_{(i)}$ does not require an input of the clock signal $CK_i$, for example, when the start signal SP and the low-level output $S_{i-1}$ of the previous step are at a low level, the operation of the level shifter $\mathbf{13}_{(i)}$ is suspended. In this state, the clock signal $CK_i$ is not driven, so that power consumption required for driving cannot be generated. Furthermore, as will be described later, power supply to a level shift section 13*a*, which is disposed for each of the level shifter $\mathbf{13}_{(i)}$, is suspended, an input switching element is shut off, and a feedthrough current cannot be applied. Therefore, although a large number (n) of current-driving level shifters are provided, power is consumed only by the level shifter $\mathbf{13}_{(i)}$ under operation. Consequently, it is possible to dramatically reduce the power consumption of the shift resistor 11.

Additionally, the level shifter $\mathbf{13}_{(i)}$ of the present embodiment judges a period when the clock signal $CK_i$ is necessary for the SR flip flop $\mathbf{F1}_{(i)}$, namely, a period a) from a start of a pulse output of a start signal SP or an output $S_{i-1}$ in the previous step b) to the setting of the SR flip flop $\mathbf{F1}_{(i)}$, only based on the start signal SP or the output $S_{i-1}$ of the previous step. Consequently, it is possible to control the operation/suspension of the level shifter $\mathbf{13}_{(i)}$ only by directly applying the start signal SP or an output $S_{i-1}$ of the previous step, and to simplify the circuit construction of the shift resistor 11 as compared with when a circuit is provided for generating another control signal.

Further, in the present embodiment, while the level shifter $\mathbf{13}_{(i)}$ is suspended, a clock input to the SR flip flop $\mathbf{F1}_{(i)}$ is shut off. Thus, it is possible to precisely transmit a start signal SP without the need for a switch brought into conduction in response to the necessity for a clock input, in addition to the level shifter $\mathbf{13}_{(i)}$.

Figure 5:
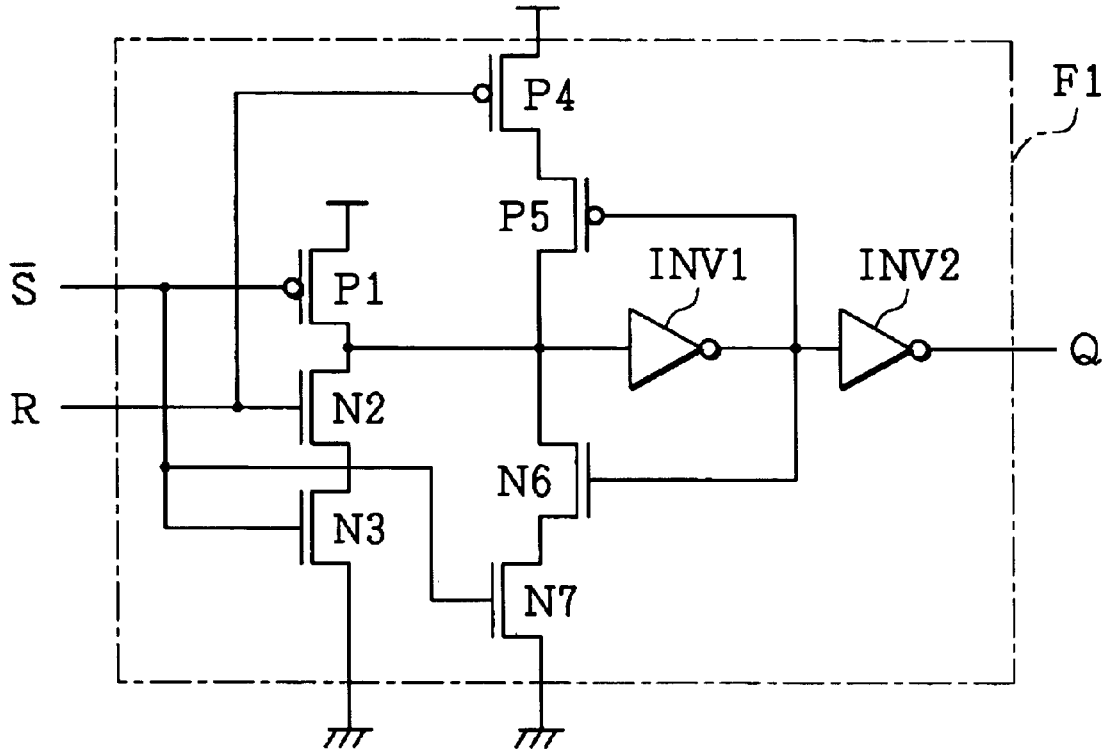
FIG. 5 is a circuit diagram showing an example of the set reset flip flop used in the shift register.

Here, as shown in FIG. 5, in each of the SR flip flops F1, a P-type MOS transistor P1, and N-type MOS transistors N2 and N3 are connected in series between the driving voltage $V_{CC}$ and a ground level. A set signal S bar with a negative logic is applied to gates of the transistors P1 and N3. Further, a reset signal R with a positive logic is applied to the gate of the transistor N2. Furthermore, drain potentials of the transistors P1 and N2 connected to each other are respectively inverted in inverters INV1 and INV2 and are outputted as an output signal Q. Meanwhile, between the driving voltage $V_{CC}$ and the ground level, P-type MOS transistors P4 and PS and N-type MOS transistors N6 and N7 are respectively provided in series. The drains of the transistors PS and P6 are connected to an input of the inverter INV1, and the gates of the transistors PS and N6 are connected to an output of the inverter INV1. Moreover, a reset signal R is applied to the transistor P4, and a set signal S bar is applied to the gate of the transistor N7.

Figure 6:
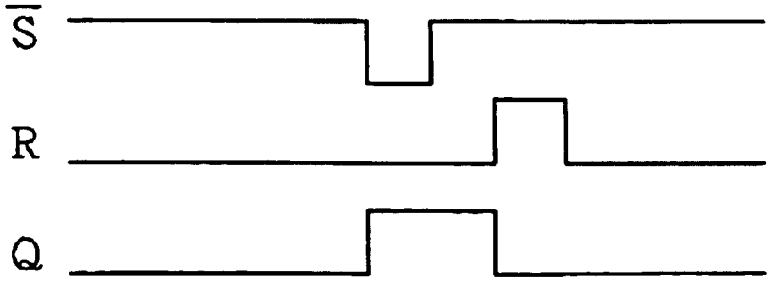
FIG. 6 is a timing chart showing an operation of the set reset flip flop.

As shown in FIG. 6, in the SR flip flop F1, while a reset signal R is inactive (low level), when a set signal S bar is shifted to be active (low level), the transistor P1 is brought into conduction so as to shift the input of the inverter INV1 to a high level. Thus, the output signal Q of the SR flip flop F1 is shifted to a high level.

In this state, the reset signal R and the output of the inverter INV1 bring the transistors P4 and P5 into conduction. Further, the reset signal R and the output of the inverter INV1 shut off the transistors N2 and N6. Hence, even when the set signal S bar turns inactive, the input of the inverter INV1 is maintained at a high level and the output signal Q is also maintained at a high level.

Afterwards, when the reset signal R turns active, the transistor P4 is shut off and the transistor N2 is brought into conduction. Here, since the set signal S bar remains inactive, the transistor P1 is shut off and the transistor N3 is brought into conduction. Therefore, the input of the inverter INV1 is driven to a low level and the output signal Q is shifted to a low level.

Figure 7:
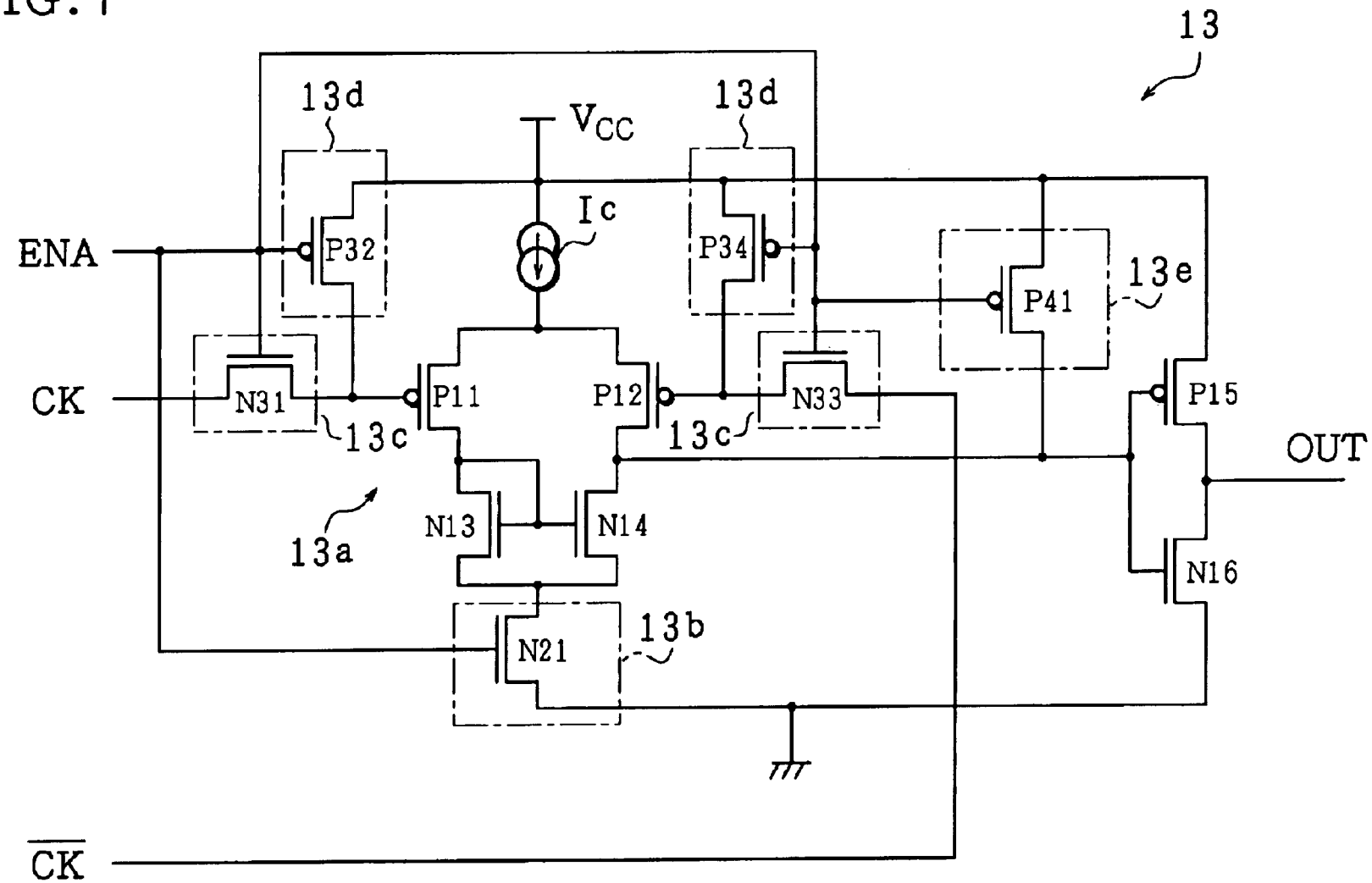
FIG. 7 is a circuit diagram indicating an example of the level shifter.

Meanwhile, as shown in FIG. 7, the level shifter 13 of the present embodiment is provided with the level shift section 13*a* for level-shifting a clock signal CK; a power supply control section 13*b* for shutting off power supply to the level shift section 13*a* during a suspension period requiring no supply of a clock signal CK; input control sections (switch) 13*c* for shutting off the level shift section 13*a* and a signal line, where a clock signal CK is transmitted, during the suspension period; input switching element shutting-off control sections (input signal control section) 13*d* for shutting off the input switching element of the level shift section 13*a* during the suspension period; and an output stabilizing section (output stabilizing means) 13*e* for maintaining the output of the level shift section 13*a* at a predetermined value during the suspension period.

The level shift section 13*a* is provided with P-type MOS transistors P11 and P12, in which the sources are connected to each other, as a differential input pair of an unpitying step; a constant current source Ic for supplying a predetermined current to the sources of the transistors P11 and 12; N-type MOS transistors N13 and N14 which constitute a current mirror circuit and serve as active loads of the transistors P11 and P12; and transistors P15 and N16 having CMOS structures for amplifying an output of the differential input pair.

To the gate of the transistor P11, a clock signal CK is inputted via a transistor N31 (described later). To the gate of the transistor P12, an inverse signal CK bar of the clock signal is inputted via a transistor N33 (described later). Further, the gates of the transistors N13 and N14 are connected to each other and to the drains of the transistors P11 and N13. Meanwhile, the drains of the transistors P12 and N14, that are connected to each other, are connected to the gates of the transistors P15 and N16. Here, the sources of the transistors N13 and N14 are grounded via the N-type MOS transistor N21 serving as the power supply control section 13*b*.

Meanwhile, in the input control section 13*c* on the side of the transistor P11, the N-type MOS transistor N31 is disposed between the clock signal CK and the gate of the transistor P11. Moreover, in the input switching element shutting-off control section 13*d* on the side of the transistor P11, a P-type MOS transistor P32 is disposed between the gate of the transistor P11 and the driving voltage $V_{CC}$. In the same manner, to the gate of the transistor P12, an inverse signal CK bar of a clock signal is applied via the transistor N33 acting as the input control section 13*c*, and a driving voltage $V_{CC}$ is applied via the transistor P34 acting as the input switching element shutting-off control section 13*d*.

Further, the output stabilizing section 13*e* has a construction in which an output voltage OUT of the level shifter 13 is stabilized to a ground level during the suspension period. A P-type MOS transistor P41 is provided between the driving voltage $V_{CC}$ and the gates of the transistors P 15 and N16.

Additionally, in the present embodiment, a control signal ENA is set so as to indicate the operation of the level shifter 13 at a high level. Hence, the control signal ENA is applied to the gates of the transistors N21 to P41.

In the level shifter 13 having the above construction, when the control signal ENA indicates operation (at a high level), the transistors N21, N31, and N33 are brought into conduction, and the transistors P32, P34, and P41 are shut off. In this state, current of the constant current source Ic passes through the transistors P11 and N13, or the transistors P12 and N14, and the transistor N21. Further, to the gates of the transistors P11 and P12, the clock signal CK or the inverse signal CK bar of the clock signal is applied. Consequently, to the transistors P11 and P12, current is applied in accordance with a voltage ratio of the gate and the source. Meanwhile, the transistors N13 and N14 act as active loads, so that voltage is applied to a connection of the transistors P12 and N14 in accordance with a voltage level difference between the CK and CK bar. The voltage, which serves as a gate voltage for the CMOS transistors P15 and N16, is amplified at the transistors P15 and N16 and is outputted as an output voltage OUT.

The level shifter 13 has a construction in which the clock signal CK switches conduction/shutting off of the transistors P11 and P12 at the unpitying step, namely, unlike a current-driven type, the transistors P11 and P12 of the unpitying step are continuously conducting during the operation. Current of the constant current source Ic is shunted in accordance with a voltage ratio of the gate and the source of each of the transistors P11 and P12, so that the clock signal CK is level-shifted.

Consequently, as shown in FIG. 4, the level shifter $\mathbf{13}_{(i)}$ can output the output voltage OUT as the clock signal $CK_i$ whose peak value is increased to a driving voltage $V_{CC}$ (for example, about 15 [V], the clock signal $CK_i$ being identical to the clock signal CK with a peak value smaller than the driving voltage $V_{CC}$ (for example, about 5 [V].

In contrast, when the control signal $ENA_i$ indicates suspension (low level), the transistor N21 shuts off current transmitted from the constant current source Ic via the transistors P11 and N13 or the transistors P12 and N14. In this state, current supply from the constant current source Ic is interrupted in the transistor N21, resulting in smaller power consumption. Further, in this state, current is not supplied to the transistors P11 and P12, so that the transistors P 11 and P12 cannot act as a differential input pair; consequently, it is not possible to determine a potential of the output end, namely, a connecting point of the transistors P11 and N14.

Furthermore, in this state, the transistors N31 and N33 of the input control sections 13*c* are shut off. With this arrangement, a signal line for transmitting the clock signal CK(CK bar) is away from the gates of the transistors P11 and P12 of the unpitying step, and a gate capacity serving as a load capacity of the signal line is limited to the level shifter 13 in operation. As a result, although a plurality of level shifters $\mathbf{13}_{(i)}$ are connected to the signal line, it is possible to reduce the load capacity on the signal line and to reduce power consumption of a circuit such as the control circuit 5 of FIG. 2 for driving the clock signal CK (CK bar).

Additionally, during the suspension, the transistors P32 and P34 of the input switching element shutting-off control sections 13*d* are conducting, so that each of the transistors P11 and P12 has a gate voltage being equivalent to the driving voltage $V_{CC}$; thus, the transistors P11 and P12 are shut off. Hence, as in the case of the transistor N21 being shut off, the power consumption can be reduced by a current outputted by the constant current source Ic. Here, in this state, the transistors P11 and P12 cannot act as a differential input pair, so that it is not possible to determine a potential of the output end.

In addition, when the control signal ENA indicates suspension, the transistor P41 of the output stabilizing section 13*e* is conducting. As a result, the output end, namely, a gate potential of the CMOS transistors P15 and N16 is equivalent to the driving voltage $V_{CC}$, and the output voltage OUT enters a low level. Thus, as shown in FIG. 4, when the control signal $ENA_i$ indicates suspension, the output voltage OUT ($CK_i$) of the level shifter $\mathbf{13}_{(i)}$ is maintained at a low level regardless of a state of the clock signal CK. Consequently, unlike the case of the output voltage OUT being irregular during the suspension of the level shifter $\mathbf{13}_{(i)}$, it is possible to prevent malfunction of the SR flip flop $F\mathbf{1}_{(i)}$ and to achieve the shift resistor 11 being able to operate in a stable manner.

[Embodiment 2]

Unlike Embodiment 1, referring to FIGS. 8 to 14, the following explanation discusses a construction in which a shift resistor consists of D flip flops with a plurality of steps. Here, in the following Embodiments, those members that have the same functions and that are described in Embodiment 1 are indicated by the same reference numerals and the description thereof is omitted for convenience of explanation.

Figure 8:
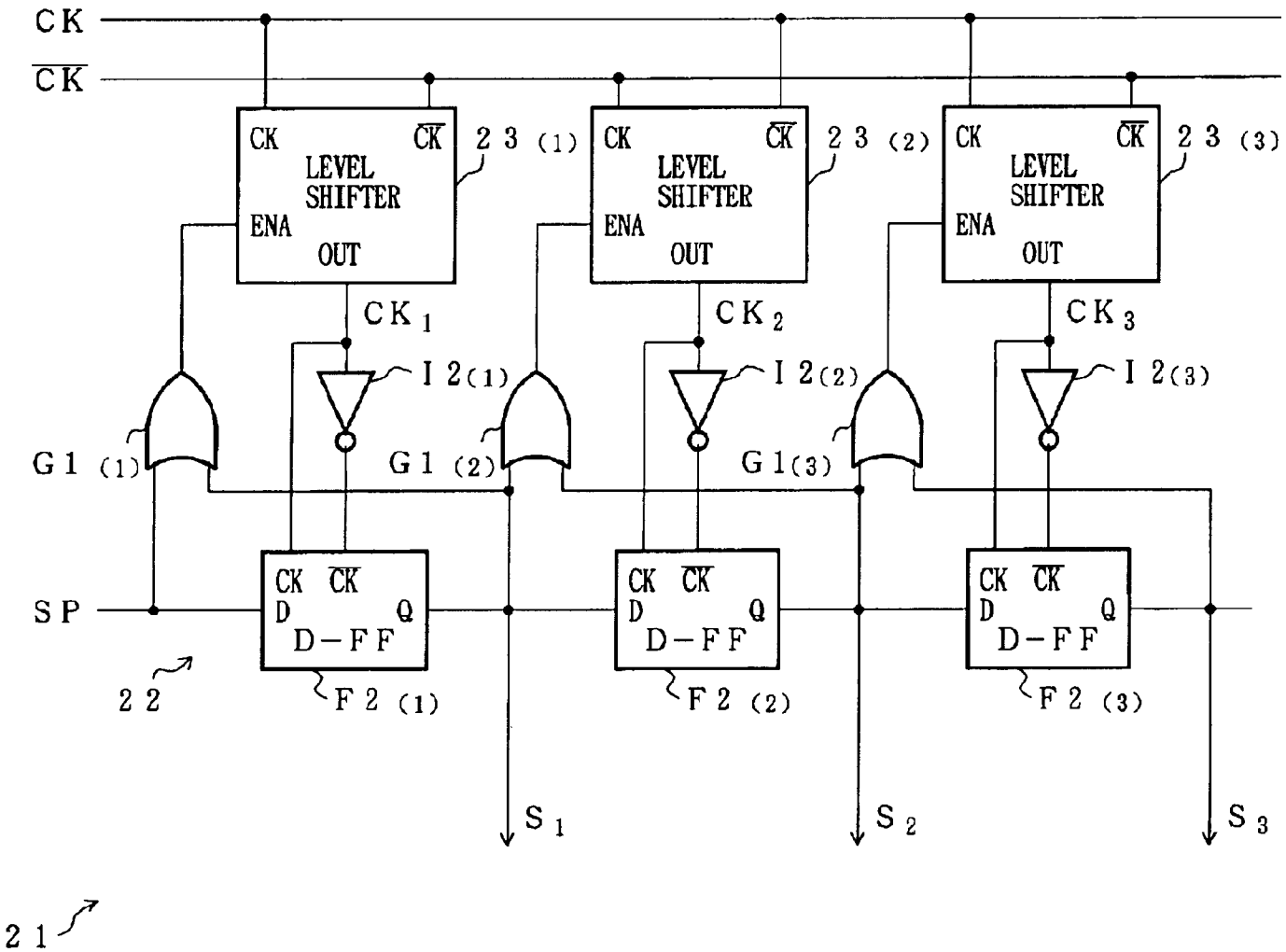
FIG. 8 is a block diagram showing a main construction of the shift register including D flip flops in accordance with another embodiment of the present invention.

Namely, as shown in FIG. 8, a shift resistor 21 of the present embodiment is provided with a flip flop section 22 consisting of a D flip flop $F\mathbf{2}_{(1)}$ and later with a plurality of steps, and a level shifter $\mathbf{23}_{(1)}$ and later which are disposed respectively for the D flip flop $F\mathbf{2}_{(1)}$ and later and which have the same constructions as level shifter $\mathbf{13}_{(1)}$ and later of FIG. 1.

The D flip flop $F\mathbf{2}_{(i)}$ is a D flip flop in which an output Q is varied in response to an input D when a clock signal $CK_i$ is at a high level, and the output Q is maintained at a low level. The output Q of the D flip flop $F\mathbf{2}_{(i)}$ is outputted as an output $S_i$ and inputted to a D flip flop $F\mathbf{2}_{(i-1)}$ of the following step. Here, a start signal SP is inputted to the D flip flop $F\mathbf{2}_{(1)}$ of the first step.

Moreover, as shown in FIG. 1, the level shifter $\mathbf{23}_{(1)}$ and later of odd-numbered steps output a clock signal CK, whose voltage has been increased, as a clock signal $CK_1$ and later during the operation, and the level shifter $\mathbf{23}_{(2)}$ and later of even-numbered steps output a signal $CK_2$ and later, whose voltages have been increased with a polarity being opposite to the clock signal CK, in operation. Here, regardless of an odd or even step, the corresponding clock signal $CK_i$ and an inverse signal of the clock signal $CK_i$, which is generated in an inverter $I\mathbf{2}_{(i)}$, are applied to the D flip flop $F\mathbf{2}_{(i)}$.

Here, the output $S_i$ of the D flip flop $F\mathbf{2}_{(i)}$ does not vary until the clock signal $CK_i$ rises. Therefore, unlike the SR flip flop $F\mathbf{1}_{(i)}$ of FIG. 1, the D flip flop $F\mathbf{2}_{(i)}$ requires the clock signal $CK_i$ at a falling edge as well as a rising edge of the output $S_i$. Therefore, the present embodiment is provided with an OR circuit $G\mathbf{1}_{(i)}$ for computing an OR of the input and output of the level shifter $\mathbf{23}_{(i)}$. The OR circuit $G\mathbf{1}_{(i)}$ outputs a computing result as the control signal $ENA_1$, to the corresponding level shifter $\mathbf{23}_{(i)}$.

Figure 9:
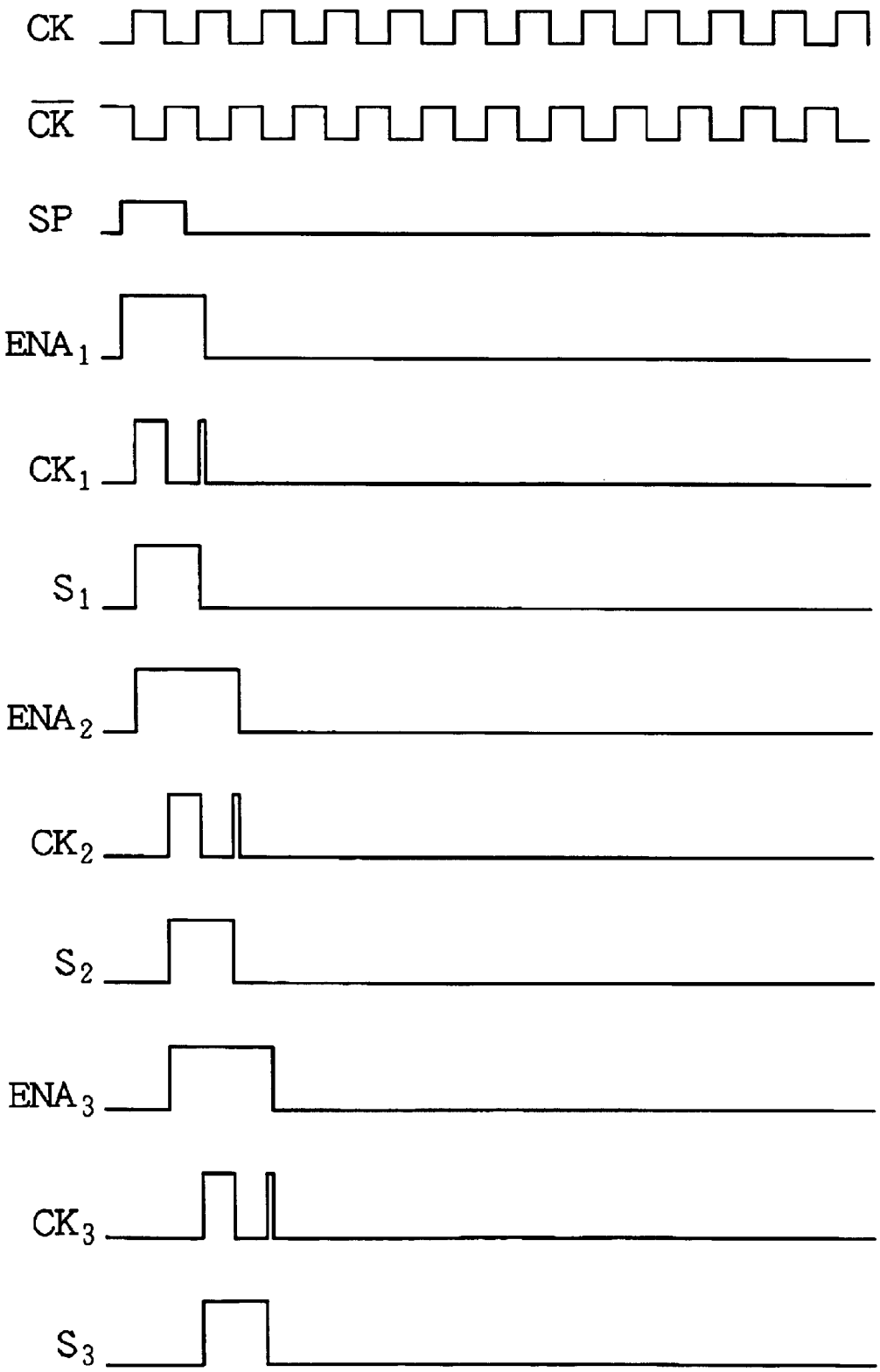
FIG. 9 is a timing chart showing an operation of the shift register.

As shown in FIG. 9, in the case of a pulse input of the start signal SP in the above construction, the control signal $ENA_1$ is shifted to a high level, and the clock signal CK1 whose voltage has been increased is inputted to the D flip flop $F\mathbf{2}_{(1)}$. Consequently, after the pulse input of the start signal SP, the output $S_1$ of the D flip flop $F\mathbf{2}_{(1)}$ is shifted to a high level at a rising edge of the following clock signal $CK_1$. While the clock signal $CK_1$ is at a low level, even when the start signal is shifted to a low level, the output $S_1$ of the D flip flop $F\mathbf{2}_{(1)}$ is maintained at a high level.

After the start signal SP is shifted to a low level, at the first rising edge of the clock signal $CK_1$, the output $S_1$ of the D flip flop $F\mathbf{2}_{(1)}$ is shifted to a low level. Furthermore, in this state, the start signal SP and the output $S_1$ are at a low level, so that the OR circuit $G\mathbf{1}_{(1)}$ shifts the control signal $ENA_1$ to a low level and suspends the level shifter $\mathbf{23}_{(1)}$.

Here, the output $S_i$ of the D flip flop $F\mathbf{2}_{(i)}$ is inputted to the following D flip flop $F\mathbf{2}_{(i+j)}$, and the clock signals $CK_i$ and $CK_{i+1}$ having opposite polarities to each other are inputted to the adjacent D flip flop $F\mathbf{2}_{(i)}$ and $F\mathbf{2}_{(i+1)}$. Consequently, the flip flop section 22 can transmit the start signal SP to the following step at each edge (rising and falling) of the clock signal CK.

In the above construction, the level shifter $\mathbf{23}_{(i)}$ is operated when the corresponding D flip flop $F\mathbf{2}_{(i)}$ requires an input of the clock signal $CK_i$, namely, a period from the start of a pulse input to the D flip flop $F\mathbf{2}_{(i)}$ to the end of a pulse output of the D flip flop $F\mathbf{2}_{(i)}$, and the level shifter $\mathbf{23}_{(i)}$ can suspend its operation in other periods. As a result, in the same manner as Embodiment 1, it is possible to achieve the shift resistor 21 which can operate by the clock signal CK with an amplitude being smaller than the driving voltage $V_{CC}$ and achieve small power consumption.

Further, unlike Embodiment 1, the flip flop section 22 of the present embodiment is constituted by the D flip flops which vary the output Q in response to the input D and the clock signal CK. Thus, even when a pulse width (number of clocks) of the start signal SP is changed, the start signal SP can be transmitted without causing any problems.

For example, in the case of the sampling section 3*b* of FIG. 2, when a sampling transistor for sampling an image data signal DAT has a small driving capability, a longer sampling period is required and the outputs $S_1$ to $S_n$ need to have longer pulse widths (time). Meanwhile, even in the case of a pulse width having the same time period, the higher a frequency of the clock signal CK is, the number of the clocks increases. Therefore, regarding a pulse width of the start signal SP, an optimum value varies according to the driving capability of the sampling transistor and a frequency of the clock signal CK. Hence, as shown in the shift resistor 11 of FIG. 1, in the case of the construction in which a connecting point of a reset signal R is set in accordance with a pulse width (clock number) of the output $S_1$ and later, it is necessary to arrange a different circuit for each of the desired widths (clock numbers). Moreover, when the data signal line driving circuit 3 is driven by a clock signal CK with a different frequency, or when the same data signal line driving circuit 3 is used for driving a different display section 2, an optimum pulse width may not be secured, resulting in degradation in display quality.

In contrast, the shift resistor 21 of the present embodiment can output the outputs $S_1$ and later with desired pulse widths only by changing a pulse width of the start signal SP. Hence, it is possible to reduce the steps of designing the construction and to achieve an image display apparatus 1 which does not cause degradation in display quality even in the above-mentioned state.

However, as shown in FIG. 5, the SR flip flop F1 can be realized with fewer elements at higher operation speed as compared with a D flip flop F2 of FIG. 10 (described later), at the same moving speed. Moreover, in the output $S_{i-1}$ of the previous step, it is possible to directly control the operation/suspension of the level shifter $\mathbf{13}_{(i)}$ of the following step; hence, the OR circuit $\mathbf{G1}_{(i)}$ is not necessary. Consequently, when an optimum pulse width (clock number) can be previously determined and a high-speed shift resistor with a small circuit is demanded, the SR flip flop F1 is more preferable.

Figure 10:
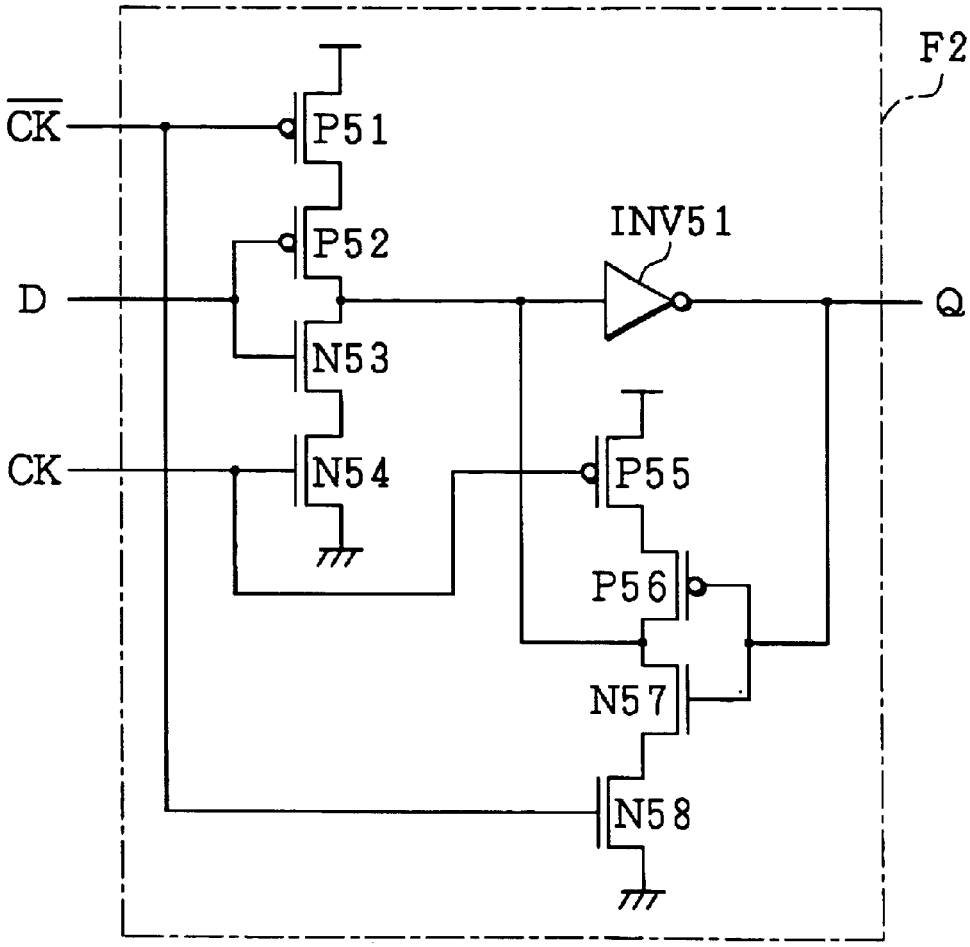
FIG. 10 is a circuit diagram showing an example of the D flip flop.

Here, for example, as shown in FIG. 10, each of the D flip flops F2 has a construction in which P-type MOS transistors P 51 and P 52 and N-type MOS transistors N53 and N54 are connected in series between a driving voltage $V_{CC}$ and the ground level. An input signal D is applied to the gates of the transistors P52 and N53, and the drain potentials of the transistors P52 and N53 are inverted at an inverter INV 51 and is outputted as an output Q. Further, between a driving voltage $V_{CC}$ and the ground level, P-type MOS transistors P55 and P56 and N-type MOS transistors N57 and N58 are connected in series. The drains of the transistors P56 and N57 are inputted to an input of the inverter INV51 and the gates thereof are connected to an output of the inverter INV51. Moreover, an inverse signal CK bar of a clock signal is applied to the gates of the transistors P51 and N58, and a clock signal CK is applied to the gates of the transistors N54 and P55.

Figure 11:
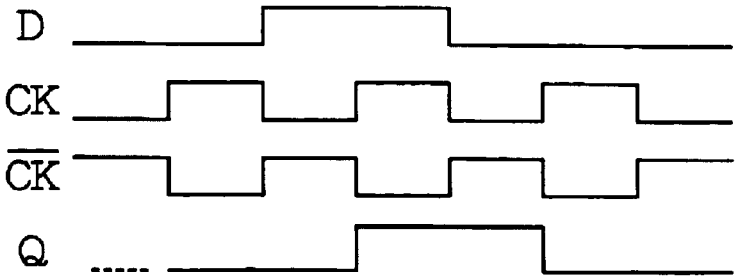
FIG. 11 is a timing chart showing an operation of the D flip flop.

In the D flip flop F2 having the above construction, while the clock signal CK is at a high level, the transistors P51 and N54 are conducting and the transistors P55 and N58 are shut off. With this arrangement, the input D is inverted at the transistors P52 and N53 and is inverted at the inverter INV 51. As a result, the output Q is shifted to the same value as the input D. In contrast, while the clock signal CK is at a low level, the transistors P51 and N54 are shut off, so that the transistors P 52 and N53 cannot invert the input D. Further, in this state, the transistors P 55 and N58 are conducting, so that the output of the inverter INV51 returns to the input thereof. As a result, while the clock signal CK is at a low level, the output Q is maintained at a value of a falling edge of the clock signal CK even when the input D is at a high level. Therefore, as shown in FIG. 11, after the input D is changed, the output Q of the D flip flop F2 is varied in response to the input D at the first rising edge of the clock signal CK.

Figure 12:
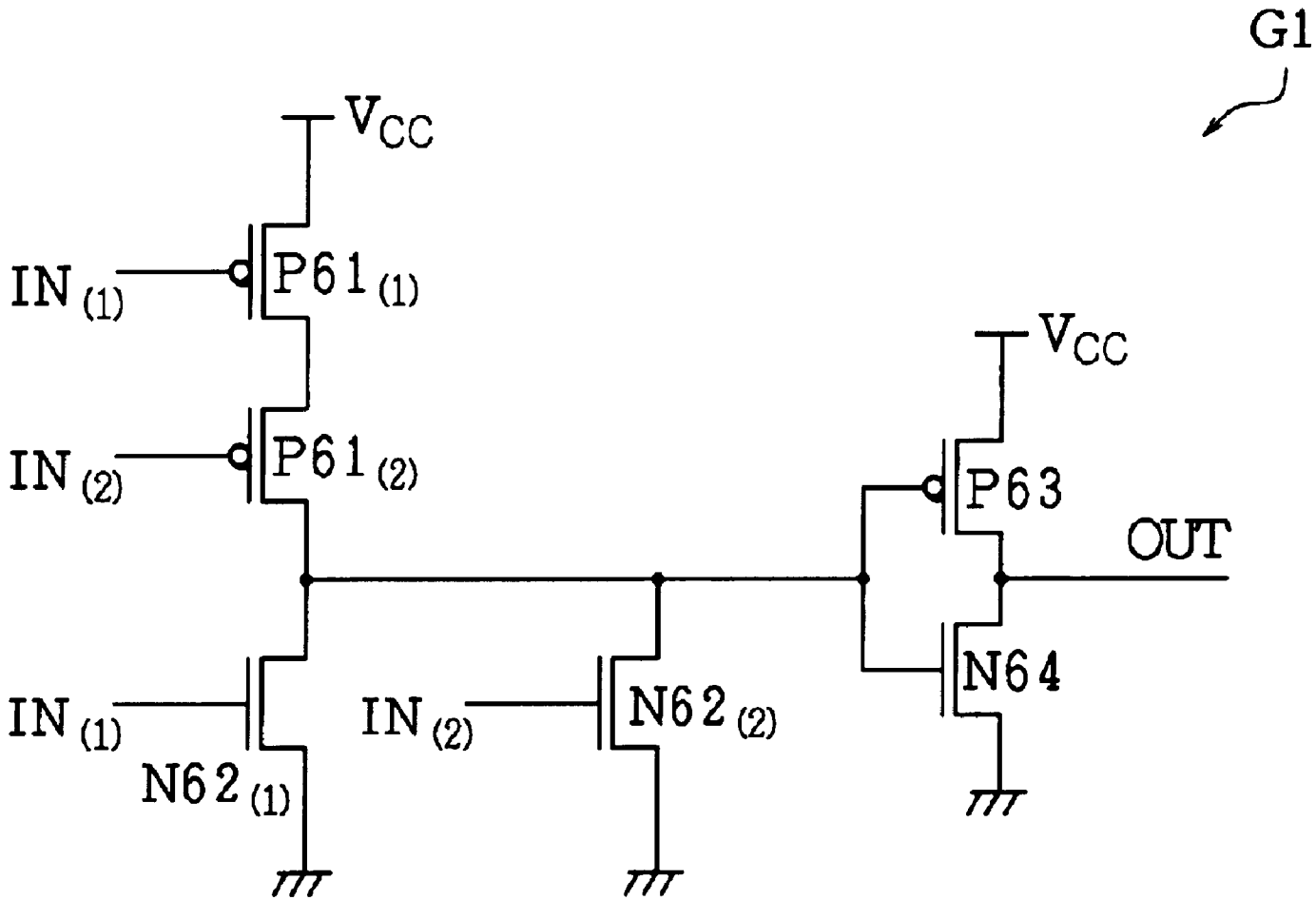
FIG. 12 is a circuit diagram showing an example of an OR circuit used in the shift register.

Meanwhile, as shown in FIG. 12, each of the OR circuits G1 is provided with a series circuit consisting of P-type MOS transistors $\mathbf{P61}_{(1)}$ and later corresponding to the inputs $IN_{(1)}$ and later, a parallel circuit consisting of N-type MOS transistors $\mathbf{N62}_{(1)}$ and later corresponding to the inputs $IN_{(1)}$, and a CMOS inverter consisting of a P-type MOS transistor P63 and an N-type MOS transistor N64. Here, the OR circuit G1 is an OR circuit with two inputs, so that the two transistors P61 and the two transistors N62 are respectively provided. Inputs $IN_{(1)}$ are applied to the gates of the transistors $\mathbf{P61}_{(1)}$ and $\mathbf{N62}_{(1)}$, and inputs $IN_{(2)}$ are applied to the gates of the transistors $\mathbf{P62}_{(2)}$ and $\mathbf{N62}_{(2)}$. Further, the series circuit and the parallel circuit are connected in series and are disposed between the driving voltage $V_{CC}$ and the ground level. Moreover, a connecting point of the series circuit and the parallel circuit is connected to the input end of the CMOS inverter, namely, to the gates of the transistors P63 and N64. With this arrangement, the OR circuit G1 can output an OR of the inputs $IN_{(1)}$ and $IN_{(2)}$ from the drains of the transistors P63 and N64, that serve as the output terminal of the CMOS inverter.

Incidentally, in FIG. 8, the OR circuit $\mathbf{G1}_{(j)}$ is provided for finding an OR of the input and the output of the D flip flop $\mathbf{F2}_{(i)}$ and for providing an instruction of operation/suspension to the level shifter $\mathbf{23}_{(i)}$. However, if the level shifters themselves can find an OR of the input and the output of the D flip flop $\mathbf{F2}_{(i)}$ and judge operation/suspension, the OR circuit $\mathbf{G1}_{(i)}$ can be omitted.

Figure 13:
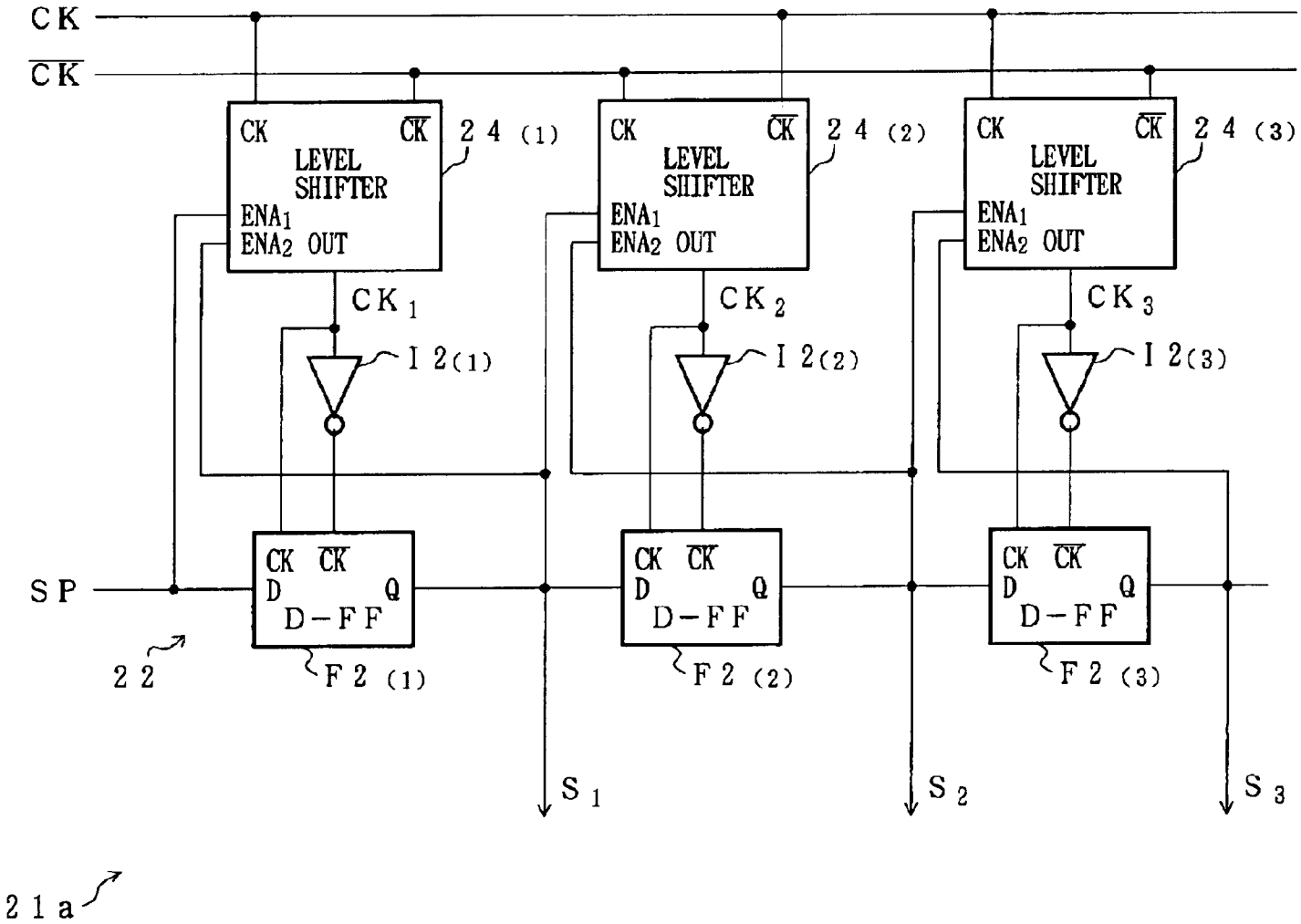
FIG. 13 is a block diagram showing a variation of the shift register.

To be specific, as shown in FIG. 13, in a shift resistor 21*a* of the present variation, a level shifter $\mathbf{24}_{(i)}$, which operates when the control signal $ENA_1$ or $ENA_2$ is active (true), is provided instead of the level shifter $\mathbf{23}_{(i)}$. Accordingly, the OR circuit $\mathbf{G1}_{(i)}$ of FIG. 8 is omitted, and the input and the output of the D flip flop $\mathbf{F2}_{(i)}$ are directly inputted as the control signals $ENA_1$ or $ENA_2$ to the corresponding level shifter $\mathbf{24}_{(i)}$.

Figure 14:
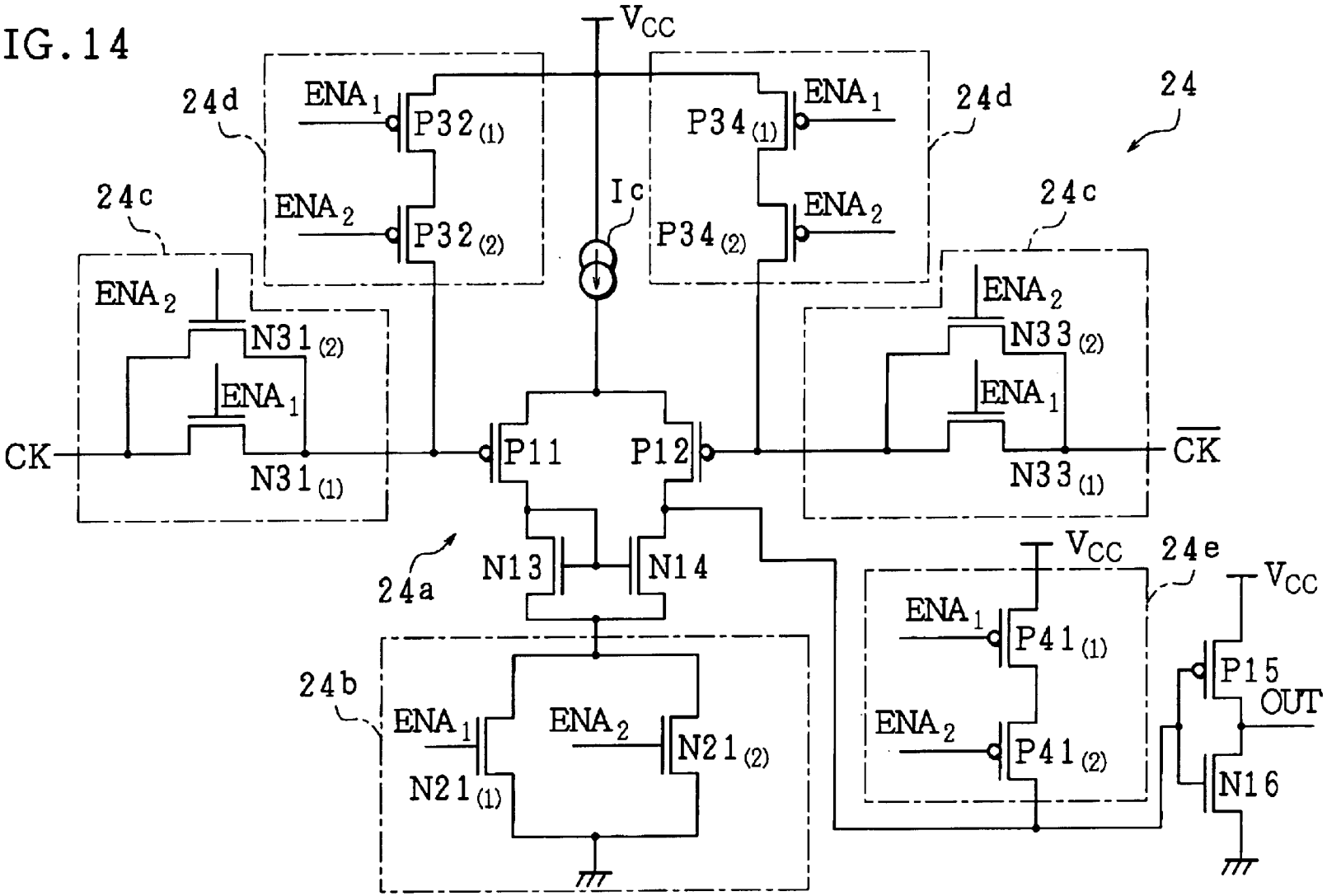
FIG. 14 is a circuit diagram showing an example of the level shifter in the shift register.

As shown in FIG. 14, the level shifter 24 has virtually the same construction as the level shifter 13 of FIG. 7; however, unlike the level shifter 13, power supply control sections 24*b* to an output stabilizing section 24*e* are provided with transistors N21 to P41, each being provided in the same number as each of the control signals $ENA_1$ and $ENA_2$ (in this case, respectively two) so as to correspond to the control signals $ENA_1$ and $ENA_2$. To be specific, in the power supply control section 24*b*, the transistors $\mathbf{N21}_{(1)}$ and $\mathbf{N21}_{(2)}$ are connected in parallel. In the same manner, in the input control section 24*c* corresponding to the transistor P11, the transistors $\mathbf{N31}_{(1)}$ and $\mathbf{N31}_{(2)}$ are connected in parallel, and in the input control section 24*c* corresponding to the transistor P12, the transistors $\mathbf{N33}_{(1)}$ and $\mathbf{N33}_{(2)}$ are connected in parallel. Meanwhile, in the output stabilizing section 24*e*, the transistors $\mathbf{P41}_{(1)}$ and $\mathbf{P41}_{(2)}$ are connected in series. Each of the input switching element shutting-off control sections 24*d* consists of the transistors $\mathbf{P32}_{(1)}$ and $\mathbf{P32}_{(2)}$ connected in series, or the transistors $\mathbf{P34}_{(1)}$ and $\mathbf{P34}_{(2)}$ connected in series. Further, in the present embodiment, the shift register 21*a* transmits a high-level pulse signal, so that the control signal $ENA_1$ is applied to the gate of the transistor corresponding to $ENA_1$ (subscript is $_{(1)}$) among the transistors $\mathbf{N21}_{(1)}$ to $\mathbf{P41}_{(2)}$, and the control signal $ENA_2$ is applied to the gate of the transistor corresponding to the control signal $ENA_2$ (subscript is $_{(2)}$).

According to the above construction, when at least one of the control signal $ENA_1$ and $ENA_2$ is at a high level, the transistor $\mathbf{N21}_{(1)}$ or $\mathbf{N21}_{(2)}$, the transistor $\mathbf{N31}_{(1)}$ or $\mathbf{N31}_{(2)}$, and the transistor $\mathbf{N33}_{(1)}$ or $\mathbf{N33}_{(2)}$ are brought into conduction. Further, the transistor $\mathbf{P32}_{(1)}$ or $\mathbf{P32}_{(2)}$, the transistor $\mathbf{P34}_{(1)}$ or $\mathbf{P34}_{(2)}$, and the transistor $\mathbf{P41}_{(1)}$ or $\mathbf{P41}_{(2)}$ are shut off. Consequently, in the same manner as the level shifter 13, the level shifter 24 is operated. In contrast, when both of the control signals $ENA_1$ and $ENA_2$ are at a low level, the N-type transistors $\mathbf{N21}_{(1)}$ to $\mathbf{N34}_{(2)}$ are all shut off and the P-type transistors $\mathbf{P31}_{(1)}$ to $\mathbf{P41}_{(2)}$ are all brought into conduction, so that the level shifter 24 is suspended in the same manner as the level shifter 13. Consequently, in the same manner as the level shifter $\mathbf{23}_{(i)}$ of FIG. 8, the level shifter $\mathbf{24}_{(1)}$ can be operated/suspended according to the input and the output of the corresponding D flip flop $\mathbf{P2}_{(i)}$, thereby achieving the same effect.

[Embodiment 3]

Incidentally, in Embodiments 1 and 2, a level shifter is provided for each flip flop. However, when a smaller circuit is considerably required, it is possible to provide a level shifter for a plurality of the flip flops, as will be described in the following Embodiments. Referring to FIGS. 15 to 19, the present embodiment describes a construction in which a level shifter is provided for a plurality of SR flip flops.

Figure 15:
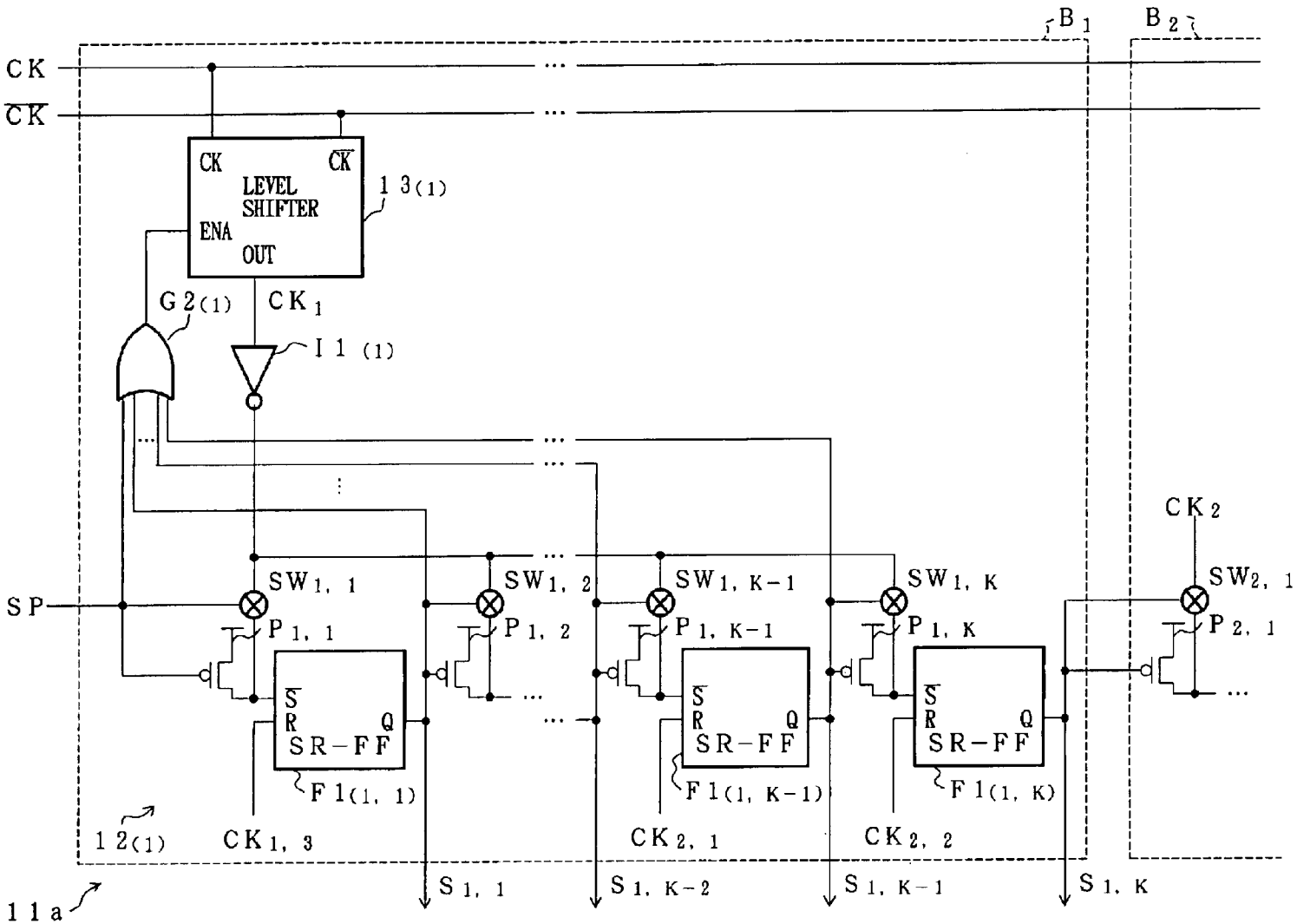
FIG. 15 is a block diagram showing a shift register in which a level shifter is provided for a plurality of set reset flip flops, in accordance with still another embodiment of the present invention.

To be specific, in a shift resistor 11*a* of the present embodiment, as shown in FIG. 15, N pieces of SR flip flops F1 are divided for every K pieces into a plurality of blocks $B_1$ to $B_P$. Moreover, a level shifter 13 is disposed for each of the blocks B. Hereinafter, for convenience of explanation, a $j_{th}$ SR flip flop F1 in an $i_{th}$ block $B_i$ is referred to as $F1_{(i,j)}$, where i represents an integer between 1 and P and j represents an integer between 1 and K.

Figure 16:
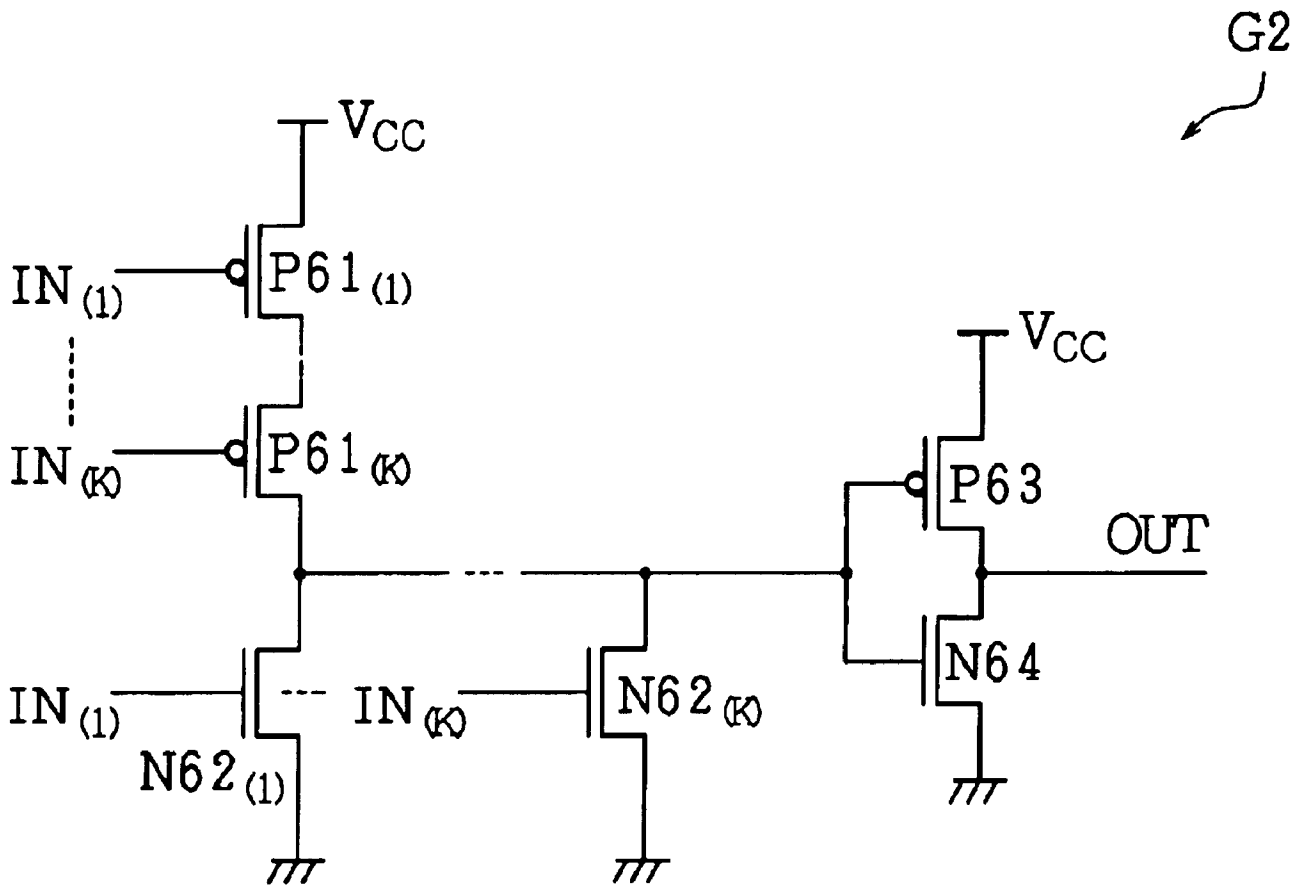
FIG. 16 is a circuit diagram showing an example of an OR circuit used in the shift register.

Furthermore, in the present embodiment, in each block $B_i$, an OR circuit $G2_{(i)}$ is provided for instructing a control signal $ENA_i$ to the level shifter $13_{(i)}$. The OR circuit $G2_{(i)}$ is an OR circuit with K inputs that calculates an OR of an input signal to the block $B_i$ and each output signal of the SR flip flops $F1_{(i,1)}$ to $F1_{i,(K-1)}$ except for at the final step of the block $B_i$, and outputs the OR to the level shifter $13_{(i)}$. Here, a start signal SP serves as an input signal to the block $B_i$ in the block $B_1$ of the first step, and an output signal of the previous block $B_{i-1}$ serves as an input signal in the block $B_i$ of the second step or later. For example, as shown in FIG. 16, the above OR circuit G2 can be realized by increasing the transistors P61 and the transistors N62 to the number of inputs (in this case, K inputs) in the OR circuit G1 of FIG. 12.

Figure 17:
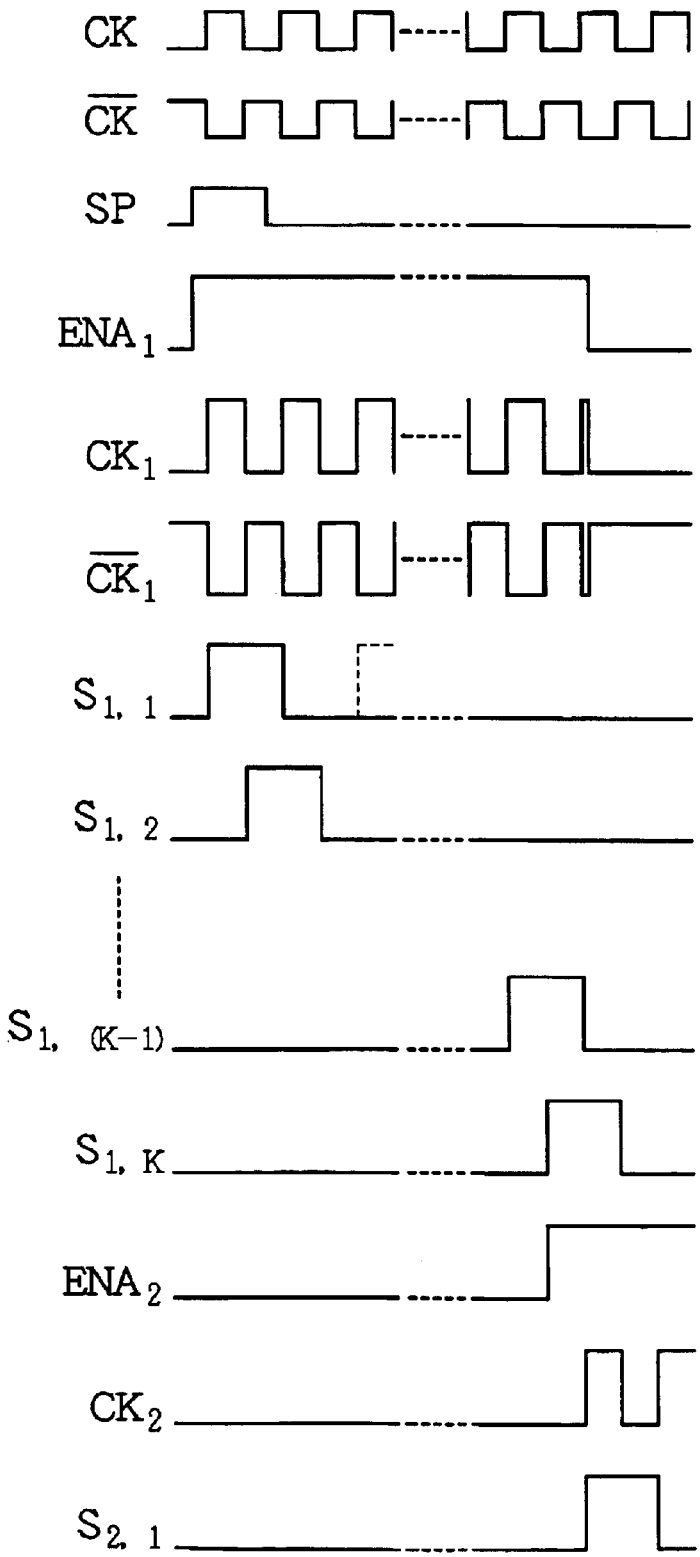
FIG. 17 is a timing chart showing an operation of the shift register.

With this arrangement, as shown in FIG. 17, from the start of a pulse input to the block $B_i$ to the end of a pulse output regarding the output $S_{i,(G-1)}$) of the SR flip flop $F1_{(i,(K-1))}$, which belongs to a step before the last one, a control signal $ENA_i$ to the level shifter $13_{(i)}$ is at a high level. As a result, the level shifter $13_{(i)}$ can output a clock signal $CK_i$ at least when an input of the clock signal $CK_i$ is required in any one of the SR flip flops $F1_{(i,1)}$ to $F1_{(i,K)}$, namely, from the start of the pulse input to the setting of the SR flip flop $F1_{(i,K)}$ of the final step. Further, after the SR flip flop $F1_{(i-K)}$ is set, the level shifter $13_{(i)}$ can suspend its operation at the end of the pulse output of the output $S_{i,(k-1)}$ of the SR flip flop $F1_{(i,(K-1))}$.

In the present embodiment, the level shifter $13_{(i)}$ continues to output the clock signal $CK_1$ when a clock input is necessary in any one of the SR flip flops $F1_{(i,j)}$ in the block $B_i$. Therefore, if the clock signal $CK_i$ is applied to the SR flip flops $F1_{(i,j)}$ as it is, the SR flip flop $F1_{(i,j)}$ is set after being reset; consequently, a plurality of pulses are generated from a single pulse of the start signal SP. Hence, as shown in FIG. 15, the shift register 11*a* is provided with a switch $SW_{i,j}$ between the level shifter $13_{(i)}$ and the SR flip flops $F1_{(i,j)}$ so as to apply the clock signal $CK_i$ to the SR flip flops $F1_{(i,j)}$ only when the SR flip flops $F1_{(i,(j-1))}$ of the previous step outputs a pulse. Moreover, while the switch $SW_{i,j}$ is shut off, in order to interrupt a set input to the SR flip flop $F1_{(i,j)}$, a driving voltage $V_{CC}$ is applied to a negative-logic set terminal S bar of the SR flip flop $F1_{(i,j)}$ via a P-type MOS transistor $P_{i,j}$. In the shift register 11*a* of the first step, a start signal SP is applied to the gate of a transistor $P_{1,1}$, and in other steps, an output $S_{i,j-1}$ of the SR flip flop $F1_{(i,j-1)}$ of the previous step is applied to the gate of the transistor $P_{i,j}$. Hence, while the switch $SW_{i,j}$ is shut off, the transistor $P_{i,j}$ is brought into conduction and the set terminal S bar is maintained at a predetermined potential (in this case, the driving voltage $V_{CC}$) so as to interrupt the set input. Consequently, the start signal SP is transmitted without any problems. Additionally, to an SR flip flop F1 which does not receive the clock signal $CK_i$ after a reset, for example, to the SR flip flop $F1_{(i,K)}$ of the final step, the clock signal can be directly inputted without passing through the switch SW.

According to this arrangement, as described in Embodiment 1, a distance between the level shifter 13 and the SR flip flop F1 is longer as compared with the construction in which the level shifter 13 is provided for each of the SR flip flops F1. However, as compared with the conventional art in which a single level shifter applies a clock signal CK to all SR flip flops F1, this arrangement makes it possible to reduce a distance between the level shifter 13 and the SR flip flop F1 and to reduce the buffer. Thus, virtually in the same manner as Embodiment 1, it is possible to realize the shift register 11*a* achieving small power consumption.

In this case, when the number of the SR flip flops F1 in the block B is increased, it is possible to reduce the number of the level shifters 13 in the shift register 11*a*, thereby simplifying the circuit construction. Meanwhile, in the case of the excessive SR flip flops, the driving capability of the level shifter 13 becomes insufficient, so that a buffer is necessary, resulting in larger power consumption. Therefore, when the size of the circuit needs to be reduced without a large increase in power consumption, it is more preferable to set the number of the SR flip flops F1 in each of the blocks B such that the level shifter $13_{(i)}$ can apply the clock signal $CK_{(i)}$ without a buffer.

Figure 18:
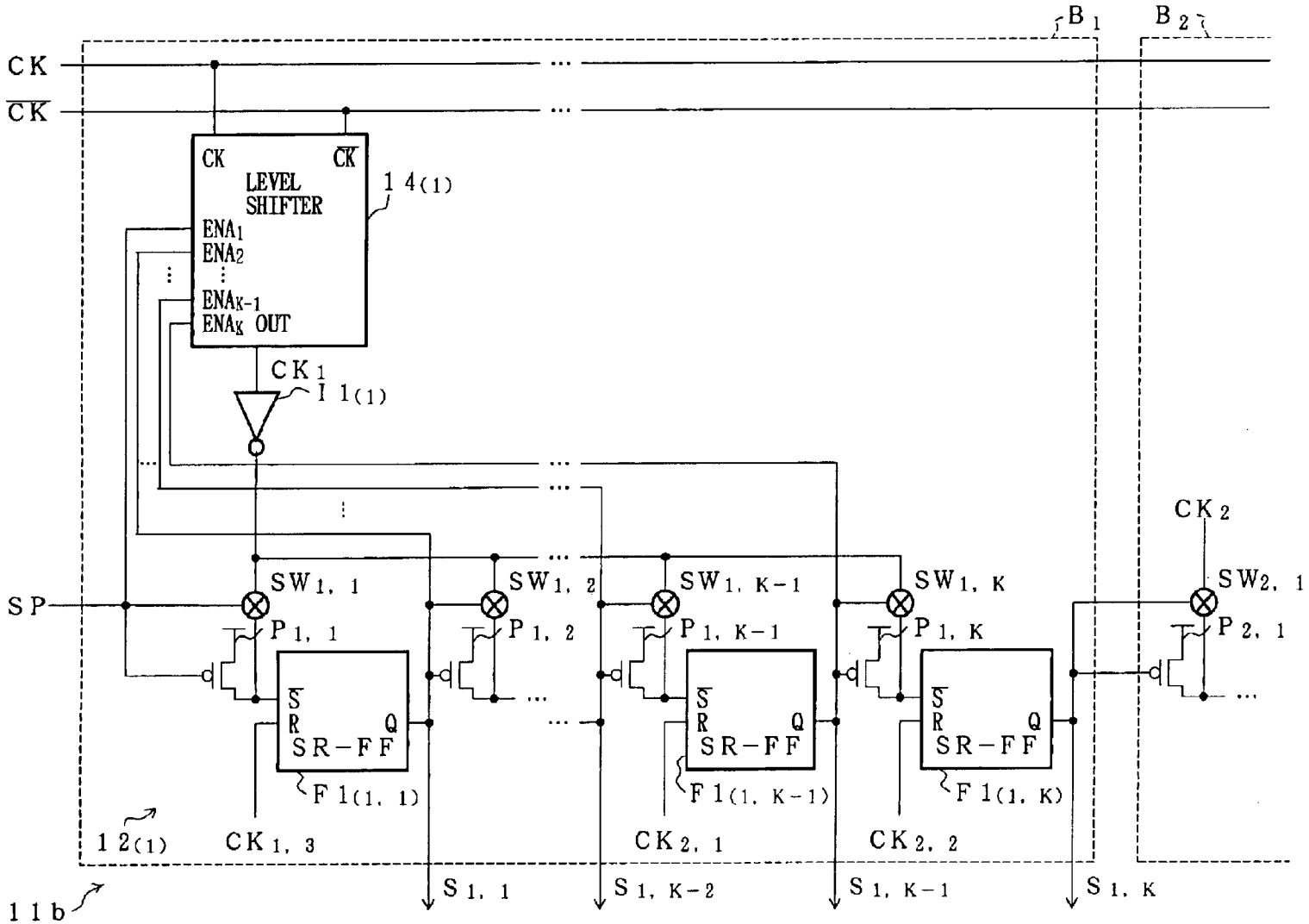
FIG. 18 is a block diagram showing a variation of the shift register.
Figure 19:
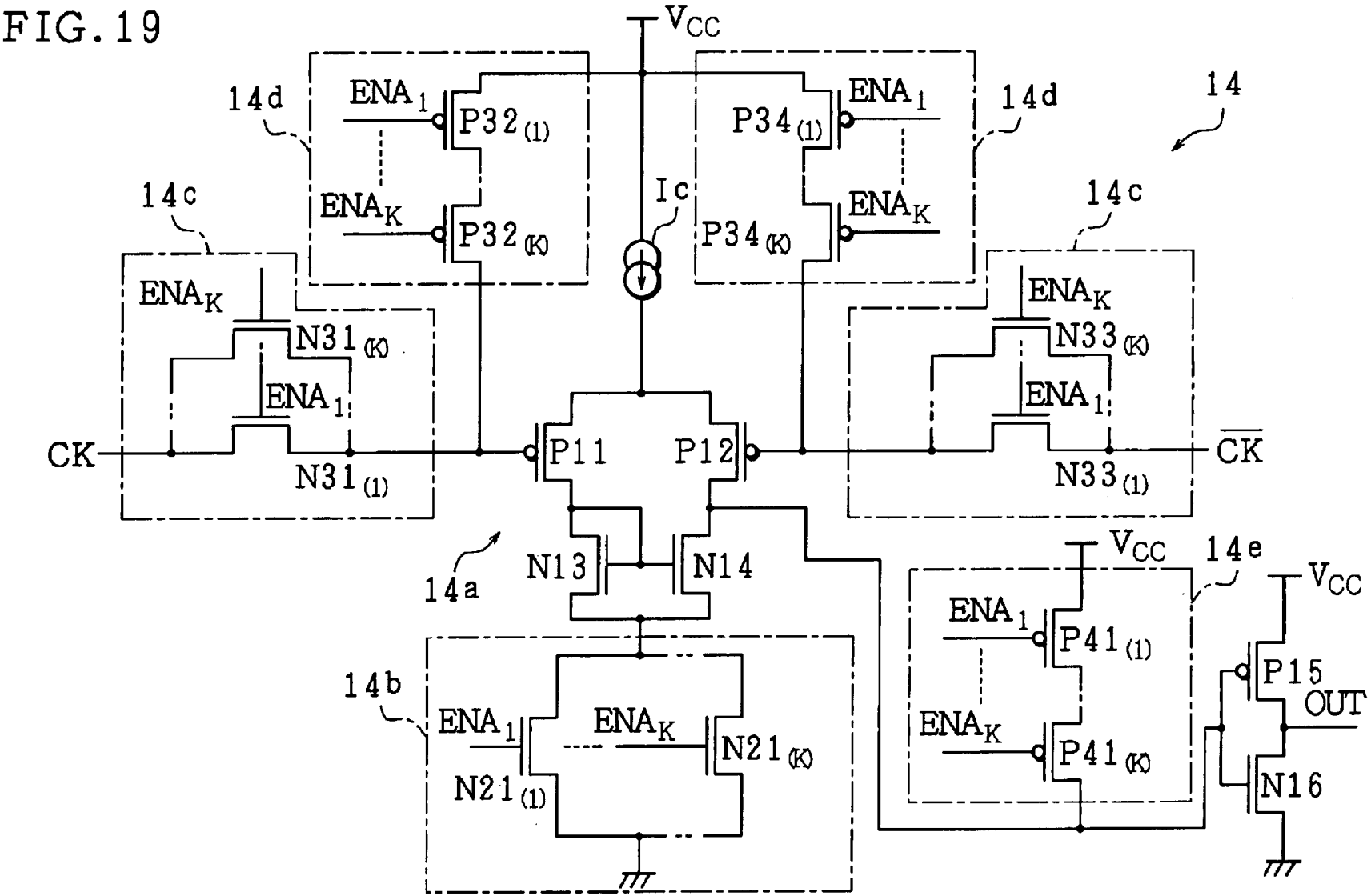
FIG. 19 is a circuit diagram showing an example of the level shifter in the shift register.

Here, in the above Embodiment, the construction is taken as an example, in which the OR circuit G2 controls the operation/suspension of the level shifter 13. However, as shown in FIG. 18, in the same manner as the level shifter 24 of FIG. 13, it is also possible to allow the level shifter 14 to determine the operation/suspension based on the input signals transmitted to the OR circuit G2. As shown in FIG. 19, the level shifter 14 can be realized by, for example, providing each of the transistors N21 to P41 of the level shifter 24 shown in FIG. 14 in the same number as the inputs (in this case, the number is K).

[Embodiment 4]

Figure 20:
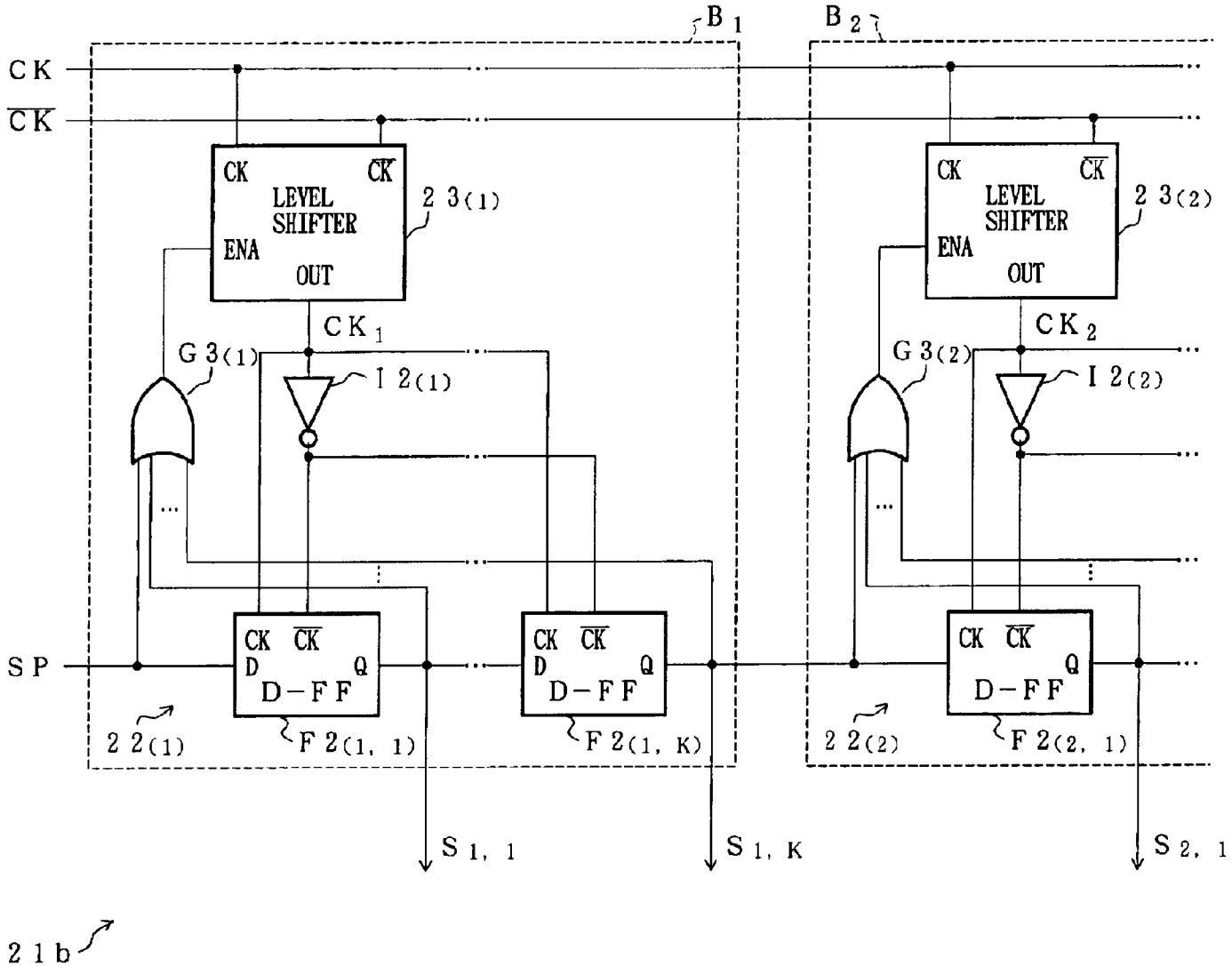
FIG. 20 is a block diagram showing a shift register in which a level shifter is provided for a plurality of D flip flops, in accordance with still another embodiment of the present invention.

Referring to FIGS. 20 to 24, the following explanation describes a construction in which a level shifter is provided for a plurality of D flip flops. Namely, as shown in FIG. 20, a shift register 21*b* of the present embodiment is similar to a shift register 21 of FIG. 8; however, N pieces of D flip flops F2 are divided for every K pieces into a plurality of blocks $B_1$ to $B_P$. Further, a level shifter 23 is provided for each of the blocks B.

Figure 21:
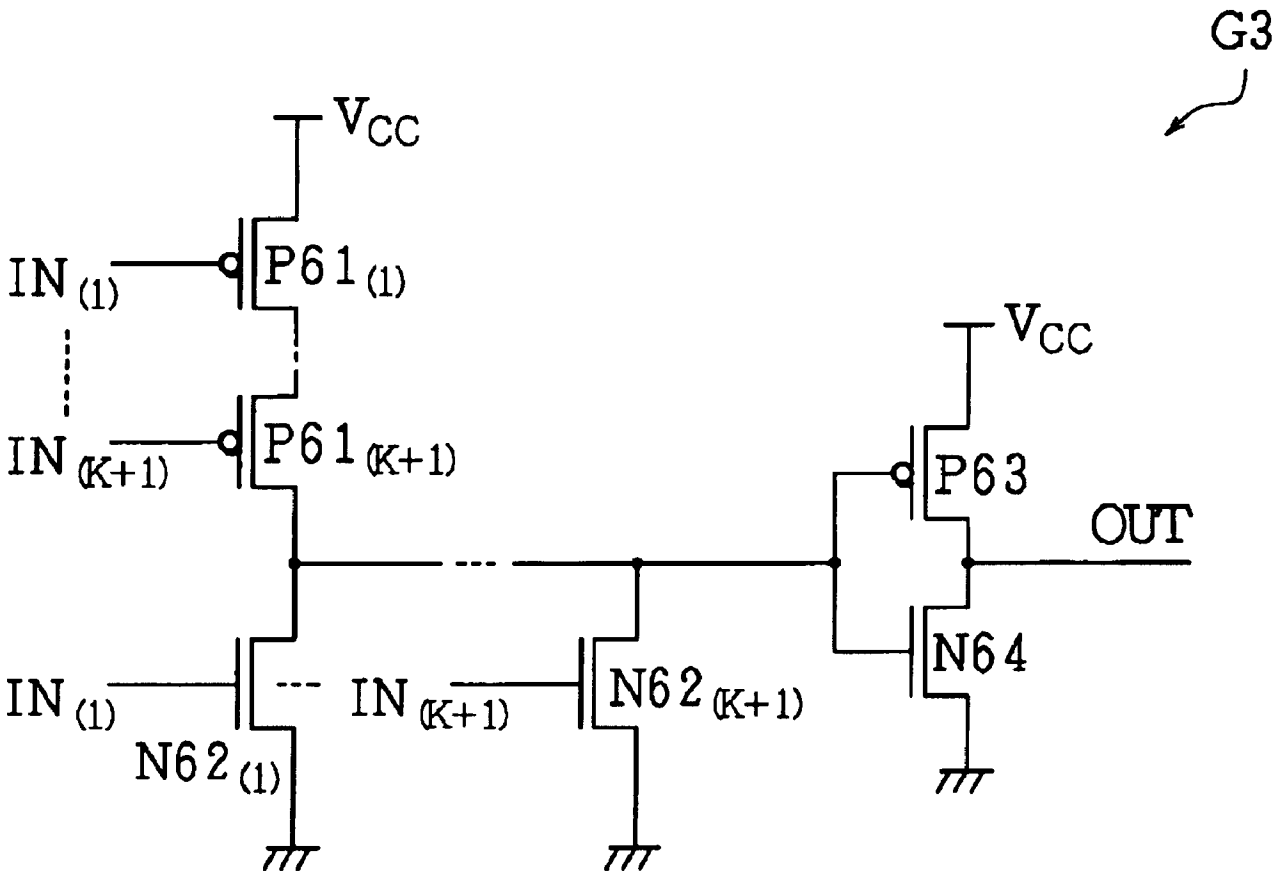
FIG. 21 is a circuit diagram showing an example of an OR circuit used in the shift register.

Moreover, in the present embodiment, each of the blocks $B_i$ is provided with an OR circuit $G3_{(i)}$ for instructing a control signal $ENA_i$ to the level shifter $23_{(i)}$. The OR circuit $G3_i$ is an OR circuit having (K+1) inputs. The OR circuit $G3_i$ calculates ORs of the inputs and outputs of the D flip flops $F2_{(i,1)}$ to $F2_{(i,K)}$ and outputs the ORs to the level shifter $23_{(i)}$. Here, an input signal to the D flip flop $F2_{(i,1)}$ of the final step is a start signal SP in the block B1 of the final step. In the second step or later, an input signal is an output signal from the block $B_{i-1}$ of the previous step. The OR circuit G3 can be realized by, as shown in FIG. 21, increasing the transistors P61 and the transistors N62 of an OR circuit G1 shown in FIG. 12 to the number of the inputs (in this case, the number is K+1).

Figure 22:
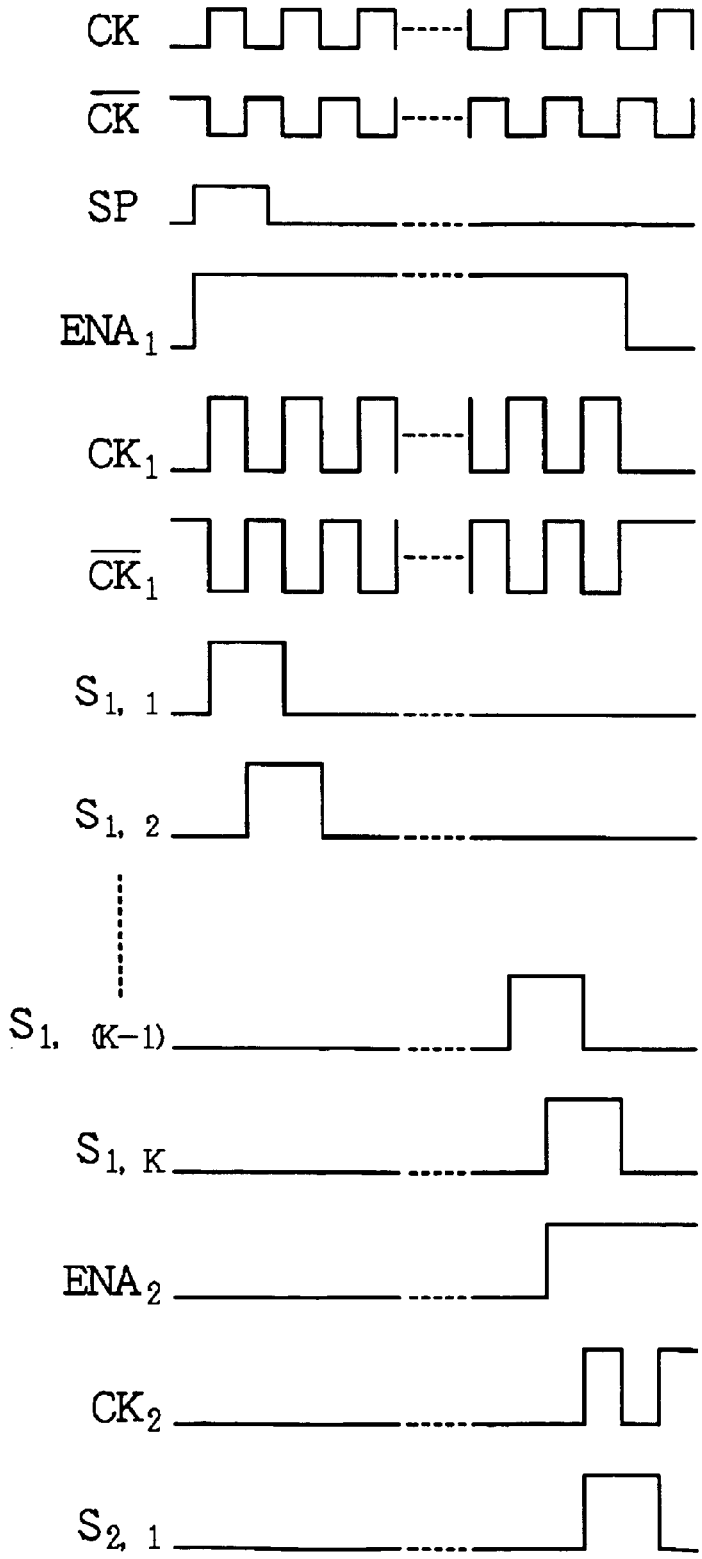
FIG. 22 is a timing chart showing an operation of the shift register.
Figure 23:
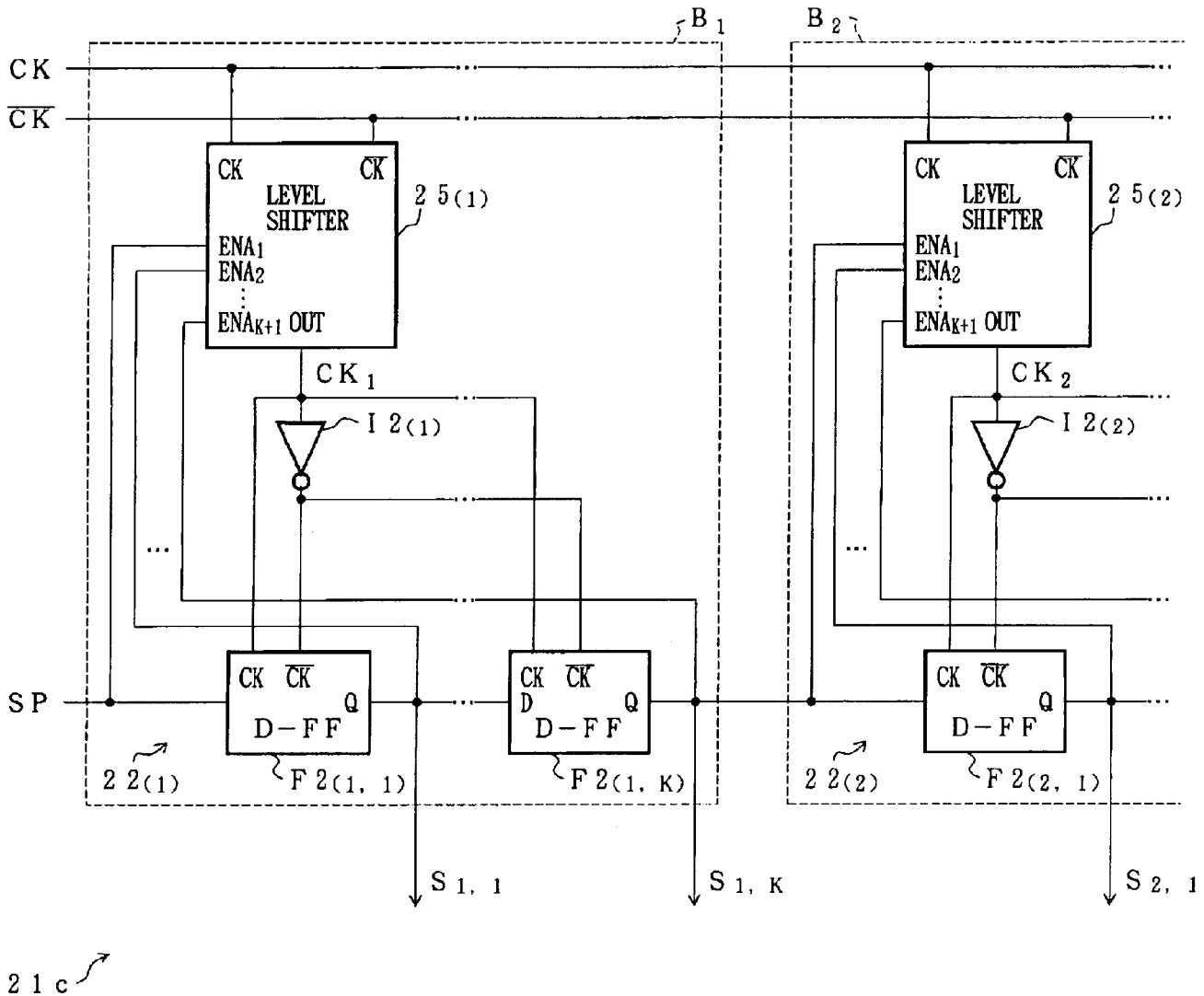
FIG. 23 is a block diagram showing a variation of the shift register.

With this arrangement, as shown in FIG. 22, when any one of the D flip flops $F2_{(i,1)}$ to $F2_{(i,K)}$ requires an input of a clock signal $CK_i$ in the block $B_i$, namely, from the start of a pulse input to the block $B_i$ to the end of the pulse output of the D flip flop $F2_{(i,K)}$ in the final step, the control signal $ENA_i$ to the level shifter $23_{(i)}$ is at a high level, so that the level shifter $23_{(i)}$ can transmit the clock signal $CK_i$. Further, the control signal $ENA_i$ is at a low level in the other periods, so that the level shifter $23_{(i)}$ can suspend its operation.

According to this arrangement, a distance between the level shifter 23 and the D flip flop F2 is longer as compared with a shift register 21 of Embodiment 2, in which a level shifter 23 is provided for each D flip flop F2. However, as compared with the conventional art in which a single level shifter supplies a clock signal CK to all D flip flops, this arrangement makes it possible to reduce a distance between the level shifter 23 and the D flip flop F2 and to reduce the buffer. Therefore, virtually in the same manner as Embodiment 2, it is possible to realize the shift register 21*b* achieving small power consumption.

Furthermore, in the same manner as Embodiment 3, the present embodiment makes it possible to reduce the number of the level shifters 23 to less than the level shifters 21. Additionally, when it is necessary to reduce the size of the circuit without a large increase in power consumption, it is more preferable to set the number of the D flip flops F2 in each of the blocks Bi such that the level shifter $\mathbf{23}_{(i)}$ can apply the clock signal $CK_{(i)}$ without a buffer.

Figure 24:
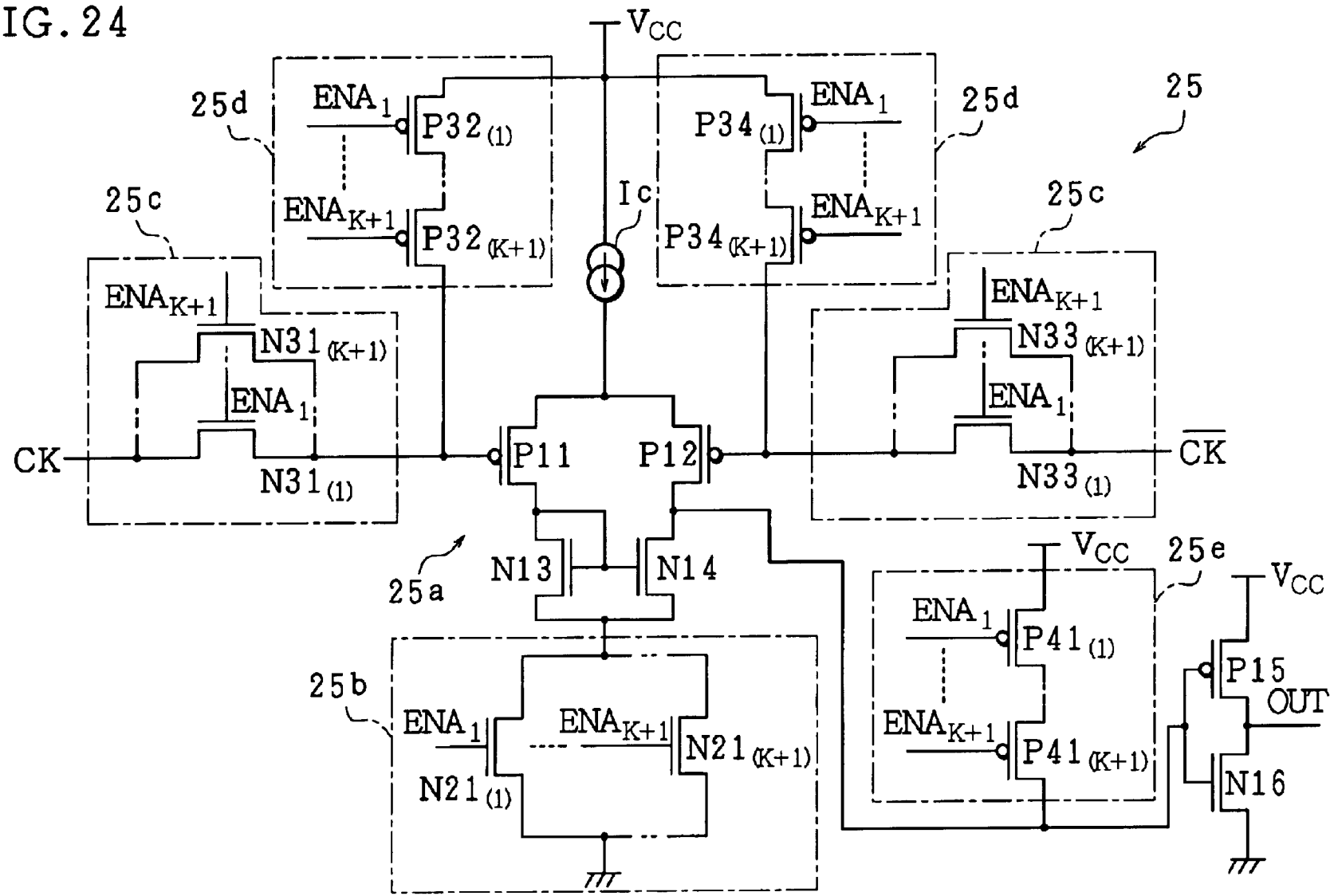
FIG. 24 is a circuit diagram showing an example of the level shifter in the shift register.

Here, in FIG. 20, the construction is taken as an example, in which the OR circuit G3 controls the operation/suspension of the level shifter 23. However, in the same manner as the shift register 21*c* of FIG. 23, as shown in the shift register 21*c* of FIG. 23, it is also possible to allow the level shifter 25 to determine the operation/suspension based on the input signals transmitted to the OR circuit G3. As shown in FIG. 24, the level shifter 25 can be realized by, for example, providing each of the transistors N21 to P41 in the level shifter 14 of FIG. 19, in the same number as the inputs (in this case, the number is K).

[Embodiment 5]

Embodiment 3 (and Embodiment 4) describes the construction in which a level shifter or an OR circuit is used to obtain an OR of K, (K+1) signals so as to control the operation/suspension of the level shifter. Meanwhile, referring to FIGS. 25 to 29, the present embodiment describes a construction in which a latch circuit is used for controlling the operation/suspension of the level shifter.

Figure 25:
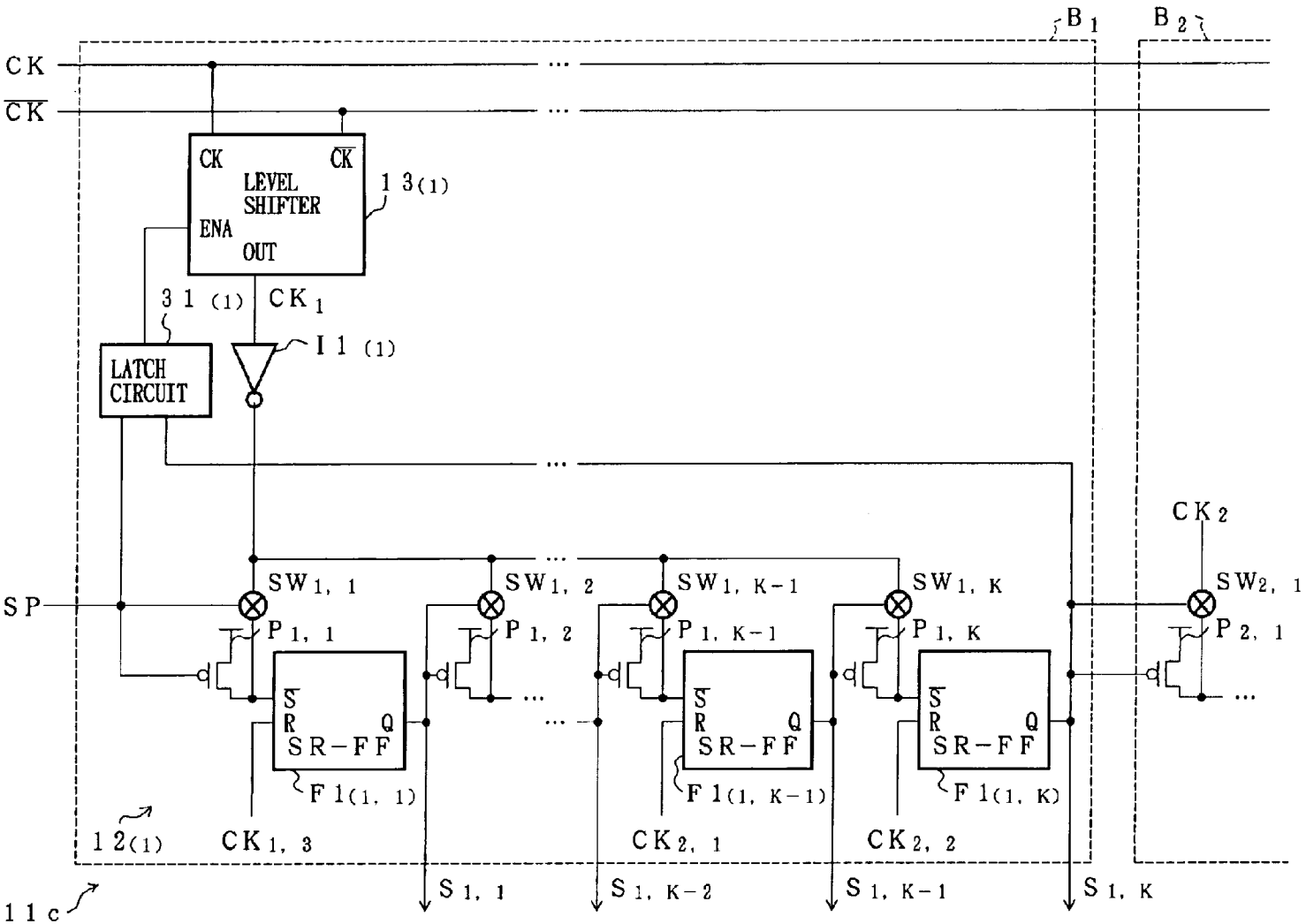
FIG. 25 is a block diagram showing a shift register including a latch circuit for controlling an operation of the level shifter, and set reset flip flops, in accordance with still another embodiment of the present invention.

To be specific, as shown in FIG. 25, a shift register 11*c* of the present embodiment is provided with a latch circuit $\mathbf{31}_{(i)}$ instead of an OR circuit $G\mathbf{2}_{(i)}$ of a shift register 11*a* shown in FIG. 15. The latch circuit 31 is arranged so as to change an output by using as triggers a) a pulse input to an SR flip flop $F\mathbf{1}_{(i,1)}$ of the first step in a block $B_1$ and b) a pulse output from an SR flip flop $F\mathbf{1}_{(i,K)}$ of the final step in a block $B_i$. With this arrangement, between the start of the pulse input and the start of the pulse output, it is possible to instruct an operation to a level shifter $\mathbf{13}_{(i)}$.

Figure 26:
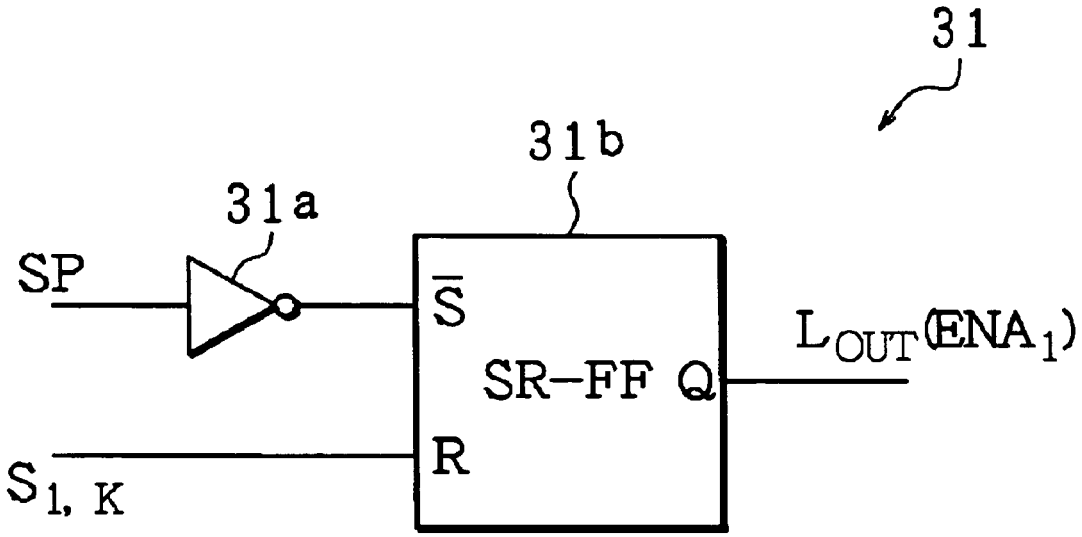
FIG. 26 is a block diagram showing an example of the latch circuit.

For example, in the first block $B_1$, a start signal SP inverted in an inverter 31*a* is applied to the latch circuit 31 as a set signal S bar having a negative logic, as shown in FIG. 26. Further, the latch circuit 31 is provided with an SR flip flop 31*b*, where an output $S_{1,K}$ of the SR flip flop $F\mathbf{1}_{(1,K)}$ in the final step is applied as a reset signal R having a positive logic. Additionally, in the following block $B_i$ and later, an output of the block $B_{i-1}$ in the previous step is applied instead of the start signal SP.

Figure 27:
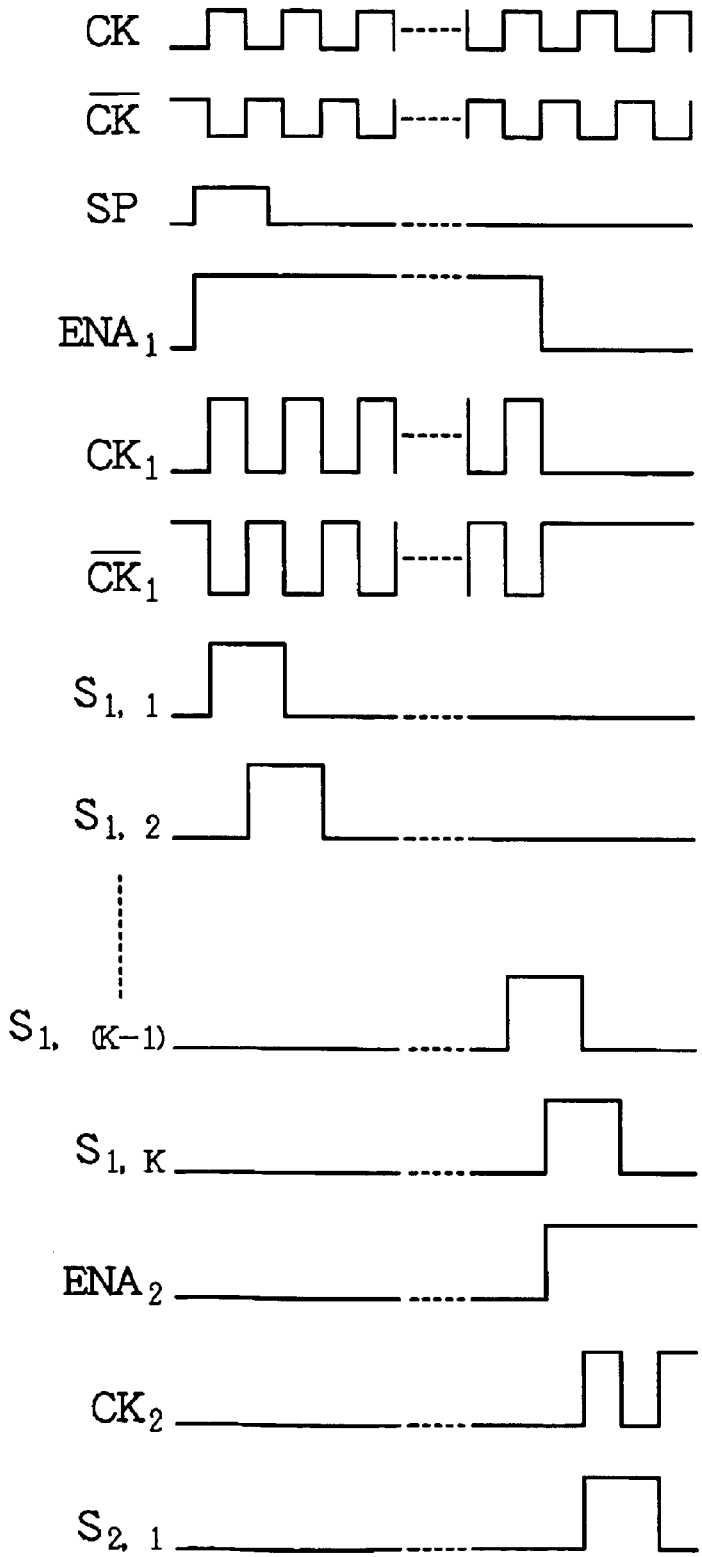
FIG. 27 is a timing chart showing an operation of the shift register.

In the above arrangement, as shown in FIG. 27, the latch circuit $\mathbf{31}_{(i)}$ sets a control signal $ENA_i$ at a high level a) from when an input to the SR flip flop $F\mathbf{1}_{(i,1)}$ of the final step is shifted to a high level b) to when the output $S_{i,K}$ is shifted to a high level. Thus, the level shifter $\mathbf{13}_{(i)}$ can continue to apply a clock signal $CK_i$ during this period. Moreover, when the output $S_{i,K}$ is shifted to a high level, the control signal $ENA_i$ is shifted to a low level, so that the level shifter $\mathbf{13}_{(i)}$ suspends its operation. Consequently, in the same manner as Embodiment 3, it is possible to realize the shift register 11*c* achieving smaller power consumption as compared with the conventional art.

Furthermore, unlike an OR circuit $G\mathbf{2}_{(i)}$ (level shifter $\mathbf{14}_{(i)}$) of Embodiment 3, in which the operation/suspension of a level shifter $\mathbf{13}_{(i)}$ ($\mathbf{14}_{(i)}$) is judged based on K signals, two signals trigger the latch circuit 31 to generate a control signal $ENA_i$, regardless of the number of steps K of the SR flip flops F1 in a block $B_i$. Therefore, it is possible to reduce the number of signal lines to two. The signal lines transmit a signal required for judging. The more signal lines for judging, the more intersections of the signal lines for judging and the signal lines for transmitting the output $S_{i,j}$ and the clock signals CK and $CK_i$, resulting in a capacity of each of the signal lines. Meanwhile, in the present embodiment, the signal lines for judging is reduced to two, so that it is more possible to prevent an increase in a wire capacity, the increase being caused by the signal lines for judging; thus, it is possible to realize the shift register 11*c* achieving small power consumption.

Figure 28:
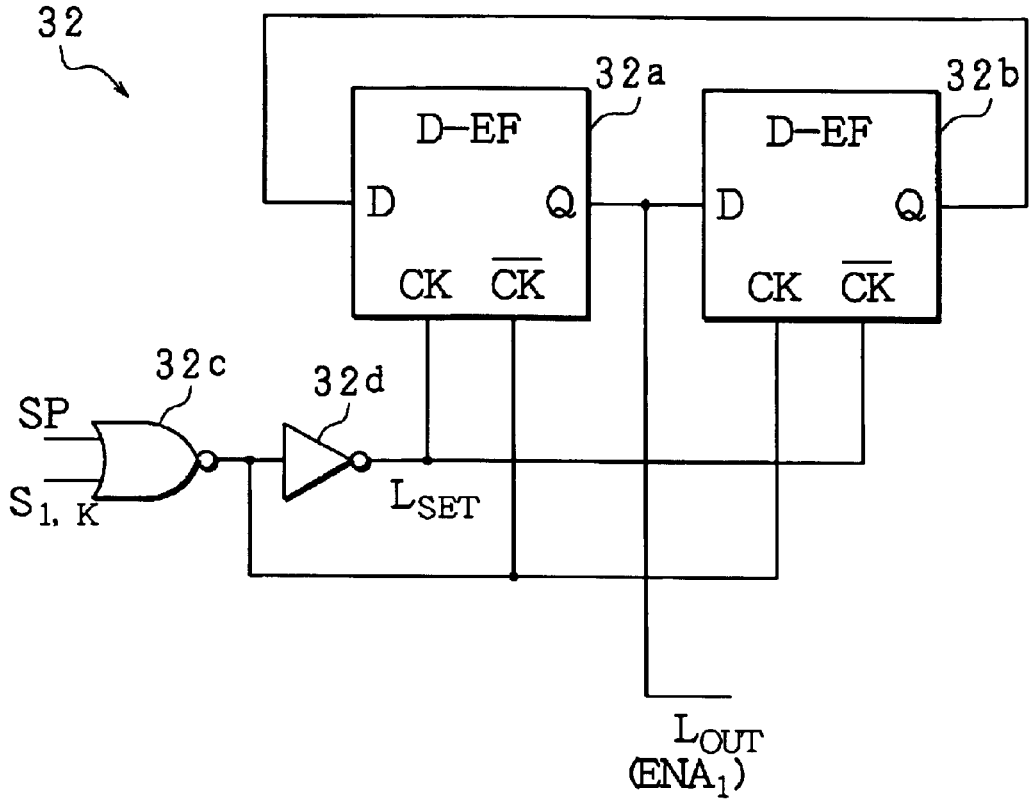
FIG. 28 is a block diagram showing another example of the latch circuit.

In FIG. 26, the construction in which the latch circuit $\mathbf{31}_{(i)}$ is constituted by the SR flip flops is taken as an example. However, the construction is not particularly limited. For example, even when a latch circuit 32 of FIG. 28 is used instead of the latch circuit $\mathbf{31}_{(i)}$, the same effect can be achieved as long as two signals serve as triggers to control the operation/suspension of the level shifter $\mathbf{13}_{(i)}$.

Figure 29:
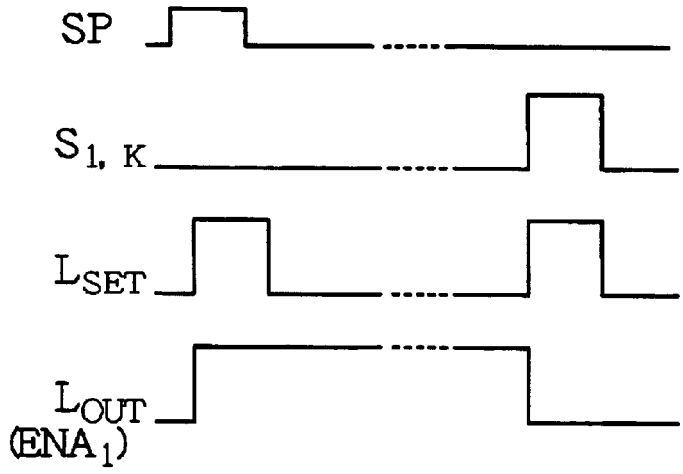
FIG. 29 is a timing chart showing an operation of the latch circuit.
Figure 30:
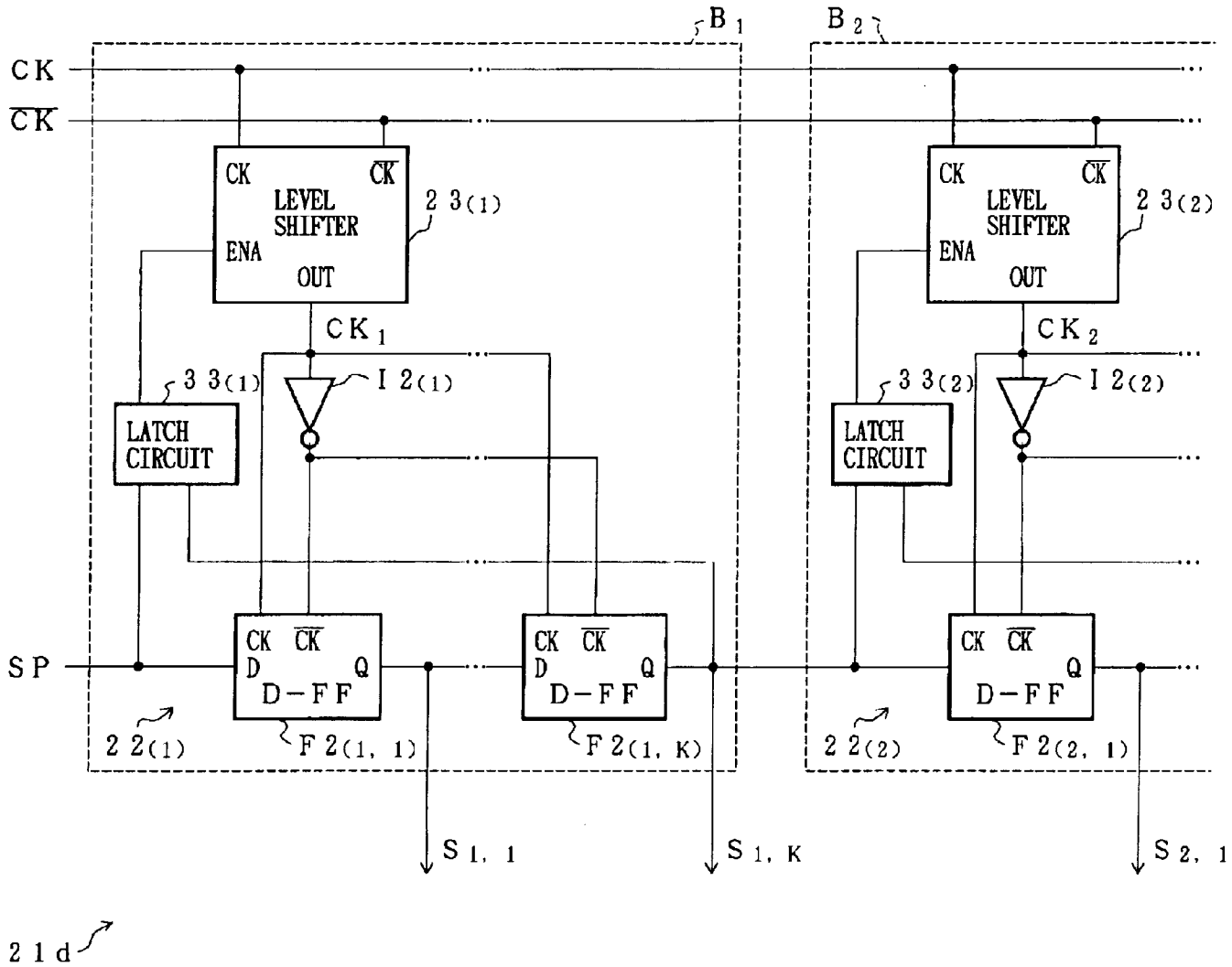
FIG. 30 is a block diagram showing a shift register including the latch circuit and D flip flops, in accordance with still another embodiment of the present invention.

The latch circuit 32 is provided with two D flip flops 32*a* and 32*b* constituting two frequency dividers, an NOR circuit 32*c* for calculating a NOT of an OR of the start signal SP and the output $S_{1,K}$ and an inverter 32*d* for inverting an output of the NOR circuit 32*c*. An output Q of the D flip flop 32*a* is inputted to the D flip flop 32*a* via the D flip flop 32*b*. Further, an output $L_{SET}$ of the inverter 32*d* is applied to the D flip flop 32*a* as a clock. Meanwhile, an output of the NOR circuit 32*c* is applied to the D flip flop 32*b* as a clock. Furthermore, an output $L_{OUT}$ of the D flip flop 32*a* is outputted as a control signal $ENA_1$. Consequently, as shown in FIG. 29, the latch circuit $\mathbf{32}_{(1)}$ can output a high-level control signal $ENA_1$ a) from the start of a pulse input to the SR flip flop $F\mathbf{1}_{(i,1)}$ in the first step b) to a rising edge of the output $S_{i,K}$, so that an instruction is provided to operate the level shifter $\mathbf{13}_{(i)}$.

Additionally, in the present embodiment, a) the start of a pulse input to the SR flip flop $F\mathbf{1}_{(i,1)}$ in the first step and b) the start of the pulse output of the SR flip flop $F\mathbf{1}_{(i,K)}$ in the final step are used as triggers of the latch circuit (31–32); however, the triggers are not particularly limited. As the triggers, it is also possible to adopt a signal for setting the control signal $ENA_i$ at an active level before a period when the SR flip flop F1 of the block $B_i$ requires a clock signal $CK_i$, and a signal for setting the control signal $ENA_i$ at an inactive level after the period, in order to achieve the same effect.

[Embodiment 6]

Referring to FIGS. 30 to 34, the present embodiment describes a construction in which a latch circuit controls the operation/suspension of a level shifter in a shift register using D flip flops.

To be specific, a shift register 21*d* of the present embodiment is provided with a latch circuit $\mathbf{33}_{(i)}$, which uses as triggers, a) a pulse input to the D flip flop $F\mathbf{2}_{(i,1)}$ in the first step and b) a pulse output of the D flip flop $F\mathbf{2}_{(i,K)}$ in the final step, virtually in the same manner as a latch circuit $\mathbf{31}_{(i)}$ of FIG. 25, instead of an OR circuit $G\mathbf{3}_{(i)}$ of a shift register 21*b* shown in FIG. 20. However, as described above, in the case of the D flip flop, a clock signal $CK_i$ is necessary until the D flip flop F2*(i,K)* of the final step stops a pulse output. Therefore, the latch circuit $\mathbf{33}_{(i)}$ is arranged so as to instruct an operation to the level shifter $\mathbf{23}_{(i)}$ from the start of the pulse input to the end of the pulse output.

Figure 31:
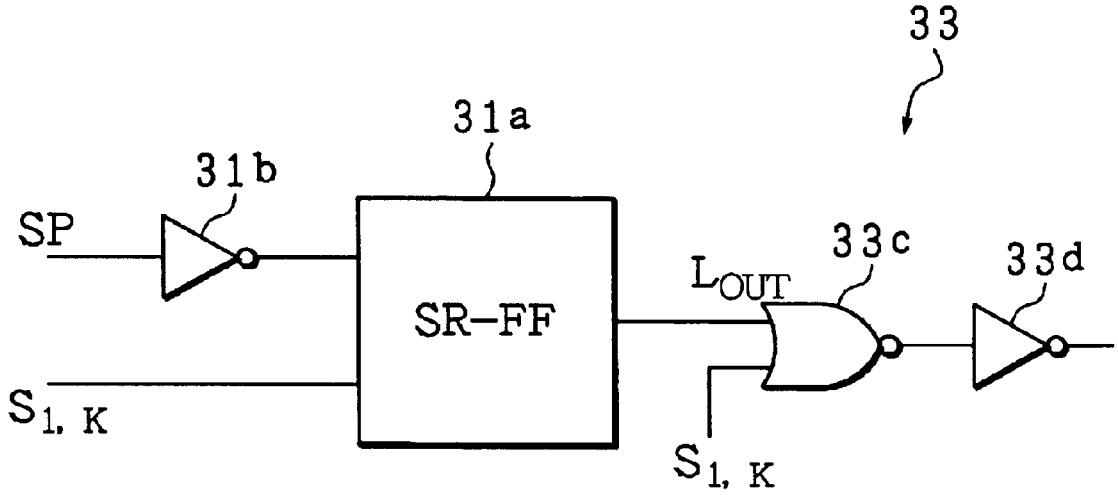
FIG. 31 is a block diagram showing an example of the latch circuit.

To be specific, as shown in FIG. 31, in the first block $B_1$, the latch circuit 33 is provided with a NOR circuit 33*c* for calculating a NOT of an OR of an output signal $L_{OUT}$ and an output $S_{1,K}$ of the final step, and an inverter 33*d* for inverting the calculation result, in addition to the latch circuit 31 of FIG. 26. Here, in the following block $B_i$, an output of the block $B_{i-1}$ of the previous step is applied instead of the start signal SP.

Figure 32:
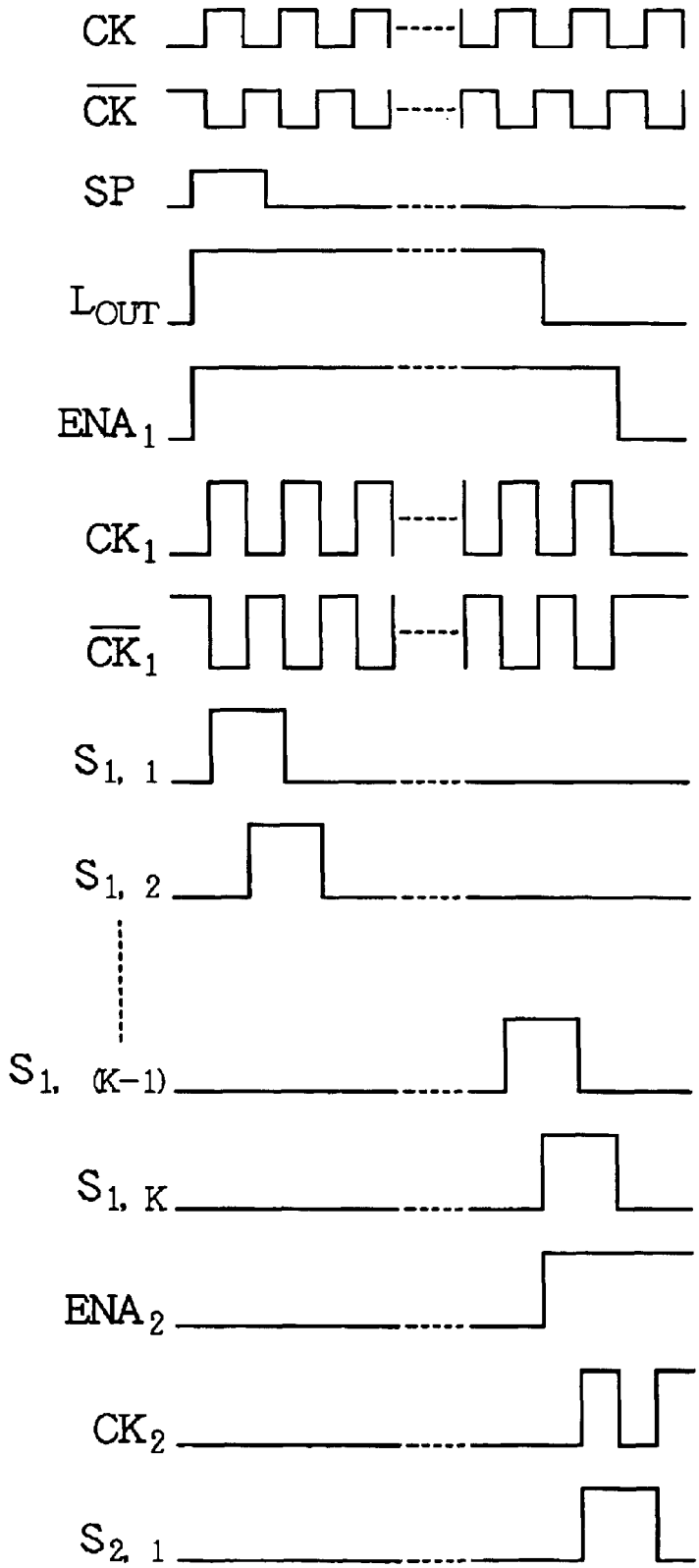
FIG. 32 is a timing chart showing an operation of the shift register.

As shown in FIG. 32, in the above arrangement, the latch circuit $\mathbf{33}_{(1)}$ sets the control signal $ENA_1$ at a high level a) from when an input to the D flip flop $\mathbf{F2}_{(1,1)}$ of the first step is shifted to a high level b) to when the output $S_{1,K}$ is shifted to a low level. Thus, the level shifter $\mathbf{23}_{(1)}$ can continue to apply the clock signal $CK_1$ during this period. Further, when the output $S_{1,K}$ is shifted to a low level, the control signal $ENA_1$ is shifted to a low level, so that the level shifter $\mathbf{23}_{(i)}$ suspends its operation. Consequently, in the same manner as Embodiment 4, it is possible to achieve the shift register 21*d* smaller in power consumption than the conventional art.

Moreover, like Embodiment 5, the present embodiment makes it possible to reduce the number of signal lines required for judging the operation/suspension of the level shifter 23. Hence, it is more possible to prevent an increase in a wiring capacity, the increase being caused by the signal lines for judging, as compared with Embodiment 4. Furthermore, it is possible to realize the shift register 21*d* achieving small power consumption.

Figure 33:
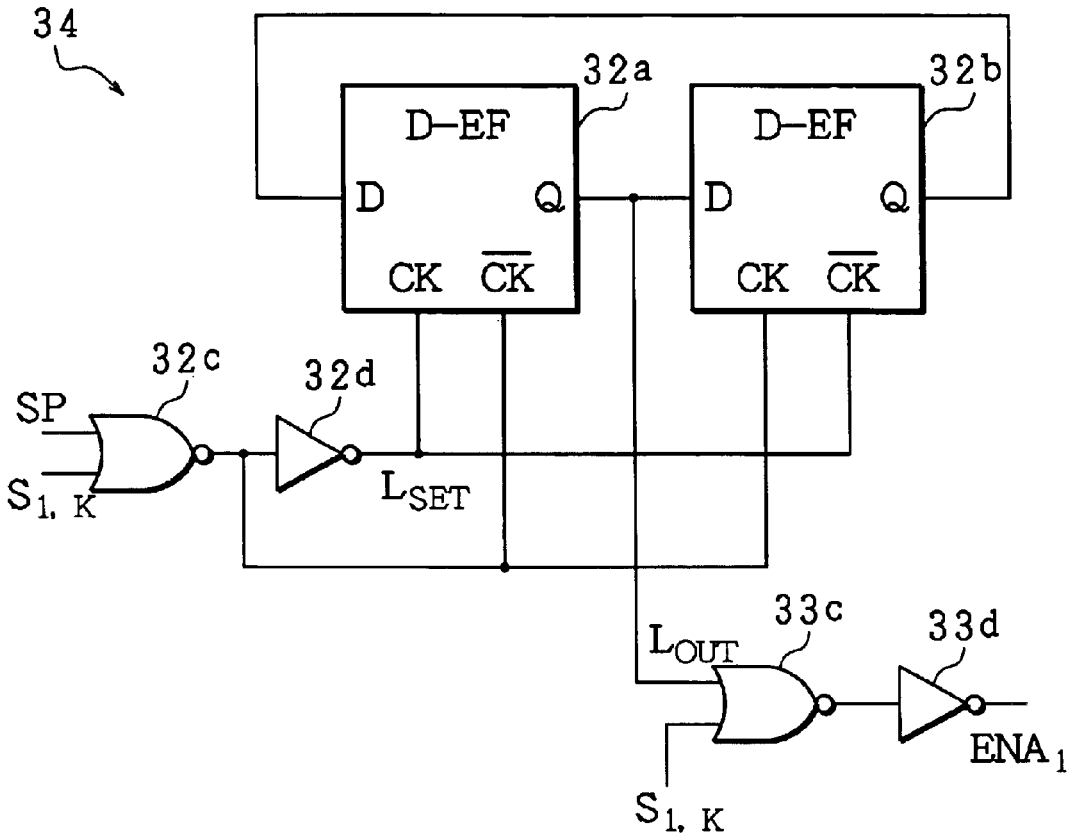
FIG. 33 is a block diagram showing another example of the latch circuit.

Here, in FIG. 31, the construction in which the latch circuit 33 is constituted by the SR flip flops is taken as an example. However, the construction is not particularly limited. For example, even when a latch circuit 34 of FIG. 33 is used instead of the latch circuit $\mathbf{31}_{(i)}$, the same effect can be achieved as long as two signals serve as triggers to control the operation/suspension of the level shifter 13.

Figure 34:
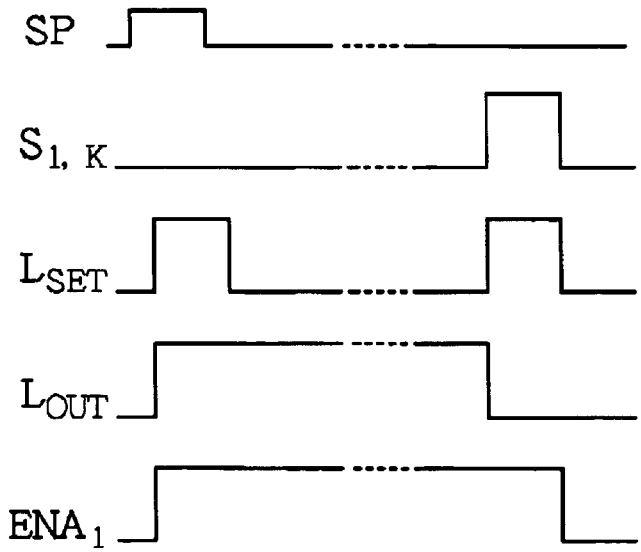
FIG. 34 is a timing chart showing an operation of the latch circuit.

The latch circuit 34 is provided with the NOR circuit 33*c* and the inverter 33*d* of FIG. 31 in addition to a latch circuit 32 of FIG. 28. Consequently, as shown in FIG. 34, the latch circuit 34 can output a high-level control signal $ENA_1$ a) from the start of a pulse input to the D flip flop $\mathbf{F2}_{(i,1)}$ in the first step of the block $B_i$ b) to the end of a pulse output of the D flip flop $\mathbf{F2}_{(i,K)}$ in the final step, so as to instruct an operation to the level shifter $\mathbf{23}_{(i)}$.

Here, in the present embodiment, a) the start of a pulse input to the D flip flop $\mathbf{F2}_{(i,1)}$ of the first step and b) the end of a pulse output of the D flip flop $\mathbf{F2}_{(i,K)}$ of the final step are adopted as the triggers of the latch circuits (33 to 34). However, the triggers are not particularly limited. As the triggers, it is also possible to adopt a signal for setting the control signal $ENA_i$ at an active level before a period when the SR flip flop F1 in the block $B_i$ requires a clock signal $CK_i$, and a signal for setting the control signal $ENA_i$ at an inactive level after the period, in order to achieve the same effect.

[Embodiment 7]

Figure 35:
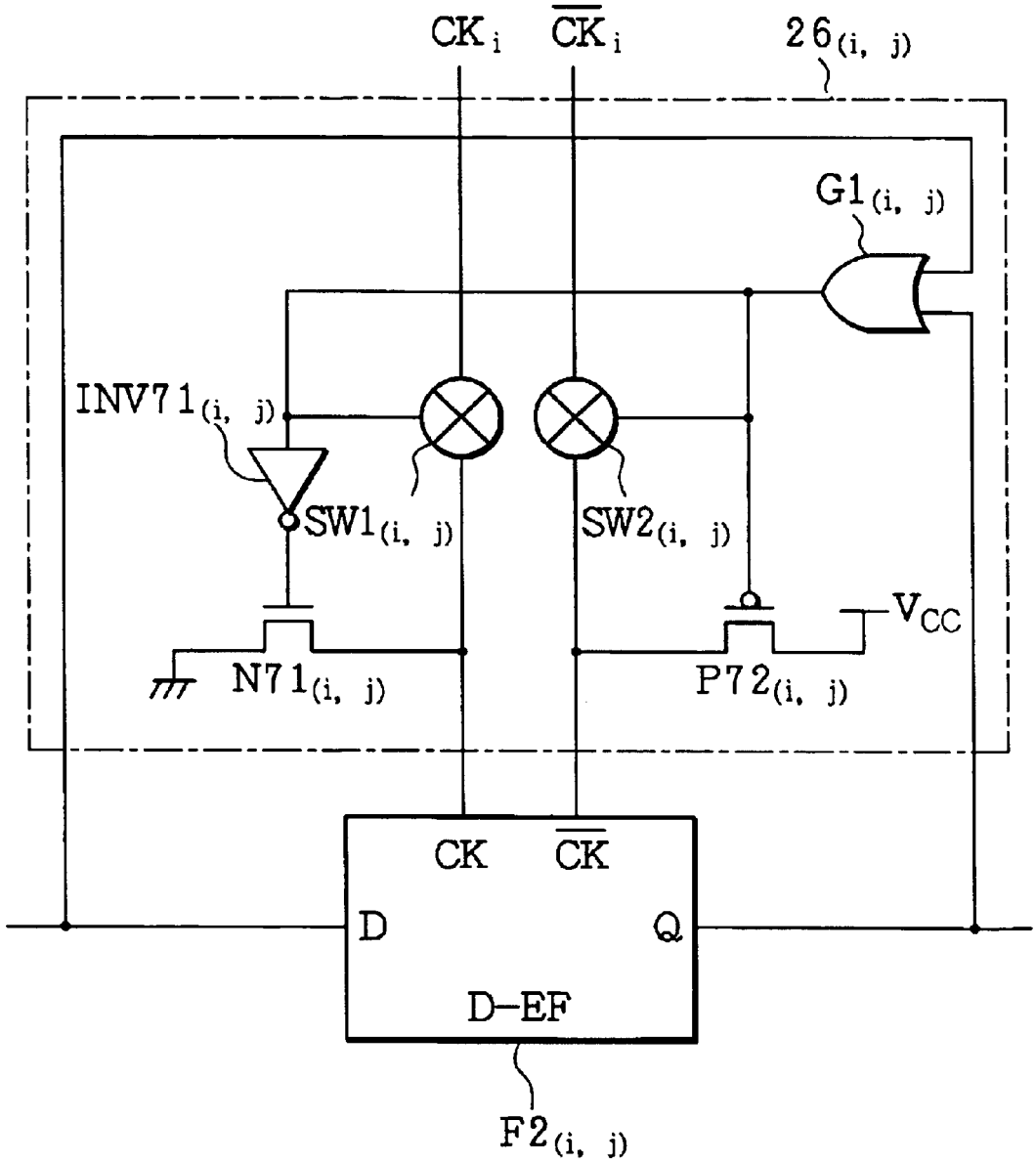
FIG. 35 is a circuit diagram showing a clock signal control circuit which is provided when the level shifter of each block selectively applies a clock signal to the D flip flop in the block, in accordance with still another embodiment of the present invention.

Referring to FIG. 35, the following explanation describes a construction being able to further reduce power consumption, regarding shift registers 21*b* to 21*d*, in which a level shifter 23 (24, 25) applies a clock signal CK to a plurality of D flip flops F2 in the same manner as Embodiments 4 and 6.

To be specific, the shift registers of the present embodiment have the same constructions as the shift registers 21*b* to 21*d* except that a clock signal control circuit $\mathbf{26}_{(i,j)}$ is provided for each of the D flip flops $\mathbf{F2}_{(i,j)}$. Further, the level shifter $\mathbf{23}_{(i)}$ ($\mathbf{24}_{(i)}$, $\mathbf{25}_{(i)}$: hereinafter, represented by $\mathbf{23}_{(i)}$) applies a clock signal $CK_{(i)}$, in which a voltage has been increased, only to the D flip flops F2 requiring a clock input.

As shown in FIG. 35, the clock signal control circuit $\mathbf{26}_{(i,j)}$ is provided with a switch $\mathbf{SW1}_{(i,j)}$ disposed on a signal line for transmitting the clock signal $CK_i$, and a switch $\mathbf{SW2}_{(i,j)}$ disposed on a line for transmitting an inverted signal $CK_i$ bar of the clock signal $CK_i$. In the same manner as the level shifter $\mathbf{23}_{(i,j)}$ of FIG. 8, the switches $\mathbf{SW1}_{(i,j)}$ and $\mathbf{SW2}_{(i,j)}$ are controlled by an OR circuit $\mathbf{G1}_{(i,j)}$ for calculating an OR of the input and the output of the D flip flop $\mathbf{F2}_{(i,j)}$, the switches are brought into conduction when the D flip flop $\mathbf{F2}_{(i,j)}$ requires the clock signal $CK_i$ ($CK_i$ bar) , and the switches are shut off when the clock input is not necessary. Moreover, the clock signal control circuit $\mathbf{26}_{(i,j)}$ is provided with a)an N-type MOS transistor $\mathbf{N71}_{(i,j)}$ disposed between a clock input terminal of the D flip flop $\mathbf{F2}_{(i,j)}$ and a ground potential and b)a P-type MOS transistor $\mathbf{P72}_{(i,j)}$ disposed between an inverted clock input terminal of the D flip flop $\mathbf{F1}_{(i,j)}$ and a driving voltage $V_{CC}$. An output of the OR circuit $\mathbf{G1}_{(i,j)}$ is inverted in an inverter $\mathbf{INV71}_{(i,j)}$, and then, the output is applied to a gate of the transistor $\mathbf{N71}_{(i,j)}$. Meanwhile, the output of the OR circuit $\mathbf{G1}_{(i,j)}$ is applied to the gate of the transistor $\mathbf{P72}_{(i,j)}$.

According to this arrangement, when the corresponding D flip flop $\mathbf{F2}_{(i,j)}$ requires the clock signal $CK_i$ ($CK_i$ bar), whose voltage has been increased, the switch $\mathbf{SW1}_{(i,j)}$ ($\mathbf{SW2}_{(i,j)}$) is brought into conduction so as to apply the clock signal $CK_i$ ($CK_i$ bar) to the D flip flop $\mathbf{F2}_{(i,j)}$. Meanwhile, when the clock input is not necessary, the switches $\mathbf{SW1}_{(i,j)}$ and $\mathbf{SW2}_{(i,j)}$ are shut off. Namely, for example, circuits such as the D flip flop $\mathbf{F2}_{(i,j)}$ following the switches $\mathbf{SW1}_{(i,j)}$ and $\mathbf{SW2}_{(i,j)}$ are separated from the level shifter $\mathbf{23}_{(i)}$. Moreover, when the clock input is not necessary, the transistor $\mathbf{N71}_{(i,j)}$ and $\mathbf{P72}_{(i,j)}$ are brought into conduction so as to maintain the clock input terminal and the inverted input terminal of the D flip flop $\mathbf{F2}_{(i,j)}$ at predetermined values (low level and high level). With this arrangement, it is possible to prevent malfunction of the D flip flop $\mathbf{F2}_{(i)}$, unlike a construction in which the input terminals are irregular.

According to this arrangement, when the clock signal is not necessary, the circuits following the switches $\mathbf{SW1}_{(i,j)}$ and $\mathbf{SW2}_{(i,j)}$ are separated from the level shifter $\mathbf{23}_{(i)}$. Therefore, the level shifter $\mathbf{23}_{(i)}$ needs to drive only the D flip flop $\mathbf{F2}_{(i,j)}$ requiring the clock signal $CK_{(i)}$ at this point. Hence, as compared with a construction in which all the D flip flops $\mathbf{F2}_{(i,1)}$ to $\mathbf{F2}_{(i,K)}$ are driven in the block $B_i$, a loading of the level shifter $\mathbf{23}_{(i)}$ can be considerably reduced, resulting in smaller power consumption. Consequently, it is possible to realize a shift register achieving small power consumption.

In the above description, the construction is taken as an example, in which the clock signal control circuit $\mathbf{26}_{(i,j)}$ is provided for each D flip flop $\mathbf{F2}_{(i,j)}$. However, the construction is not particularly limited. For instance, it is possible to provide the clock signal control circuit 26 for a plurality of the D flip flops F2. In this case, while the D flip flop F2 connected to the switches SW1 and SW2 requires a clock input, namely, a) from the start of a pulse input to the D flip flop F2 of the first step b) to the end of a pulse output of the D flip flop F2 of the final step, the switches SW1 and SW2 are controlled by a circuit such as the OR circuit G3 of FIG. 20 and the latch circuit 33 (34) of FIG. 30 (33); thus, the switches SW1 and SW2 are brought into conduction. In this case, as compared with the construction in which the clock signal control circuit 26 is provided for each of the D flip flops F2, the load capacity of the level shifter 23 (24, 25) is larger. However, the number of the clock signal control circuits 26 is reduced so as to simplify the circuit construction.

[Embodiment 8]

Incidentally, for example, regarding the above Embodiments, in a data signal line driving circuit 3 and a scanning signal line driving circuit 4 of FIG. 2, an output of the shift register (11, 11*a* to 11*c*, 21, 21*a* to 21*d*) in each step may be directly used as a signal for indicating a timing, or a signal, which is obtained by performing a logical operation on outputs of a plurality of the steps, may be used as a timing signal.

Figure 36:
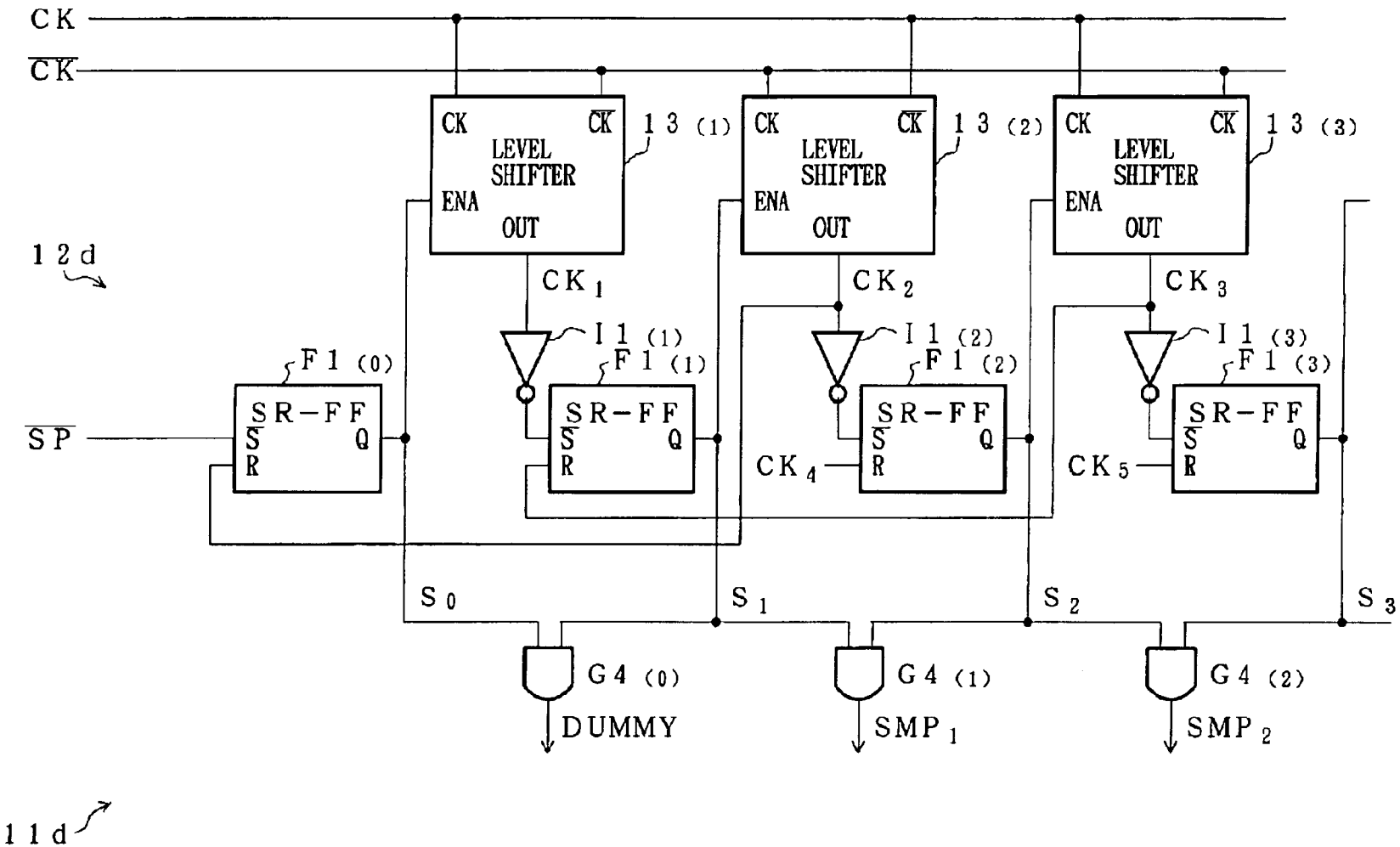
FIG. 36 is a block diagram showing a main part of a shift register in accordance with still another embodiment of the present invention.
Figure 37:
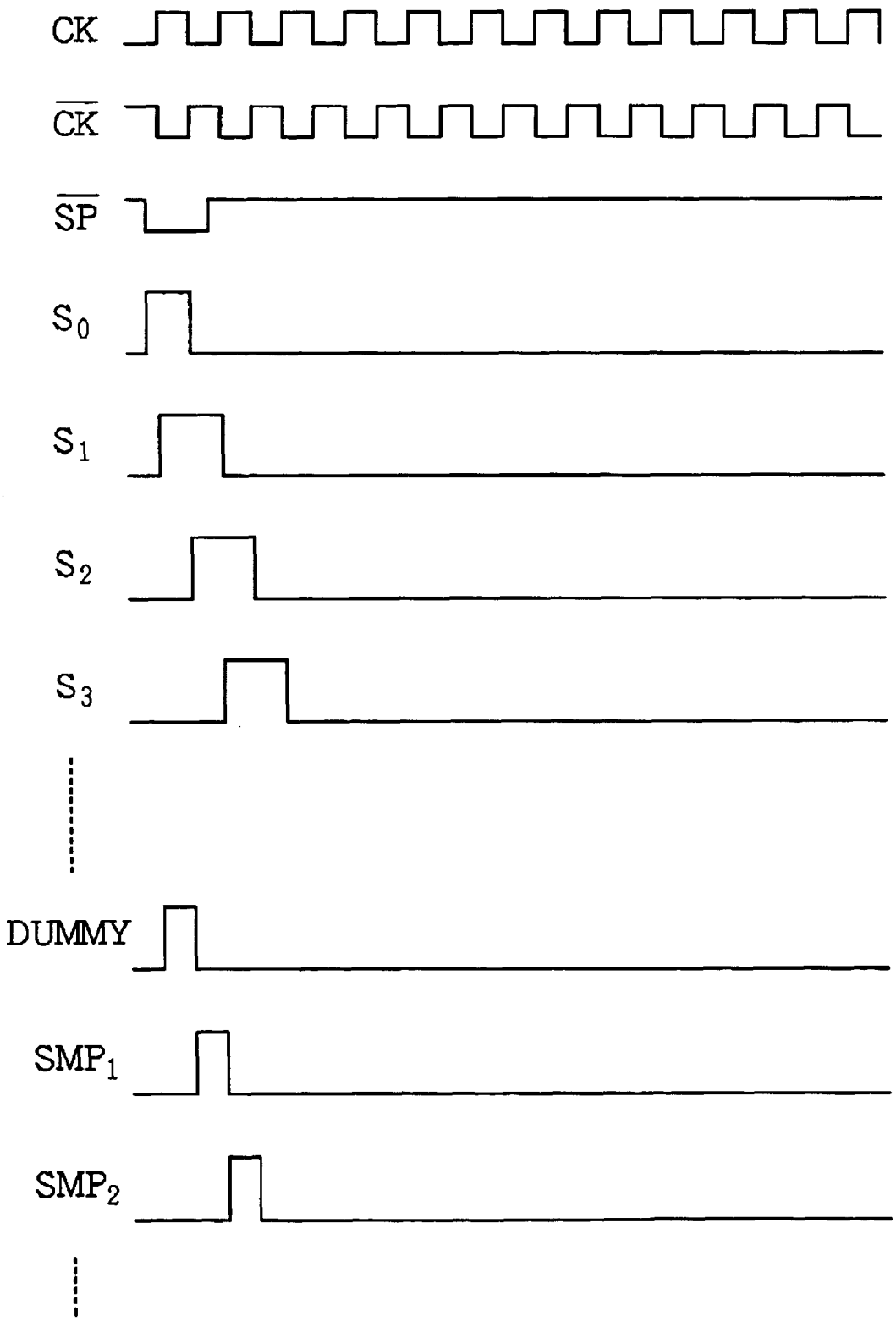
FIG. 37 is a timing chart showing an operation of the shift register.

Referring to FIGS. 36 and 37, the following explanation describes a construction for suitably performing a logical computing outputs of a plurality of steps in a shift register using SR flip flops F1 like Embodiments 1, 3, and 5. Here, the construction can be used in other embodiments as long as the SR flip flop F1 is adopted therein. In the following, Embodiment 1 is taken as an example.

To be specific, with the construction of a shift register 11 of FIG. 1, a shift register lid of the present embodiment is provided with an AND circuit $G4_{(i)}$ which computes an AND of two outputs $S_i$ and $S_{i+1}$ being adjacent to each other, and outputs the result as a timing signal $SMP_i$. Further, before an SR flip flop $F1_{(1)}$ of the first step, an SR flip flop $F1_{(0)}$ is provided, and an AND circuit $G4_{(0)}$ is provided for computing an AND of an output SO of the SR flip flop $F1_{(0)}$ and an output $S_1$ and for outputting the result. Moreover, an inverse signal SP bar of a start signal SP is applied to the SR flip flop $F1_{(0)}$ as a set signal having a negative logic. The output of the SR flip flop $F1_{(0)}$ is inputted to a level shifter $13_{(1)}$ of the following step as a control signal $ENA_1$. Additionally, an output $CK_2$ of a level shifter $13_{(2)}$ is applied to the SR flip flop $F1_{(0)}$ in the same manner as the SR flip flop $F1_{(i)}$ of other steps. The level shifter $13_{(2)}$ corresponds to the number of steps (two steps in this case) according to a pulse width of a transmitted pulse signal.

In this construction, among outputs $S_0$, $S_1$, and later of the SR flip flops $F1_{(0)}$, $F1)_1$, and later, only the output $S_0$ is connected to a single AND circuit $G4_{(0)}$. Meanwhile, each of the other outputs $S_i$ is connected to two circuits of AND circuits $G4_{(i-1)}$ and $G4_{(0)}$. As a result, the SR flip flop $F1_{(0)}$ and the other SR flip flops $F1_{(i)}$ have different outputting loads. For this reason, even if the SR flip flop $F1_{(0)}$ and the other SR flip flops $F1_{(i)}$ are driven at the same timing, the output $S_0$ and the other outputs $S_1$ and later are different from one another in a delay time to a clock signal CK. Therefore, in the case of a high frequency of the clock signal, it is necessary to reduce irregular timings resulted from a shift of a delay time. Hence, a dummy signal DUMMY, which is not used in the following circuits, is used as an output signal of the AND circuit $G4_{(0)}$, and only outputs $SMP_1$ and later of the AND circuits $G4_{(1)}$ and later are used for extracting an image signal.

In the above construction, unlike the other steps, the inverse signal SP bar, which is not in synchronization with the clock signal CK, is applied to the SR flip flop $F1_{(0)}$ as a set signal having a negative logic. Thus, a timing (a rising edge, a pulse width, etc.) of the output $S_0$ is different from those of the outputs $S_1$ and later of the SR flip flop $F1_{(1)}$ and later. However, as mentioned above, the output $S_0$ is not used in the following circuits as the dummy signal DUMMY. Therefore, even if the timing of the output $S_0$ is different, the shift register 11*d* can output the timing signal $SMP_1$ and later whose timings differ between predetermined time periods, without any problems.

Furthermore, in the above construction, the inverse signal SP bar is applied to the SR flip flop $F1_{(0)}$, and the level shifters 13 are omitted. Consequently, as compared with a construction in which the SR flip flop $F1_{(0)}$ is provided with the level shifters 13, the number of the level shifters 13 can be reduced.

Figure 38:
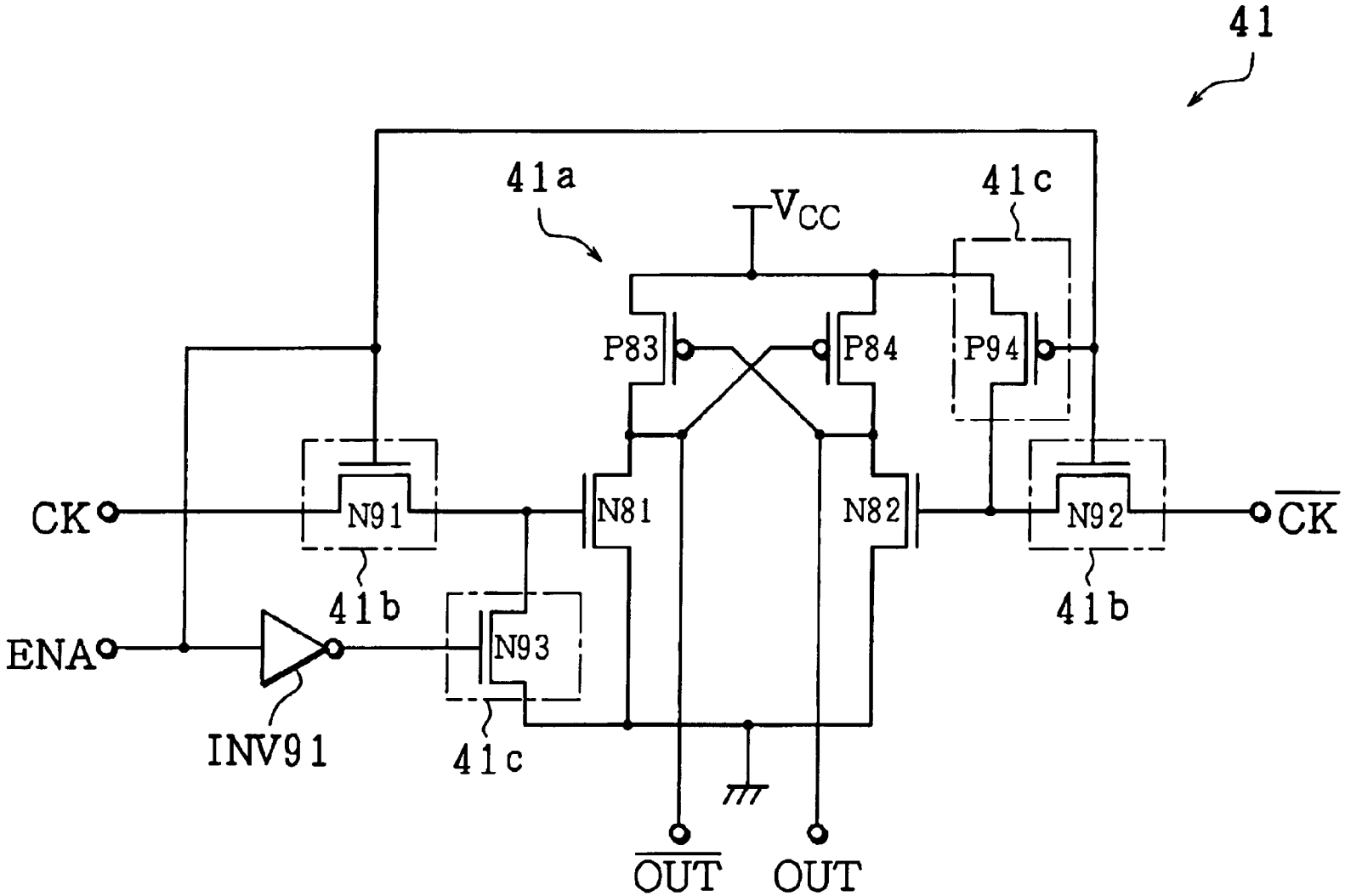
FIG. 38 is a circuit diagram showing a voltage-driven level shifter in accordance with a variation of the present invention.
Figure 39:
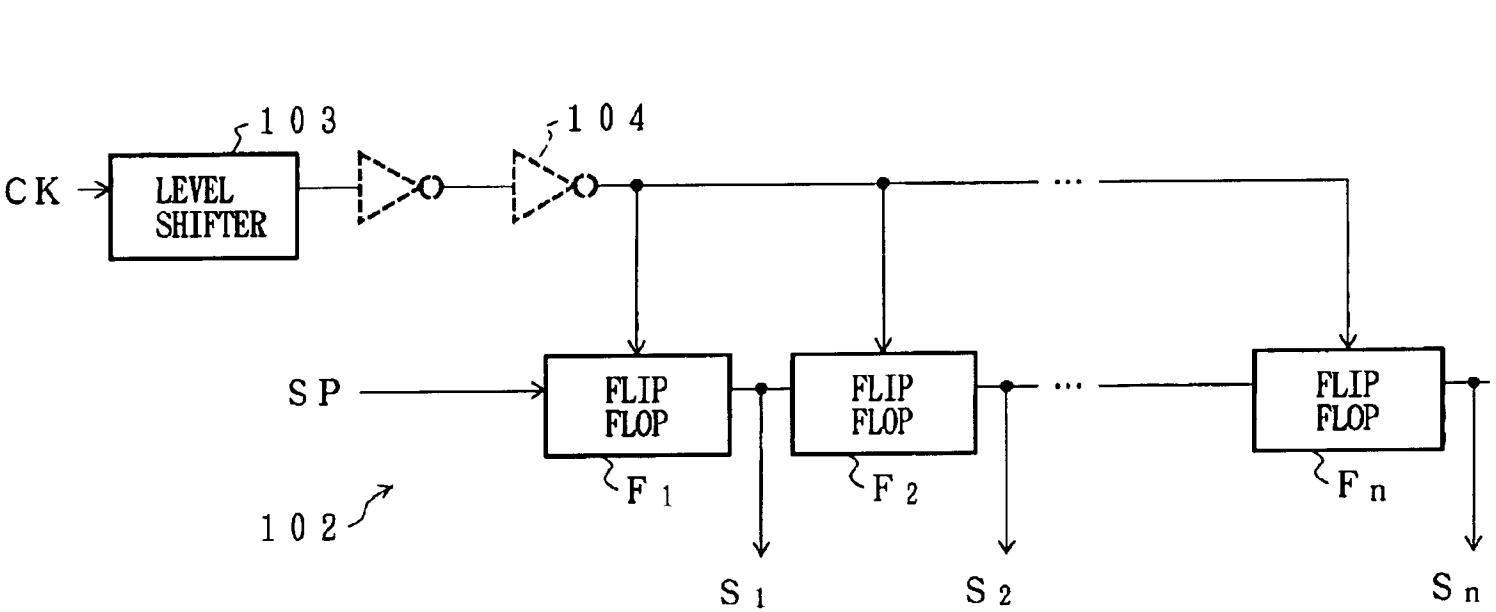
FIG. 39 is a block diagram showing a shift register including a level shifter in accordance with a conventional art.

Additionally, in Embodiments 1 to 8, the current-driven level shifters (13, 14, and 23 to 25) are taken as examples. However, as shown in FIG. 38, a voltage-driven level shifter 41 is also available. As an input switching element, a level shift section 41a of the level shifter 41 is provided with an N-type MOS transistor N81 which is conducted/shut off in response to a clock signal CK, and an N-type MOS transistor N82 which is conducted/shut off in response to an inverse signal CK bar of the clock signal CK. To a drain of each of the transistors N81(N82), a driving voltage $V_{CC}$ is applied via P-type MOS transistors P83(P84) acting as loads. Meanwhile, the sources of the transistors N81 and N82 are grounded. Moreover, a potential at a connecting point between the transistors N82 and P84 is outputted as an output OUT of the level shifter 41. Further, the potential at the connecting point between the transistors N82 and P84 is also applied to a gate of the transistor P83. In the same manner, a potential at a connecting point between the transistors N81 and P83 is outputted as an inverse output OUT bar of the level shifter 41 and is applied to the gate of the transistor P84.

On the other hand, the level shifter 41 is provided with N-type MOS transistors N91 and N92 serving as input release switch sections (switch) 41*b*. When the level shifter 41 is operated, the clock signal CK is applied to the gate of the transistor N81 via the transistor N91. Furthermore, the inverse signal CK bar of the clock signal CK is applied to the gate of the transistor N82 via the transistor N92.

Additionally, the level shifter 41 is provided with an N-type MOS transistor N93 and a P-type MOS transistor P94 serving as input stabilizing sections 41*c*. With this arrangement, when the level shifter 41 is suspended, the gate of the transistor N81 is grounded via the transistor N93. Meanwhile, the driving voltage $V_{CC}$ is applied to the gate of the transistor N82 via the transistor P94. Moreover, the input stabilizing sections 41*c* correspond to outputting stabilizing means described in claims so as to control voltage inputted to the transistors N81 and N82 and to stabilize an output. Here, the level shifter 41 is driven by voltage so as to consume electricity only when the output OUT is changed. Hence, even when an output voltage is controlled by an input voltage during the suspension of the level shifter 41, electricity is not consumed.

In the present embodiment, when a control signal ENA is at a high level, an instruction is provided for operating the level shifter 41. Therefore, the control signal ENA is applied to the gates of the transistors N91, N92, and P94. On the other hand, the control signal ENA is inverted in an inverter INV91 and is applied to the transistor N93.

In the above construction, when the control signal ENA is at a high level, the transistors N91 and N92 are brought into conduction. Further, the transistors N81 and N82 are conducted/shut off in response to the clock signal CK and the inverse signal CK bar. With this arrangement, the output OUT rises to the driving voltage $V_{CC}$ when the clock signal CK is at a high level. Meanwhile, when the clock signal CK is at a low level, the output OUT is at a ground level.

In contrast, when the control signal ENA is at a low level, the transistors N93 and P94 are brought into conduction. Thus, the transistor N81 is shut off and the transistor N82 is brought into conduction. Consequently, the output OUT is maintained at a ground level, and the inverse output OUT bar is maintained at the driving voltage $V_{CC}$. Furthermore, in this state, the transistors N91 and N92 are shut off. Therefore, the gate of the transistor N81 (N82) serving as the input switching element is separated from a line for transmitting the clock signal CK (CK bar). This arrangement makes it possible to reduce the load capacity and power consumption of a driving circuit of the clock signal CK (CK bar), for example, the control circuit 5 of FIG. 2.

Here, in FIG. 38, in the same manner as level shifters 13 and 23, the operation/suspension is controlled by a single control signal ENA; however, the number of the transistors N91 to P94 and the inverter INV91 is increased according to the number of the control signals ENA in the same manner as level shifters 14, 24, and 25, so that the operation/suspension can be controlled by a plurality of the control signals ENA.

Even when the level shifters 41 having the above constructions are used, a plurality of the level shifters 41 are provided, and at least one of them requiring no clock output is suspended. Therefore, as compared with the construction in which a single level shifter applies a clock signal to all flip flops of a shift register, it is possible to reduce the load capacity of each of the level shifters. Furthermore, power consumption of the shift registers can be smaller.

However, in the current-driven level shifter 13 (14, 23 to 25: hereinafter, represented by the level shifter 13), a current is continuously applied to the input switching elements (P11 and P12) during the operation. Therefore, even when the level shifter 41 cannot operate because the clock signal CK is lower in an amplitude than a threshold value of the input switching elements (transistors N81 and N82), a voltage of the clock signal CK can be increased without any problems. Moreover, the level shifters 13 are suspended according to the necessity for the clock output; hence, despite that a plurality of the level shifters 13 which consume electricity even when an output is not changed, it is possible to reduce an increase in power consumption. For this reason, a current-driven type level shifter 13 is more preferable than a voltage-driven type.

Additionally, in Embodiments 3 to 7, the construction is taken as an example in which each of the level shifters (13, 14, and 23 to 25) is provided for every K pieces of flip flops (F1 and F2). However, even when each block differs in the number of the flip flops, it is possible to achieve virtually the same effect as long as the shift registers are divided into a plurality of blocks and the level shifters are respectively provided in the blocks.

Furthermore, in the present embodiment, the shift register is adopted in an image display apparatus; however, the shift register can be widely adopted as long as the clock signal CK is applied with an amplitude lower than a driving voltage of the shift register. Here, in the case of the image display apparatus, more resolution and a larger display area are strongly demanded, so that a large number of the shift registers are provided and a driving capability of the level shifter cannot be sufficiently secured. For this reason, the shift register with the above construction is particularly effective for a driving circuit of the image display apparatus.

As described above, a shift register of the present invention, in which a plurality of flip flops are connected, is characterized by including a plurality of level shifters for level-shifting a clock signal, the level shifter being provided for every predetermined number of the flip flops.

According to the above arrangement, as compared with a construction in which a single level shifter applies a level-shifted clock signal to all flip flops, a distance between the level shifter and the flip flop is smaller. As a result, a distance for transmitting a level-shifted clock signal can be shorter so as to decrease a load capacity of the level shifter and to reduce the need for a driving capability of the level shifter. With this arrangement, for example, even in the case of a small driving capability of the level shifter and a long distance between the ends of the flip flop, it is possible to eliminate the necessity for a buffer between the level shifter and the flip flop so as to reduce power consumption of the shift register.

Further, in the shift register having the above construction, at least one of a plurality of the level shifters is preferably suspended.

The above construction makes it possible to reduce power consumption of the shift register as compared with a construction in which all the level shifters are simultaneously operated. As a result, it is possible to achieve the shift register which can operate by a low-voltage input of a clock signal and with small power consumption.

Moreover, in the shift register having the above construction, it is more desirable that each of the level shifters be operated only when a corresponding block includes the flip flops which require an input of a clock signal at that point.

According to the above construction, only the level shifter required for transmitting an input pulse is operated. Thus, as compared with the construction in which all the level shifters are operated, it is possible to dramatically reduce power consumption of the shift register. Additionally, a construction is also available in which some of the level shifters are temporarily operated. At least one of the level shifters is temporarily operated, so that power consumption is smaller as compared with the construction in which all the level shifters are continuously operated.

Further, the shift registers with the above arrangements are also allowed to have a construction in which a specific block of the blocks includes set reset flip flops acting as the above flip flops, that are set in response to the clock signal, and a specific level shifter corresponding to the specific block starts its operation at the start of a pulse input to the specific block, and the specific level shifter stops its operation after the flip flop is set at the final step of the specific block.

According to the above construction, the specific level shifter applies a level-shifted clock signal if necessary during the operation of the set reset flip flops in the specific block, and when a clock signal input to the set reset flip flop is not necessary, the operation is suspended. As a result, it is possible to reduce power consumption of the level shifters, which include the set reset flip flops as the above flip flops, and operate faster than a construction including D flip flops.

Furthermore, when the shift register with the above arrangement includes only one of the flip flops (set reset flip flops) in the specific block, the specific level shifter is allowed to start its operation at the start of a pulse input to the specific block, and the specific level shifter is also allowed to suspend its operation at the end of the pulse input.

According to the above arrangement, to control the operation/suspension of the specific level shifter, an input pulse is used when the specific block is at the first step, and an output of the previous flip flop is used in other cases. Consequently, it is not necessary to provide another circuit for judging an operation period of the specific level shifter, thereby simplifying the construction of the shift register.

Meanwhile, regarding the shift register with the above arrangement, when the specific block includes a plurality of the flip flops, the specific level shifter can operate during a pulse input to the specific block and during a pulse output performed by one of the flip flops of steps other than the final step of the specific block.

According to the above arrangement, it is possible to control the operation/suspension of the specific level shifter according to the input to the specific block and the output of the flip flop in the specific block. Here, the operation period can be obtained by, for example, computing an OR of the pulse signals. Hence, for example, as compared with a construction in which a counter for counting the number of the clocks for computing the operation period without using inputs and outputs of the flip flops, it is possible to compute the operation period with a simple circuit. Consequently, it is possible to achieve the simple shift register with a high operation speed.

Moreover, in the shift register with the above arrangement, when the specific block includes a plurality of the flip flops, the specific level shifter is also allowed to include a latch circuit for changing an output in response to a signal inputted to the specific block and an output signal of the flip flop of the final step in the specific block.

In the above arrangement, when a signal is inputted to the specific block, the latch circuit changes an output. The specific level shifter starts its operation in response to an output of the latch circuit. Afterwards, the latch circuit maintains the output until the flip flop of the final step outputs a signal. With this arrangement, while a signal is transmitted into the specific block, the specific level shifter continues its operation. Further, when the flip flop of the final step outputs a signal, the latch circuit changes the output so as to suspend the operation of the specific level shifter. Here, the shift register transmits a signal; thus, the operation period of the specific level shifter can be precisely recognized only by monitoring a signal serving as a trigger for the operation/suspension of the specific level shifter, namely, a signal inputted to the specific block and a signal outputted from the flip flop of the final step.

According to the above arrangement, the output of the latch circuit is changed in response to the two signals serving as triggers for the operation/suspension of the specific level shifter so as to control the operation/suspension of the specific level shifter. Therefore, unlike the construction in which the operation/suspension is controlled in response to a signal outputted from each of the flip flops, it is possible to eliminate the necessity for a complex circuit construction for judging an operation period, even when a large number of the flip flops are provided in the specific block. Consequently, the shift register can be achieved with a simple circuit construction even in the case of a large number of the flip flops.

On the other hand, the present invention is also applicable to a construction in which a specific block among the blocks includes D flip flops as the above flip flops as well as the construction in which the set reset flip flops are included as the above flip flops. In this case, it is more desirable that the specific level shifter corresponding to the specific block start its operation at the start of a pulse input to the specific block, and the specific level shifter stop its operation at the end of a pulse output of the flip flop of the final step in the specific block.

According to the above arrangement, the specific block includes the D flip flops as the flip flops. Thus, unlike the construction including the set reset flip flops, it is possible to transmit an input pulse without any problems even when a pulse width (clock number) of the input pulse is changed. Moreover, in the above arrangement, the specific level shifter applies a level-shifted clock signal if necessary during the operation of the D flip flops in the specific block, and the specific level shifter stops its operation when a clock signal does not need to be inputted to the D flip flops. Consequently, it is possible to transmit input pulses having different pulse widths and to realize the shift register achieving small power consumption.

Additionally, a period from a)a pulse input to the specific block to b) a pulse output from the flip flop of the final step is obtained by, for example, computing an OR of a pulse signal inputted to the specific block and an output signal from the flip flop of each step, and latching a signal serving as a trigger. Therefore, in this case, it is possible to simplify the circuit construction of the shift register as compared with computing an operation period without using the input and output of the flip flop.

Moreover, in the shift register with the above arrangement, when the specific block includes a plurality of the flip flops, the specific level shifter is also allowed to include a latch circuit for changing an output in response to a signal inputted to the specific block and an output signal from the flip flop of the final step in the specific block.

According to the above arrangement, the output of the latch circuit is changed in response to the two signals serving as triggers for the operation/suspension of the specific level shifter so as to control the operation/suspension of the specific level shifter. Therefore, unlike the construction in which the operation/suspension is controlled in response to a signal outputted from each of the flip flops, it is possible to eliminate the necessity for a complex circuit construction for judging an operation period even when a large number of the flip flops are provided in the specific block. Consequently, the shift register can be achieved with a simple circuit construction even in the case of a large number of the flip flops.

Furthermore, in the shift register with the above arrangement, the level shifter is also allowed to include a current-driven level shift section in which input switching elements for applying the clock signal are continuously brought into conduction during the operation.

According to the above construction, the input switching elements of the level shifter are continuously conducted while the level shifter is operated. Therefore, unlike a voltage-driven level shifter for conducting/shutting off the input switching elements according to a level of the clock signal, even when an amplitude of a clock signal is lower than a threshold voltage of the input switching element, the clock signal can be level-shifted without any problems.

Furthermore, the current-driven level shifter is larger in power consumption than the voltage-driven level shifter because the input switching elements are brought into conduction during the operation; however, at. least one of a plurality of the level shifters suspends its operation. Hence, it is possible to achieve the shift register being able to level-shift even when an amplitude of the clock signal is lower than the threshold voltage of the input switching elements and the shift register consumes smaller electricity than the construction in which all the level shifters are simultaneously operated.

Also, the shift register with the above arrangement is also allowed to include an input signal control section which applies, as an input signal to the level shift section, a signal at a level for shutting off the input switching elements so as to suspend the level shifter.

According to the above arrangement, for example, when the input switching elements are MOS transistors, in the case of an input signal applied to the gate, an input signal at a level for shutting off between a drain and a source is applied to the gate so as to shut off the input switching elements. Also, when an input signal is applied to the source, for example, an input signal virtually identical to that of the drain is applied so as to shut off the input switching elements.

In any one of the above arrangements, when the input signal control section controls a level of an input signal so as to shut off the input switching elements, the current-driven level shifter suspends its operation. With this arrangement, the input signal control section can suspend the level shifter, and during the suspension, power consumption can be reduced by current applied to the input switching elements during the operation.

Meanwhile, each of the level shifters with the above arrangements is also allowed to include a power supply control section which suspends power supply to each of the level shift sections so as to suspend the level shifter.

With this arrangement, the power supply control section can suspend the level shifter by interrupting power supply to each of the level shift sections, and during the suspension, power consumption can be reduced by electricity consumed in the level shifters during the operation.

Incidentally, during the suspension of the level shifter, when an output voltage of the level shifter becomes irregular, the flip flops connected to the level shifter may operate in an unstable manner.

Therefore, in the shift registers with the above arrangements, it is more desirable that the level shifter include an output stabilizing means for maintaining an output voltage at a predetermined value.

According to the above arrangement, an output voltage of the level shifter is maintained at a predetermined value by the output stabilizing means. As a result, it is possible to prevent malfunction of the flip flops that is caused by an irregular output voltage, thereby achieving the more stable shift register.

Furthermore, it is more desirable that each of the shift registers having the above arrangement include a clock signal line where the clock signal is transmitted, and switches which are disposed between the clock signal line and the level shift section and are opened during the suspension of the level shifter. Additionally, the switches can be also provided as a part of the input signal control section.

According to the above arrangement, unlike the construction in which all the level shifters are continuously connected to the clock signal line and the input switching elements of all the level shift sections act as loads on the clock signal line, only the input switching elements of the level shifters under operation are connected to the clock signal line. Moreover, during the suspension, even when the switch is opened and an input of the level shifter becomes irregular, the output stabilizing means maintains an output of the level shifter at a predetermined value. Therefore, this arrangement does not cause malfunction of the flip flops. Consequently, it is possible to reduce a load capacity of the clock signal line and to realize smaller power consumption of the circuit for driving the clock signal line.

Meanwhile, in order to solve the aforementioned problems, an image display apparatus of the present invention, which includes a plurality of pixels disposed in a matrix form; a plurality of data signal lines disposed for each row of the pixels; a plurality of scanning lines disposed for each column of the pixels; a scanning signal line driving circuit for successively applying scanning signals with different timings to the scanning signal lines in synchronization with a first clock signal having a predetermined period; and a data signal line driving circuit for extracting data signals from image signals applied to the pixels on the scanning lines where the scanning signals are applied, the image signals being successively applied in synchronization with a second clock signal having a predetermined period, the image signals indicating a display state of each of the pixels, wherein at least one of the data signal line driving circuit and the scanning signal line driving circuit is provided with a shift register having any one of the aforementioned arrangements, in which the first or the second clock signal serves as the clock signal.

In such an image display apparatus, the more data signal lines, or the more scanning lines, the more flip flops are accordingly provided so as to increase a distance between the ends of the flip flop. However, the shift registers with the aforementioned arrangements make it possible to reduce a buffer and power consumption even in the case of a small driving capability of the level shifter and a long distance between the ends of the flip flop.

Therefore, at least one of the data signal line driving circuit and the scanning signal line driving circuit is provided with the shift registers according to. the aforementioned arrangements so as to realize the image display apparatus achieving small power consumption.

Namely, an image display apparatus includes a data signal extract means for extracting a data signal corresponding to each of the pixels from an image signal in synchronization with a clock signal; and a data signal output means for outputting the data signal to each of the pixels, wherein a shift register of the present invention is adopted for the data signal extract means so as to realize the image display apparatus achieving small power consumption.

Further, in the image display apparatus having the above arrangement, it is more desirable that the data signal line driving circuit, the scanning signal line driving circuit, and the pixels be formed on the same substrate.

According to the above arrangement, the data signal line driving circuit, the scanning signal line driving circuit, and the pixels are formed on the same substrate. Wires between the data signal line driving circuit and the pixels and wires between the scanning signal line driving circuit and the pixels are disposed on the substrate without the need for disposing the wires outside the substrate. As a result, even in the case of a larger number of the data signal lines and the scanning signal lines, it is not necessary to change the number of signal lines disposed outside the substrate, achieving fewer steps for assembling the circuit. Furthermore, it is not necessary to dispose terminals for connecting the signal lines and the outside of the substrate, so that it is possible to prevent an excessive increase in capacities of the signal lines, thereby preventing a decrease in a degree of integration.

Incidentally, with a polycrystalline silicon thin film, it is more easier to expand a substrate area as compared with a monocrystalline silicon thin film; however, a polycrystalline silicon transistor is inferior in a transistor property such as mobility and a threshold value as compared with a monocrystalline silicon transistor. Therefore, when the monocrystalline silicon transistor is used for manufacturing the circuits, it is difficult to expand a display area; meanwhile, when the polycrystalline silicon thin film transistor is used for manufacturing the circuits, the driving capabilities of the circuits become smaller. Additionally, when the driving circuits and the pixels are formed on the different substrates, it is necessary to connect the substrates via signal lines, resulting in more steps in the manufacturing process and an increase in the capacities of the signal lines.

For this reason, in the image display apparatus according to the aforementioned arrangements, it is more desirable that the data signal line driving circuit, the scanning line driving circuit, and the pixels include switching elements formed by a polycrystalline silicon thin film transistor.

According to the above arrangement, the data signal line driving circuit, the scanning line driving circuit, and the pixels include switching elements formed by a polycrystalline silicon thin film transistor so as to readily increase a display area. Furthermore, these members can be readily formed on the same substrate so as to reduce the steps of the manufacturing process and the capacities of the signal lines. Additionally, with the shift registers according to the aforementioned arrangements, a level-shifted clock signal can be applied to each of the flip flops without any problems even in the case of a low driving capability of the level shifter. Consequently, it is possible to realize the image display apparatus achieving small power consumption and a large display area.

Moreover, in the image display apparatus according to the aforementioned arrangements, it is more desirable that the data signal line driving circuit, the scanning signal line driving circuit, and the pixels include switching elements manufactured at a process temperature of 600° C. or less.

According to the above arrangement, the process temperature of the switching elements is set at 600° C. or less; thus, even when a normal glass substrate (glass substrate having a deformation point at 600° C. or less) is used as a substrate for each of the switching elements, it is possible to prevent warp and deformation appearing in a process at the deformation point or more. Consequently, it is possible to achieve the image display apparatus which is readily mounted with a larger display area.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shift register for shifting an input pulse in synchronization with a clock signal, the clock signal being smaller in amplitude than a driving voltage of a control circuit, comprising:

flip flops of a plurality of steps that output the input pulse in synchronization with the clock signal, said flip flops being divided into a plurality of blocks, each of the blocks including at least one of said flip flops; and a plurality of level shifters, one of the level shifters corresponding to each of the blocks, wherein each level shifter increases the voltage of the clock signal and applies the clock signal to the corresponding block of flip flops, said shift register transmitting the input pulse in synchronization with the clock signal, wherein when one or more of the blocks does not require input of the clock signal, the corresponding level shifter is suspended at that point.

2. The shift register as defined in claim 1, wherein at least one of said level shifters operates only when a corresponding block includes said flip flop requiring a clock signal input at that point.

3. The shift register as defined in claim 1, wherein each of said level shifters operates only when a corresponding block includes said flip flop requiring a clock signal input at that point.

4. The shift register as defined in claim 1, wherein a specific block of said blocks includes a set reset flip flop serving as said flip flop, said set reset flip flop being set in response to the clock signal, and a specific level shifter corresponding to the specific block starts an operation at a start of a pulse input to the specific block and is suspended after setting said flip flop of a final step in the specific block.

5. The shift register as defined in claim 4, wherein said specific block includes one of said flip flops, and said specific level shifter starts an operation at a start of a pulse input to the specific block and is suspended at an end of the pulse input.

6. The shift register as defined in claim 4, wherein said specific block includes a plurality of said flip flops, and said specific level shifter operates during a pulse input to said specific block and during a pulse output of any one of said flip flops in a step except for the final step in the specific block.

7. The shift register as defined in claim 4, wherein said specific block includes a plurality of said flip flops, and said specific level shifter includes a latch circuit which changes an output in response to a signal inputted to said specific block and an output signal of said flip flop in the final step of said specific block.

8. The shift register as defined in any claim 1, wherein a specific block of said blocks includes a D flip flop as said flip flop, and a specific level shifter corresponding to the specific block starts an operation at a start of a pulse input to the specific block and is suspended after a pulse output of said flip flop of a final step in the specific block.

9. The shift register as defined in claim 8, wherein said specific block includes a plurality of said flip flops, and said specific level shifter includes a latch circuit which changes an output in response to a signal inputted to said specific block and an output signal of said flip flop in the final step of said specific block.

10. The shift register as defined in claim 1, wherein said level shifter includes a current-driven level shift section provided with an input switching element.

11. The shift register as defined in claim 10, wherein said level shifter includes an input signal control section which suspends said level shifter by providing a signal at a level for interrupting said input switching element.

12. The shift register as defined in claim 10, wherein said level shifter includes a power supply control section for suspending power supply to said level shift section so as to suspend said level shifter.

13. The shift register as defined in claim 1, wherein each of said level shifters includes output stabilizing means.

14. The shift register as defined in claim 13, wherein said level shifter includes a clock signal line for transmitting the clock signal, and a switch which is disposed between said clock signal line and said level shift section and is opened during suspension of said level shifter.

15. An image display apparatus comprising data signal extracting means for extracting a data signal corresponding to each pixel from an image signal in synchronization with a clock signal, and data signal output means for outputting the data signal to each of the pixels, wherein said data signal extracting means includes said shift register defined in claim 1.

16. An image display apparatus comprising:

a plurality of pixels disposed in a matrix form, a plurality of data signal lines disposed for each row of said pixels, a plurality of scanning lines disposed for each column of said pixels, a scanning signal line driving circuit for successively applying a scanning signal with different timings to each of said scanning signal lines in synchronization with a first clock signal having a predetermined period, and a data signal line driving circuit for extracting a data signal from an image signal applied to each of said pixels on said scanning line where the scanning signal is applied, and for outputting the data signal to said data signal lines, said image signal being successively applied in synchronization with a second clock signal having a predetermined period, said image signal indicating a display state of each of said pixels, wherein at least one of said data signal line driving circuit and said scanning signal line driving circuit is provided with said shift register defined in claim 1, in which the first or second clock signal serves as said clock signal.

17. The image display apparatus as defined in claim 16, wherein said data signal line driving circuit, said scanning signal line driving circuit, and said pixels are formed on the same substrate.

18. The image display apparatus as defined in claim 16, wherein said data signal line driving circuit, said scanning signal line driving circuit, and said pixels include a switching element composed of a polycrystalline silicon thin film transistor.

19. The image display apparatus as defined in claim 16, wherein said data signal line driving circuit, said scanning signal line driving circuit, and said pixels include a switching element manufactured at a process temperature of 600° C. or less.

20. The shift register as set forth in claim 1, wherein the level shifter operates in response to the input pulse that has been successively transmitted.

21. The shift register as set forth in claim 20, further comprising: a judging section, which identifies, based on the input pulse and an output signal, a level shifter which corresponds to blocks requiring no clock signal input, so as to control the input pulse into the level shifter.

22. The shift register as defined in claim 1, wherein each level shifter operates by receiving, as the input pulse, an output of the flip flop at the previous step.

23. The shift register as defined in claim 22, wherein each level shifter is suspended by receiving, as a reset signal, an output of the level shifter at two steps later.

24. A shift register, in which a plurality of flip flops are connected, for transmitting an input pulse in synchronization with a clock signal, the clock signal being smaller in amplitude than a driving voltage of a control circuit, comprising:

a plurality of level shifters for level-shifting the clock signal, wherein at least one level shifter is provided for a predetermined number of said flip flops, wherein each level shifter increases the voltage of the clock signal and applies the clock signal to each of the corresponding flip flops, wherein when one or more of the level shifters does not require input of the clock signal, the corresponding level shifter is suspended at that point.

25. The shift resister as defmed in claim 24, wherein at least one of a plurality of said level shifters suspends an operation.

26. The shift register as set forth in claim 24, wherein the level shifters operate in response to the input pulse that has been successively transmitted.

27. The shift register as set forth in claim 26, further comprising:

a judging section, which identifies, based on the input pulse and an output signal, a level shifter which corresponds to blocks requiring no clock signal input, so as to control the input pulse into the level shifter.

28. A shift register for shifting an input pulse in synchronization with a clock signal, the clock signal being smaller in amplitude than a driving voltage of a control circuit, comprising:

flip flops of a plurality of steps that output the input pulse in synchronization with the clock signal, said flip flops being divided into a plurality of blocks, each of the blocks including at least one of said flip flops; and a plurality of level shifters that operate by receiving the input pulse, one of the level shifters corresponding to each of the blocks, wherein each level shifter increases the voltage of the clock signal and applies the clock signal to the corresponding block of flip flops, said shift register transmitting the input pulse in synchronization with the clock signal, wherein at least one of said plurality of level shifters corresponding to the block that does not at that point require an input of the clock signal is suspended by a reset in accordance with an output of the level shifter of one of the following blocks.

29. A shift register, in which a plurality of flip flops are connected, for transmitting an input pulse in synchronization with a clock signal by using an output of each flip flop, the output being transmitted to the following flip flop, comprising:

a plurality of level shifters for level-shifting the clock signal, the level shifters operating by receiving the input pulse, wherein at least one level shifter is provided for a predetermined number of said flip flops, wherein each level shifter increases the voltage of the clock signal and applies the clock signal to each of the corresponding flip flops; and each level shifter is reset in accordance with an output of one of the following level shifters.

30. The shift register as defined in claim 29, wherein each level shifter operates by receiving, as the input pulse, an output of the flip flop at the previous step.

31. The shift register as defined in claim 30, wherein each level shifter is suspended by receiving, as a reset signal, an output of the level shifter at two steps later.

* * * * *